US012146312B2

(12) United States Patent
Damboiu

(10) Patent No.: US 12,146,312 B2
(45) Date of Patent: Nov. 19, 2024

(54) MODULAR BUILDING SYSTEM

(71) Applicant: Cristian Marius Damboiu, Howell, MI (US)

(72) Inventor: Cristian Marius Damboiu, Howell, MI (US)

( * ) Notice: Subject to any disclaimer, the term of this patent is extended or adjusted under 35 U.S.C. 154(b) by 258 days.

(21) Appl. No.: 17/979,265

(22) Filed: Nov. 2, 2022

(65) Prior Publication Data

US 2024/0141636 A1 May 2, 2024

(51) Int. Cl.
*E04B 1/24* (2006.01)
*A63H 33/08* (2006.01)

(52) U.S. Cl.
CPC ..... *E04B 1/2403* (2013.01); *A63H 33/088* (2013.01); *E04B 2001/2406* (2013.01)

(58) Field of Classification Search
CPC ..... E04B 1/2403; E04B 2001/2406; A63H 33/088
See application file for complete search history.

(56) References Cited

U.S. PATENT DOCUMENTS 3,221,589 A 12/1965 Vander et al.
3,389,493 A 6/1968 Karl
3,453,927 A 7/1969 Moore
3,667,340 A 6/1972 Black et al.
4,031,678 A 6/1977 Schuring
4,182,072 A 1/1980 Much
4,253,268 A 3/1981 Mayr
4,321,814 A 3/1982 Martin
4,335,553 A 6/1982 Gould
4,582,002 A 4/1986 Wright
4,682,967 A 7/1987 Kao
4,865,499 A 9/1989 Lacey
5,030,051 A 7/1991 Kaneko et al.
5,297,851 A 3/1994 Hekken
5,771,650 A 6/1998 Williams et al.
5,915,901 A 6/1999 Aasgaard
6,663,394 B1 12/2003 Chung
6,923,705 B2 8/2005 DeSalvo et al.
7,096,636 B1 8/2006 Neill et al.
7,566,195 B2 7/2009 Hull
8,197,297 B2 6/2012 Shimizu
8,262,329 B2 9/2012 Wille
8,646,242 B2 * 2/2014 Shapiro ..... E04F 15/10 52/741.1
9,212,684 B2 12/2015 Lee et al.
9,669,457 B2 6/2017 Bigot et al.
10,428,856 B2 10/2019 Mayer
10,570,946 B2 2/2020 Linsel
10,876,564 B2 12/2020 Schnaufer et al.
2011/0033264 A1 2/2011 Frank
2012/0057948 A1 3/2012 Jeon
(Continued)

*Primary Examiner* — Mark R Wendell
(74) *Attorney, Agent, or Firm* — Olav M. Underdal; IDP Patent Services

(57) ABSTRACT

A modular building system includes pluralities of regular and short plates and beams, and a plurality of sticks, all of which include symmetrically and equidistantly positioned holes and pins, such that the plates, beams, and sticks are detachably connectable to form construction assemblies. Also disclosed are related reinforced construction members, block-based construction members, and a threaded tubular rivet that includes holes for pins and accepts a screw for securing plates with a bracket and the screw.

26 Claims, 44 Drawing Sheets

Modular Construction System

(56) References Cited

U.S. PATENT DOCUMENTS

| | | | | |
|---|---|---|---|---|
| 2012/0213961 | A1* | 8/2012 | Graham | A47B 96/201<br>428/131 |
| 2017/0218996 | A1 | 8/2017 | Takeda et al. | |
| 2019/0077237 | A1 | 3/2019 | Sawahata et al. | |
| 2022/0211175 | A1* | 7/2022 | Huggins | F16B 5/0012 |

* cited by examiner

Modular Construction System

Plate

Beam

Stick

P6-11 Smallest Size Regular Plate

P6-22 Regular Plate

P6-22 Regular Plate

P6-11S Smallest Size Short Plate

P6-22S Short Plate

P6-22S Short Plate

P6-10 Smallest Size Regular Beam

P6-20 Regular Beam

P6-20 Regular Beam

P6-10S Smallest Size Short Beam

P6-20S Short Beam

P6-20S Short Beam

T6-1 Smallest Size Stick

T6-2 Stick

T6-2 Stick

Threaded Tubular Rivet

P6R-22 Plate

T6R-2 Stick

P6K-22 Block

P6K-22S Block

T6K-2 Stick

P6K-22 Block

P6K-22S Block

T6K-2 Stick

MODULAR BUILDING SYSTEM

CROSS-REFERENCE TO RELATED APPLICATIONS

N/A.

FIELD OF THE INVENTION

The present invention relates generally to the field of modular building system, and more particularly to methods and systems for structural, decorative or recreational constructions comprised of plates and associated elements.

BACKGROUND OF THE INVENTION

Rapid development of fixed structures can be achieved using prefabricated, standardized components. While many attempts have been made to provide modular building systems for various applications, practical implementations are limited. A large number of proposals are unnecessarily complex, hard to manufacture, expensive or of limited use. They may apply to a certain industry or trade but cannot be expanded to a different area of enterprise.

As such, considering the foregoing, it may be appreciated that there continues to be a need for novel and improved devices and methods for structural, decorative or recreational building systems based on simple components that can be easily assembled.

SUMMARY OF THE INVENTION

The foregoing needs are met, to a great extent, by the present invention, wherein in aspects of this invention, enhancements are provided to the existing models of building systems comprised of modular parts.

In an aspect, a modular building system can include:

a) a plurality of construction members, each including
   i. a plurality of plates, which each can be a regular plate or a short plate;
   ii. a plurality of beams, which each can be a regular beam or a short beam; and
   iii. a plurality of sticks;

wherein each construction member includes symmetrically positioned pins and holes, such that the plates, beams, and sticks are detachably connectable to form construction assemblies.

In a related aspect, the construction members can be reinforced.

In another related aspect, the construction members can be configured as block-based construction members, including only blocks and sticks, which each comprise symmetrically positioned protruding connectors and holes.

In yet a related aspect, the modular building system can further include:

a) a plurality of threaded tubular rivets, which each include holes for pins and are configured to accept a screw for fastening plates with a bracket There have thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. In addition, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
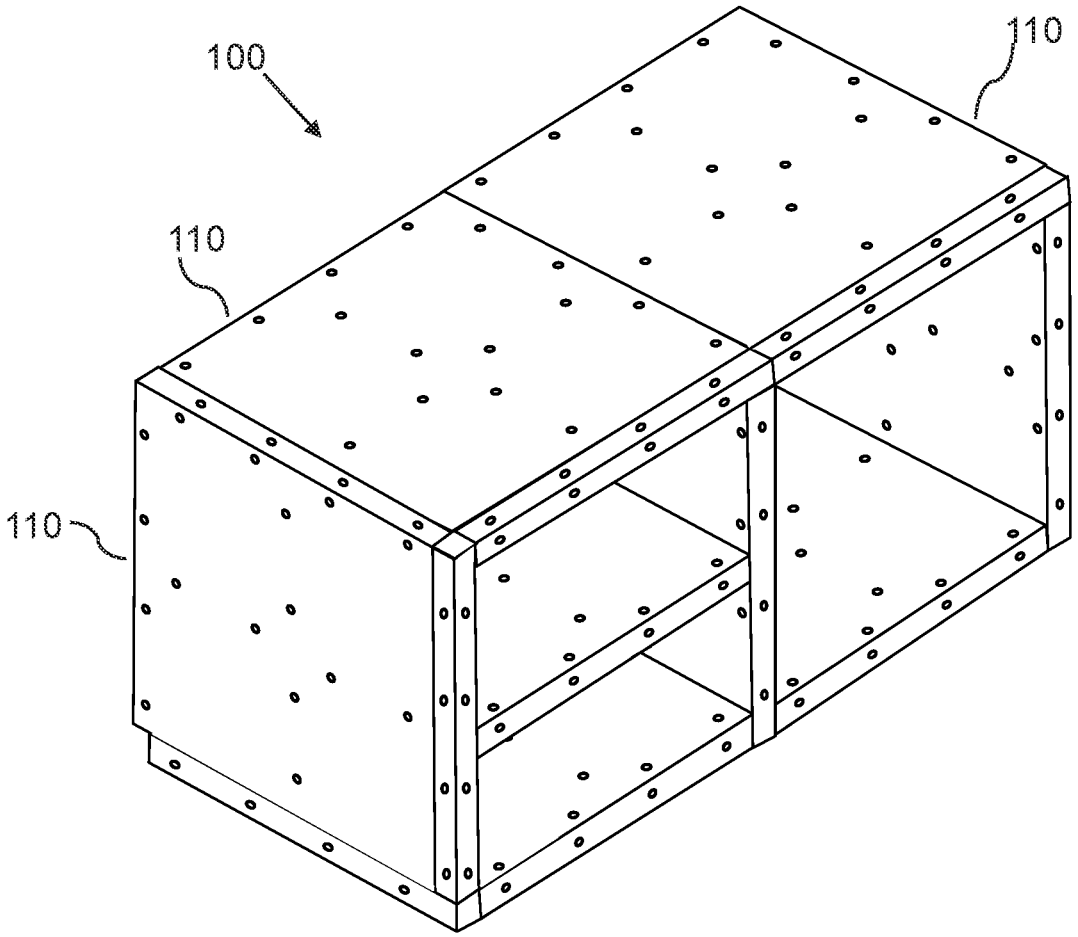
FIG. 1 is a perspective view of a modular building system in an assembled configuration, according to an embodiment of the invention.

Before describing the invention in detail, it should be observed that the present invention resides primarily in a novel and non-obvious combination of elements and process steps. So as not to obscure the disclosure with details that will readily be apparent to those skilled in the art, certain conventional elements and steps have been presented with lesser detail, while the drawings and specification describe in greater detail other elements and steps pertinent to understanding the invention.

The following embodiments are not intended to define limits as to the structure or method of the invention, but only to provide exemplary constructions. The embodiments are permissive rather than mandatory and illustrative rather than exhaustive.

In the following, we describe the structure of an embodiment of a modular building system 100 with reference to FIG. 1, in such manner that like reference numerals refer to like components throughout; a convention that we shall employ for the remainder of this specification.

In a related embodiment, a building system 100 for building modular structures can use a limited number of standard parts, including plates, beams and sticks of predetermined shapes and sizes. The plates can be flat and generally square or rectangular in shape and have holes and pins around their edges. They also have rows of holes running parallel to the edges of the plate. The beams are similar to the plates but of shorter width. The sticks are straight, with a square cross section and holes drilled in two directions perpendicular to their length. The plates, beams and sticks can be assembled with each other in three orthogonal directions to form structures of any complexity that can be expanded or modified at a later time. The number of unique plates, sticks and beams is kept to the minimum necessary to build the above-mentioned structures. The linear dimensions of each plate, stick and beam are tied to their thickness and based on the geometrical progressions of number 2.

The proposed building system aims to eliminate the prior art's drawbacks by using components that are easy to manufacture, store, transport and assemble. The building process is intuitive and, with a little practice, can be mastered by anybody.

The system is based on a limited number of unique plates, beams and sticks that can be assembled with each other, either directly or by using additional joining parts.

Thus, in an embodiment, as shown in FIG. 1, a modular building system 100 can include:

a) a plurality of construction members, each including
   i. a plurality of plates, which each can be a regular plate or a short plate;
   ii. a plurality of beams, which each can be a regular beam or a short beam; and
   iii. a plurality of sticks;

wherein each construction member includes regularly (i.e., equidistantly) positioned pins and holes, such that the plates, beams, and sticks are detachably connectable to form construction assemblies.

Figure 2A:
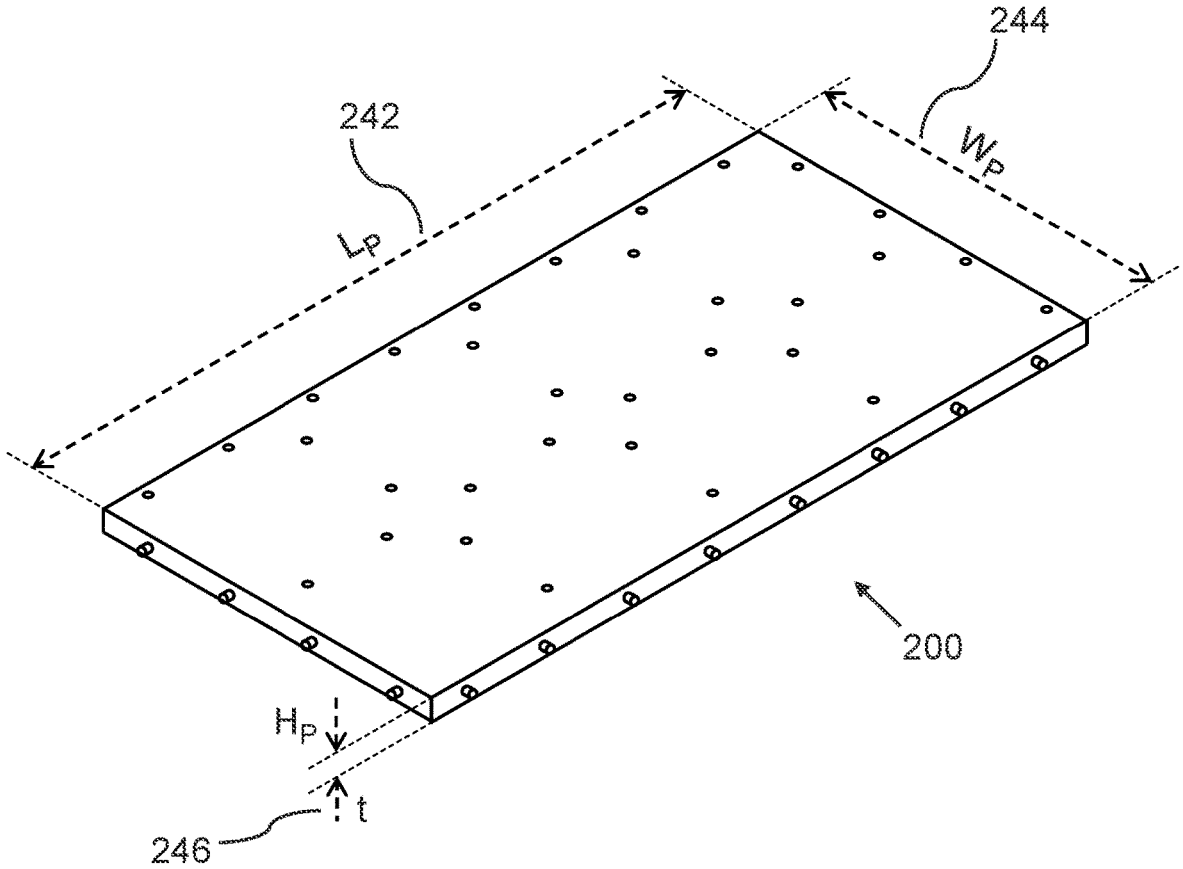
FIG. 2A is a top rear perspective view of a plate of a modular building system, according to an embodiment of the invention.
Figure 2B:
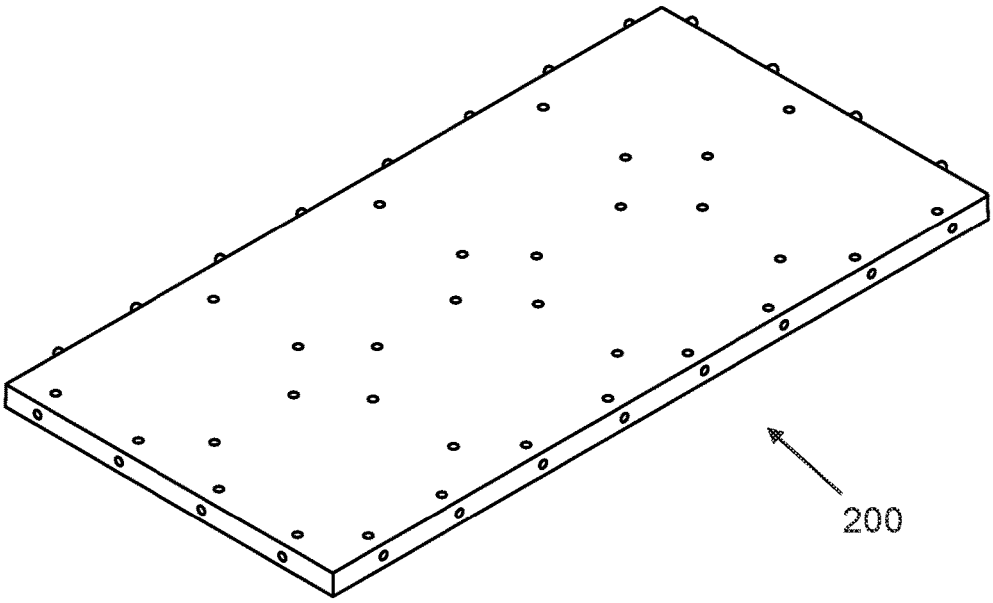
FIG. 2B is a top front perspective view of a plate of a modular building system, according to an embodiment of the invention.

In a related embodiment, as shown in FIGS. 2A-2B, a plate 200 can be a flat board with a square or rectangular shape. The plate length 242, width 244 and height 246 of a plate 200 are based on the formulas:

$$a)\ \text{plate length 242(also denoted by } L_P)=2^i*U-s*t; \quad \text{(Equation 1)}$$

$$b)\ \text{plate width 244(also denoted by } W_P)=2^j*U;\ \text{and} \quad \text{(Equation 2)}$$

$$c)\ \text{plate height/thickness 246(also denoted by } H_P)=t; \quad \text{(Equation 3)}$$

wherein i. i, j=0, 1, 2, 3, . . . ;
ii. U=unit length or width;
iii. s=0 or 1; and
iv. t=plate thickness 246;

such that when s=0 the plate is called a REGULAR plate; and when s=1 the plate is called a SHORT plate.

In related embodiments, the unit length can be any practical number, but for simplicity of design it is preferable to choose U as an even multiple oft. In particular, from hereon we are choosing:

$$a)\ U=2^3*t=8*t \quad \text{(Equation 4)}$$

such that, the dimensions of the smallest regular plate will be:

i. $L_P$=8*t;
ii. $W_P$=8*t; and
iii. $H_P$=t;

and the dimensions of the smallest short plate will be:

iv. $L_P$=7*t;
v. $W_P$=8*t; and
vi. $H_P$=t.

In a related embodiment, the plate thickness 246 can have any value, but to further limit the number of possible combinations it is preferable to pick the thickness from a series of numbers based on the imperial system, as many commercially available materials are delivered in such thicknesses (obviously, the metric system can be used instead).

In another related embodiment, for simplicity, the available thicknesses 246 can include (and in some cases be limited to):

a) ¼", ⅜", ½", ⅝", ¾" and 1";
   which, when expressed in $\frac{1}{8}^{th}$ of an inch, can be abbreviated to:
b) 2, 3, 4, 5, 6, 8;
   such that any number in this series will be referenced as a thickness number.

Thus, in a further related embodiment, in order to easily identify and reference any plate 200, a plate can be characterized by a plate notation, such that a plate 200 can be associated with an alphanumeric code derived by concatenating the letter "P" (for plate), the thickness number, the "dash" character (or other separator), the number of units in its length, the number of units in its width and the letter "S" if the plate is short (no letter if the plate is regular).

Thereby, for example, a regular plate 200 designated by P6-84 will be ¾" thick, 8 units long and 4 units wide. Since a unit "U" based on thickness number 6 is 6" long (8*¾"=6"), the plate will be 48" long (8*6"=48") and 24" wide (4*6"=24").

Thus, a short plate designated by P6-84S will be ¾" thick, 8 units minus one thickness long (or 47¼") and 4 units wide (or 24").

In various related embodiments, in order to create a well-formed assembly 100, all parts used must have the same thickness 246. Since the principle is the same regardless of thickness, in the following considerations we will limit ourselves to plates of ¾" thickness (i.e., thickness number 6).

Figure 3A:
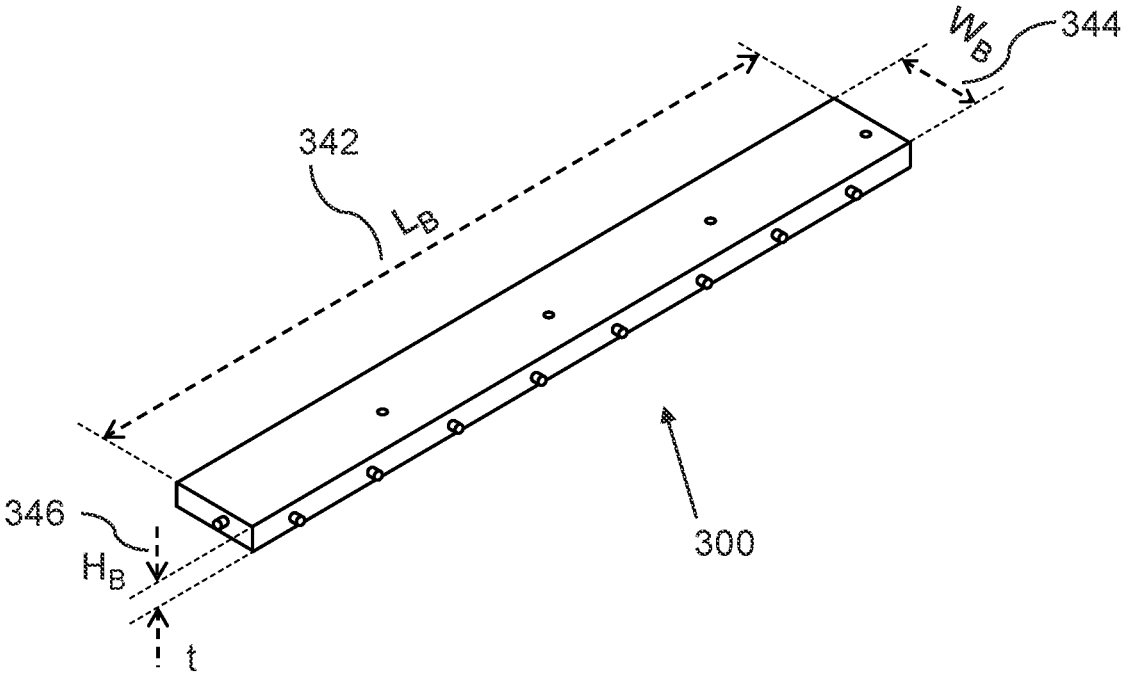
FIG. 3A is a top rear perspective view of a beam of a modular building system, according to an embodiment of the invention.
Figure 3B:
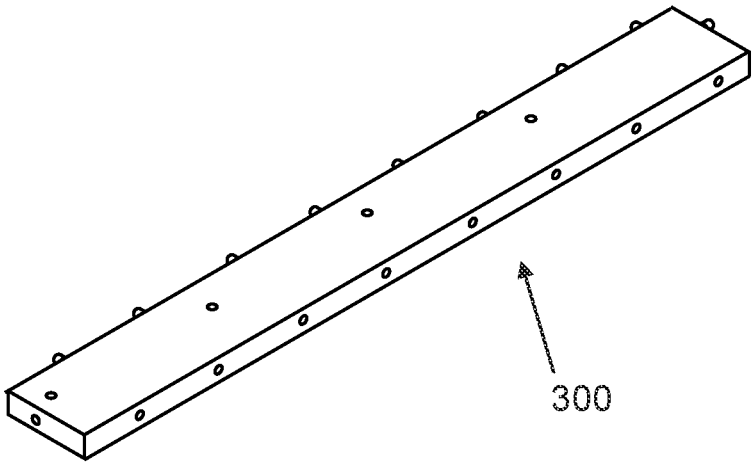
FIG. 3B is a top front perspective view of a beam of a modular building system, according to an embodiment of the invention.

In another related embodiment, as shown in FIGS. 3A and 3B, A BEAM 300 can be similar to a plate 200 except it has a narrower width. Even though the beam width 344 can have any value, for simplification and compatibility with plates we will choose the beam width 344 to be:

$$a)\ \text{Beam Width 344(also denoted by } W_P)=\tfrac{1}{2}*U; \quad \text{(Equation 5)}$$

regardless of beam's length;

also shown are the Beam Length 342 (also denoted by $L_B$) and the Beam Height 346 (also denoted by $H_B$)=t; which are determined similarly for plates, by equations 2 and 3 above.

Similarly, a beam 300 can have an alphanumeric code derived by concatenating the letter "P", the thickness series number, the "dash" character, the number of units in its length, "0" (standing for 0.5) and the letter "S" if the beam is short (no letter if the beam is regular).

Thereby, for example, a P6-80 beam will be ¾" thick, 8 units long (or 48") and 0.5 units wide (or 3"). A P6-80S beam will be 8 units minus one thickness long (or 47¼") and 0.5 units wide (or 3").

In a further related embodiment, by iterating the coefficients i and j in equations 1 and 2 and maintaining the plate identification code described above, the following table A of individual plates and beams can be:

TABLE A

| | | LENGTH [units] | | | | | | | |
|---|---|---|---|---|---|---|---|---|---|
| | | 1 | | 2 | | 4 | | 8 | |
| P6 | | | S | | S | | S | | S |
| WIDTH [units] | 0.5 | 10 | 10S | 20 | 20S | 40 | 40S | 80 | 80S |
| | 1 | 11 | 11S | 21 | 21S | 41 | 41S | 81 | 81S |
| | 2 | 12 | 12S | 22 | 22S | 42 | 42S | 82 | 82S |
| | 4 | 14 | 14S | 24 | 24S | 44 | 44S | 84 | 84S |

The number of rows and columns in this table has been limited for practical purposes (or the plates may become too large to be handled and stored/transported easily). However, based on the actual plate design that will be described further, regular plates that have transposed numbers of length and width units are actually identical. Based on this observation the above table A can be simplified to Table B, as shown below:

TABLE B

| | | LENGTH [units] | | | | | | | |
|---|---|---|---|---|---|---|---|---|---|
| | | 1 | | 2 | | 4 | | 8 | |
| P6 | | | S | | S | | S | | S |
| WIDTH [units] | 0.5 | 10 | 10S | 20 | 20S | 40 | 40S | 80 | 80S |
| | 1 | 11 | 11S | 21 | 21S | 41 | 41S | 81 | 81S |
| | 2 | | 12S | 22 | 22S | 42 | 42S | 82 | 82S |
| | 4 | | 14S | | 24S | 44 | 44S | 84 | 84S |

As it will become apparent further below, the P6-14S plate may have very limited use (due the difficulty of accessing a deep, narrow space). Therefore, eliminating this plate from Table B will lead to Table C:

TABLE C

| | | LENGTH [units] | | | | | | | |
|---|---|---|---|---|---|---|---|---|---|
| | | 1 | | 2 | | 4 | | 8 | |
| P6 | | | S | | S | | S | | S |
| WIDTH [units] | 0.5 | 10 | 10S | 20S | 20S | 40 | 40S | 80 | 80S |
| | 1 | 11 | 11S | 21 | 21S | 41 | 41S | 81 | 81S |
| | 2 | | 12S | 22 | 22S | 42 | 42S | 82 | 82S |
| | 4 | | | | 24S | 44 | 44S | 84 | 84S |

Figure 4A:
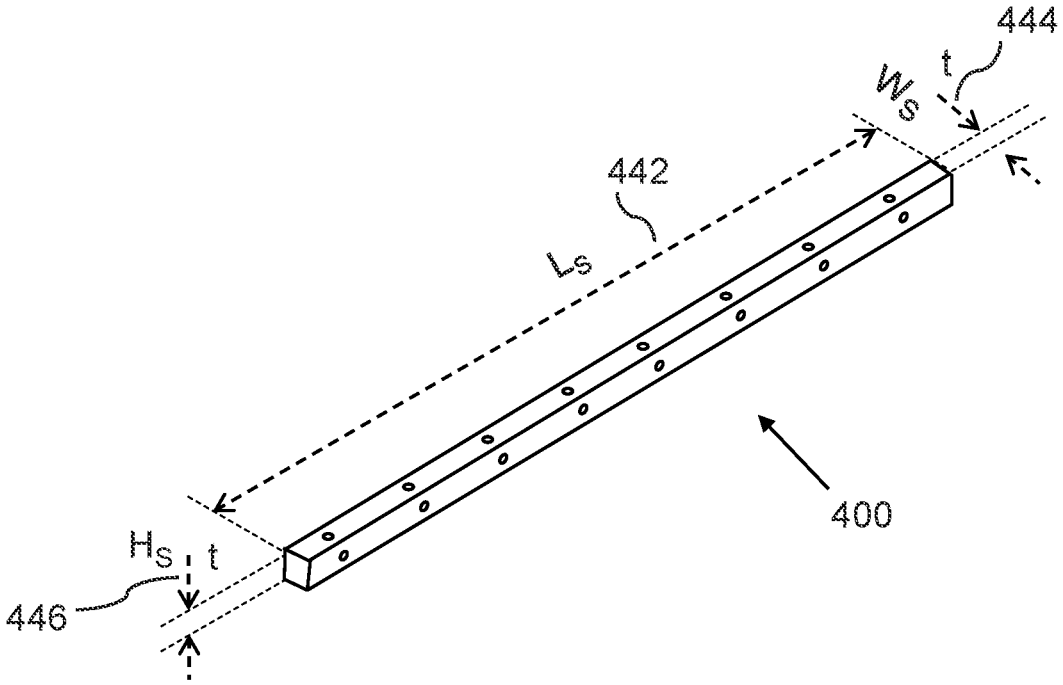
FIG. 4A is a top rear perspective view of a stick of a modular building system, according to an embodiment of the invention.
Figure 4B:
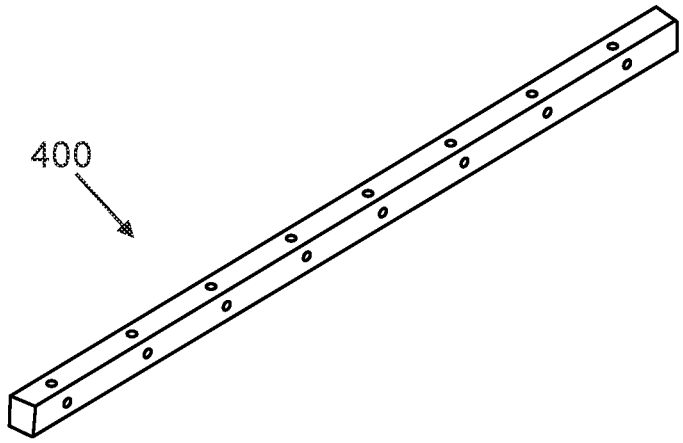
FIG. 4B is a top front perspective view of a stick of a modular building system, according to an embodiment of the invention.

In yet another related embodiment, as shown in FIGS. 4A and 4B, a STICK 400 can be configured as an elongated square linear shape with a square cross-section of thickness "t" 444, 446. The stick length 442 (also denoted by $L_S$) of a stick can be based on the formula $$a)\ \text{stick length 442(also denoted by } L_S)=2^i*U; \qquad \text{(Equation 6)}$$

wherein i. i=0, 1, 2, 3, . . . .

Similarly, a stick 400 can have an alphanumeric code derived by concatenating the letter "T", the thickness number, the "dash" character and the number of units in its length. For example, a T6-4 stick will be of a ¾" thick square section and 4 units long (or 24").

In a yet further related embodiment, by iterating the coefficient i in equation 6 and maintaining the identification code described above, the following Table D can be constructed for sticks (thickness is omitted):

TABLE D

| | LENGTH [units] | | | |
|---|---|---|---|---|
| T6 | 1 | 2 | 4 | 8 |

In Table D, the number of columns has been limited to 4 based on the same considerations as for plates and beams (and to match the available lengths of the latter).

Thus, in a related embodiment, a BUILDING SET based on the ¾" (6) thickness number can include a total of 32 different plates, beams and sticks, which can include:

a) Regular Plates (9 pieces in total), which can include: P6-11, P6-21, P6-22, P6-41, P6-42, P6-44, P6-81, P6-82, P6-84;

b) Short Plates (11 pieces in total), which can include: P6-11S, P6-12S, P6-21S, P6-22S, P6-24S, P6-41S, P6-42S, P6-44S, P6-81S, P6-82S, P6-84S;

c) Regular Beams (4 pieces in total), which can include: P6-10, P6-20, P6-40; P6-80;

d) Short Beams (4 pieces in total), which can include: P6-10S, P6-20S, P6-40S, P6-80S; and e) Sticks (4 pieces in total), which can include: T6-1, T6-2, T6-4, T6-8.

The above components can be assembled together to create 3-dimensional structures of variable complexity, as further described in the following, wherein the actual construction and assembly of the components is disclosed. For particular applications, not all the above components may be necessary. A building set can therefore comprise a reduced number of standard components, depending on need.

Figure 5A:
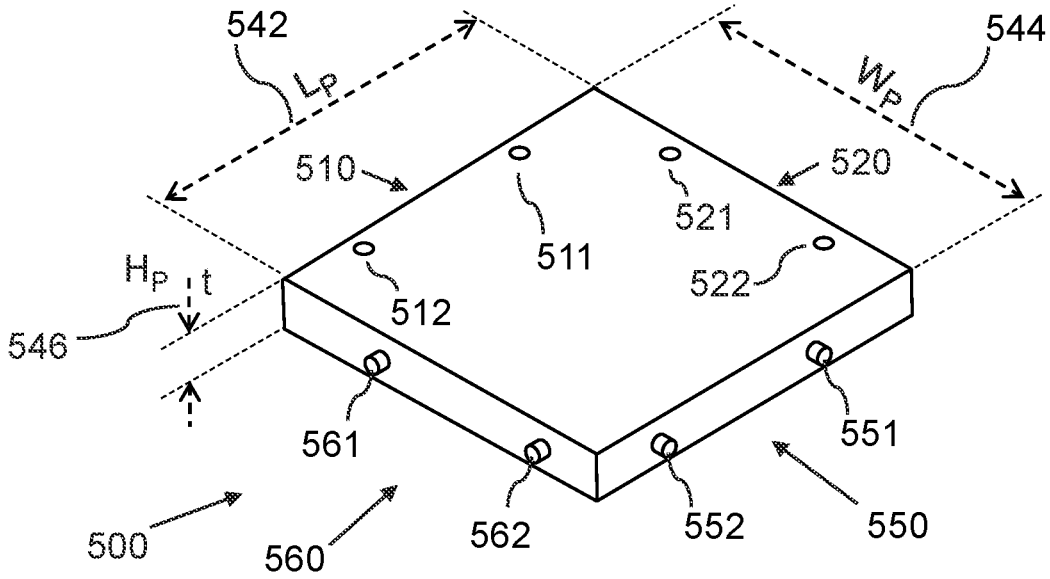
FIG. 5A is a top rear perspective view of a P6-11 smallest size regular plate of a modular building system, according to an embodiment of the invention.
Figure 5B:
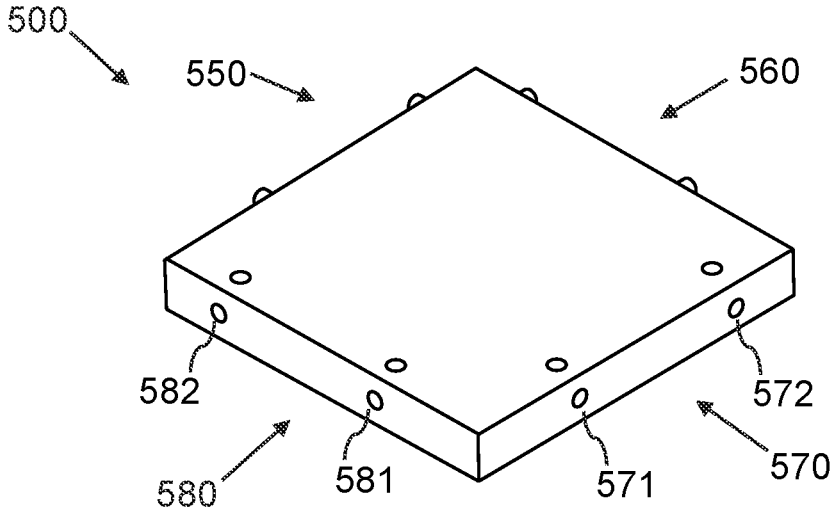
FIG. 5B is a top front perspective view of a P6-11 smallest size regular plate of a modular building system, according to an embodiment of the invention.

In a related embodiment, as shown in FIGS. 5A and 5B, the smallest size plate 500, a P6-11 plate 500, can include the following properties:

a) On the upper surface and in proximity of 2 adjacent edges, there are 2 sets of thru-holes 510, 520 (i.e., penetrating holes 510, 520, which penetrate through from an upper surface of the P6-11 plate 500 to a lower surface of the P6-11 plate 500), including:

i. through horizontal hole set 510 (aka TH hole set 510), which includes: a first through horizontal hole 511 and a second through horizontal hole 512, which are positioned along a horizontal edge of the P6-11 plate 500 (TH hole set); and ii. through vertical hole set 520 (aka TV hole set 520), which includes: a first through vertical hole 521 and a second through vertical hole 522, which are positioned along a vertical edge of the P6-11 plate 500;

b) Two sets 550, 560 of pins 551, 552, 561, 562 positioned on 2 adjacent front side surfaces. As before, we will identify one set as a pins-horizontal set (PH) and the other as a pins-vertical (PV); and c) Two sets 570, 580, of blind holes 571, 572, 581, 582 (BH and BV). The blind holes 571, 572, 581, 582 are located at the same points along the edges as the thru-holes and intersect the thru-holes, but do not extend beyond the surface of the thru-holes;

wherein we note that front versus rear, and vertical versus horizontal are arbitrary relative designations with reference to the drawings (due to rotational symmetries there is no fixed/absolute front/rear or vertical/horizontal orientations).

Figure 5C:
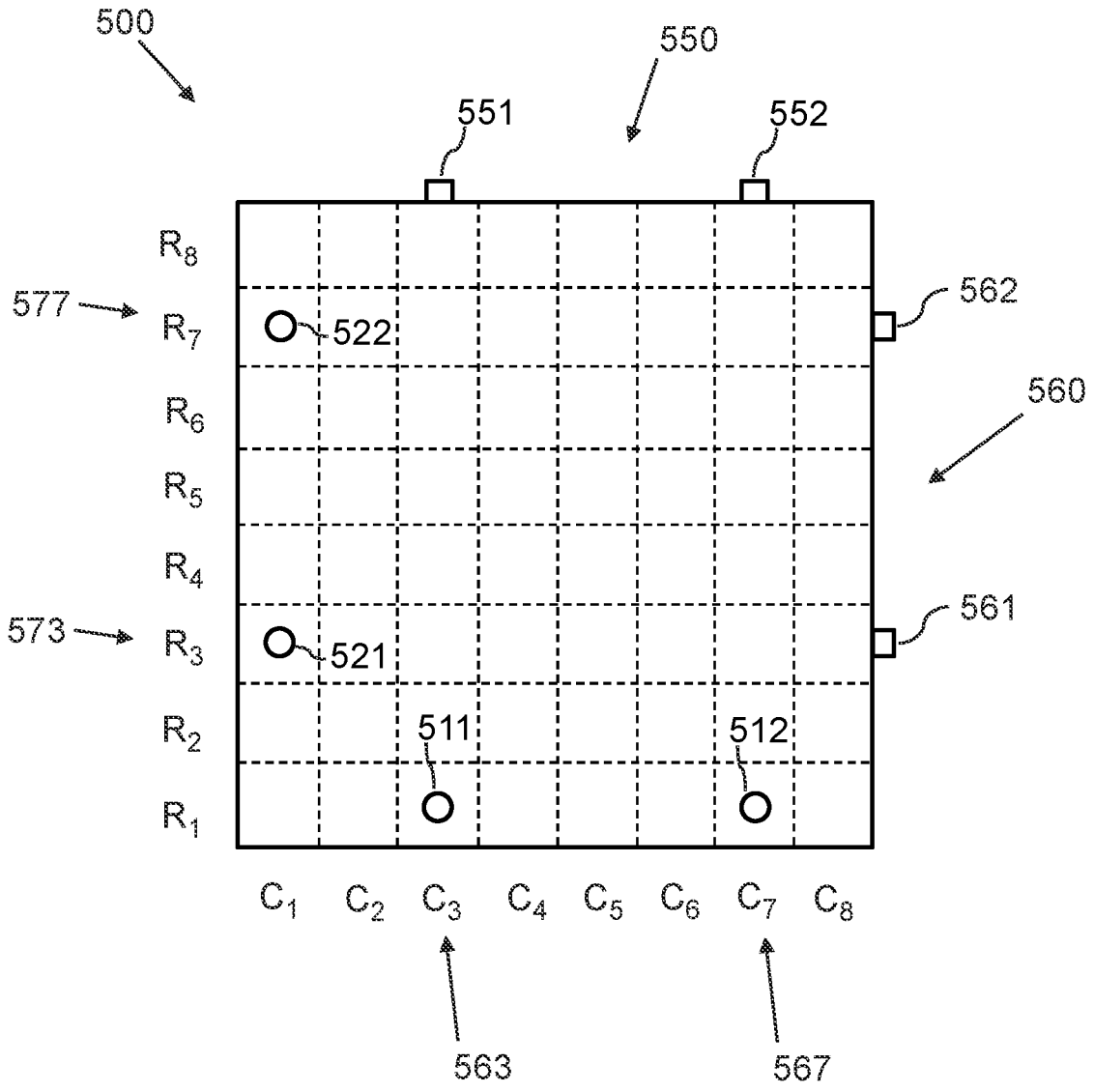
FIG. 5C is a top plan view of a P6-11 smallest size regular plate of a modular building system, according to an embodiment of the invention.

In a further related embodiment, as shown in FIG. 5C, if a square grid with a spacing equal to t, the thickness 546 (as shown in FIG. 5A) of the plate, is placed on top of the plate, the locations of all holes and pins become apparent. The horizontal holes and pins are placed in the third and seventh columns 563, 567 (denoted $C_3$ and $C_7$) numbered from left to right) of the grid, while the vertical holes and pins are placed in the third and seventh rows 573, 577 (denoted $R_3$ and $R_7$; with rows numbered from bottom to top).

As an alternate description, the holes and pins are offset in relation to center lines of the plate. Any pair of holes or pins (TH, TV, PH, PV, BH or BV) can be placed symmetrically relative to either a horizontal or vertical line that is offset by ½ a thickness from the horizontal or vertical centerline of the plate, respectively.

In an alternative embodiment, instead of 2 holes or pins on each side/edge, there could be only 1 hole or pin located in column 5 or row 5, respectively. This would lower the total number of holes and pins in half.

Figure 7:
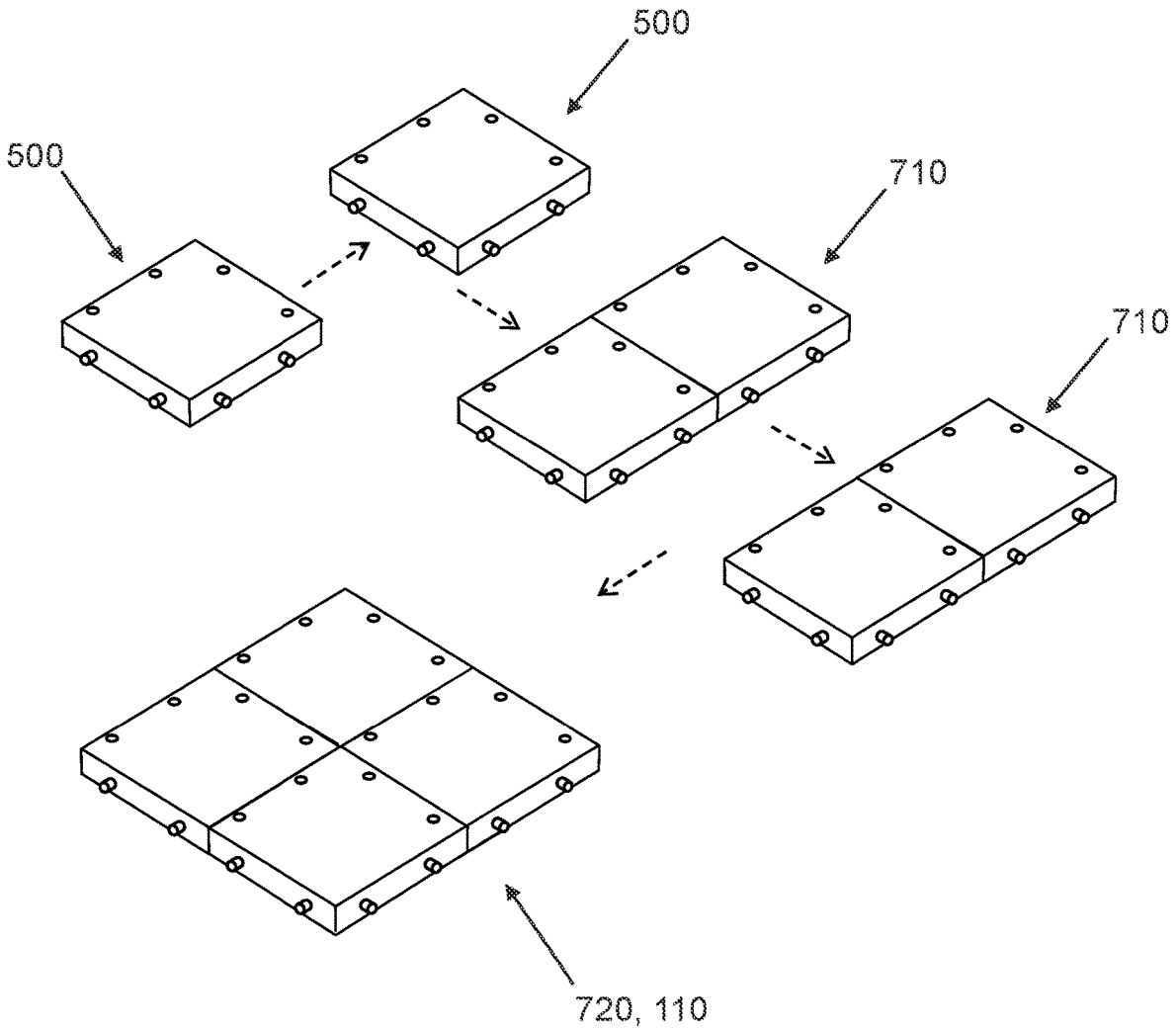
FIG. 7 is a rear perspective view of an assembly sequences of plates of a modular building system, according to an embodiment of the invention.

In various related embodiments, we will now describe some multiple-unit regular plates, including:

a) A next size plate 710, as shown in FIG. 7, is encoded P6-21. That means the plate is 2 units long and 1 unit wide as implied by its designation;

i. a P6-21 plate 710 is formed by placing two P6-11 plates 500 adjacent to each other.

b) The P6-22 plate 110, 720, as shown in FIGS. 6A-6E and 7, is 2 units long and 2 units wide;

i. The P6-22 plate 720, 110 is double the size of P6-21 and 4 times the size of P6-11. It has a set of (TH2) thru-holes placed along a horizontal line approximately in the middle of the plate and a set of (TV2) holes placed along a vertical line approximately in the middle of the plate;

ii. a P6-22 plate 720, 110 is formed by joining two P6-21 plates together or joining four P6-11 plates, as shown in FIGS. 6A-6E and 7.

Figure 6A:
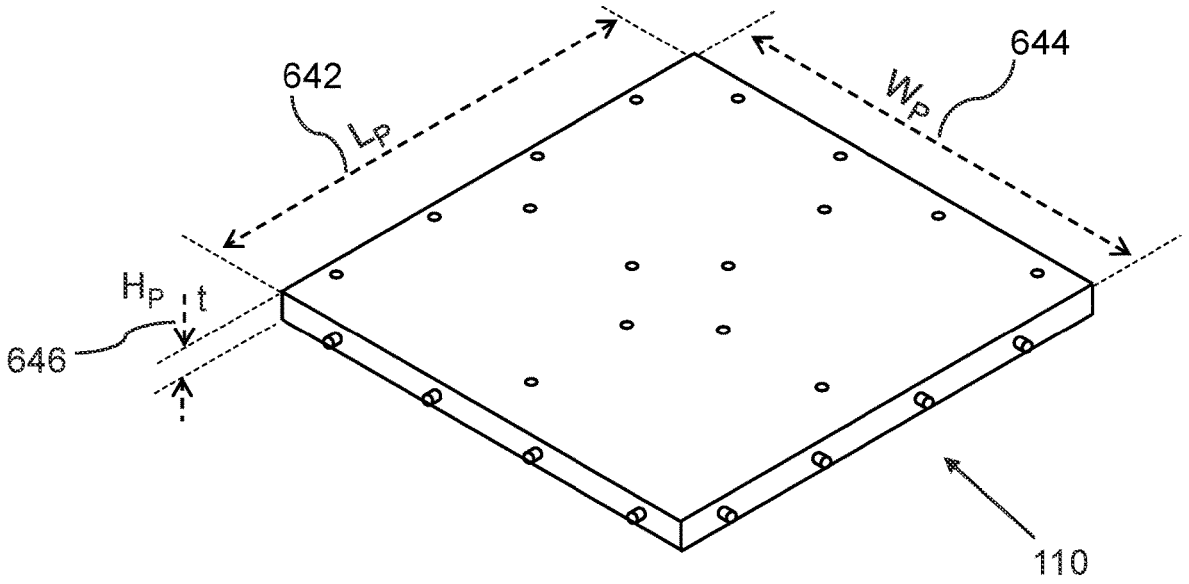
FIG. 6A is a top rear perspective view of a P6-22 regular plate of a modular building system, according to an embodiment of the invention.
Figure 6B:
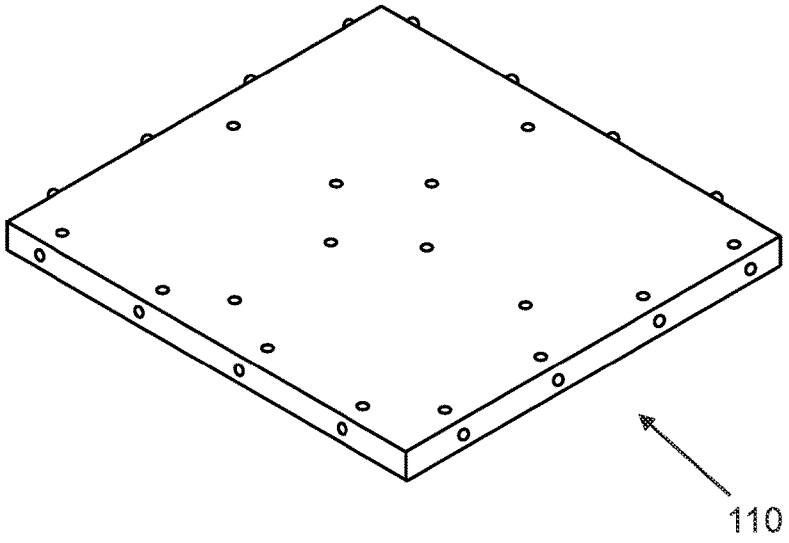
FIG. 6B is a top front perspective view of a P6-22 regular plate of a modular building system, according to an embodiment of the invention.
Figure 6C:
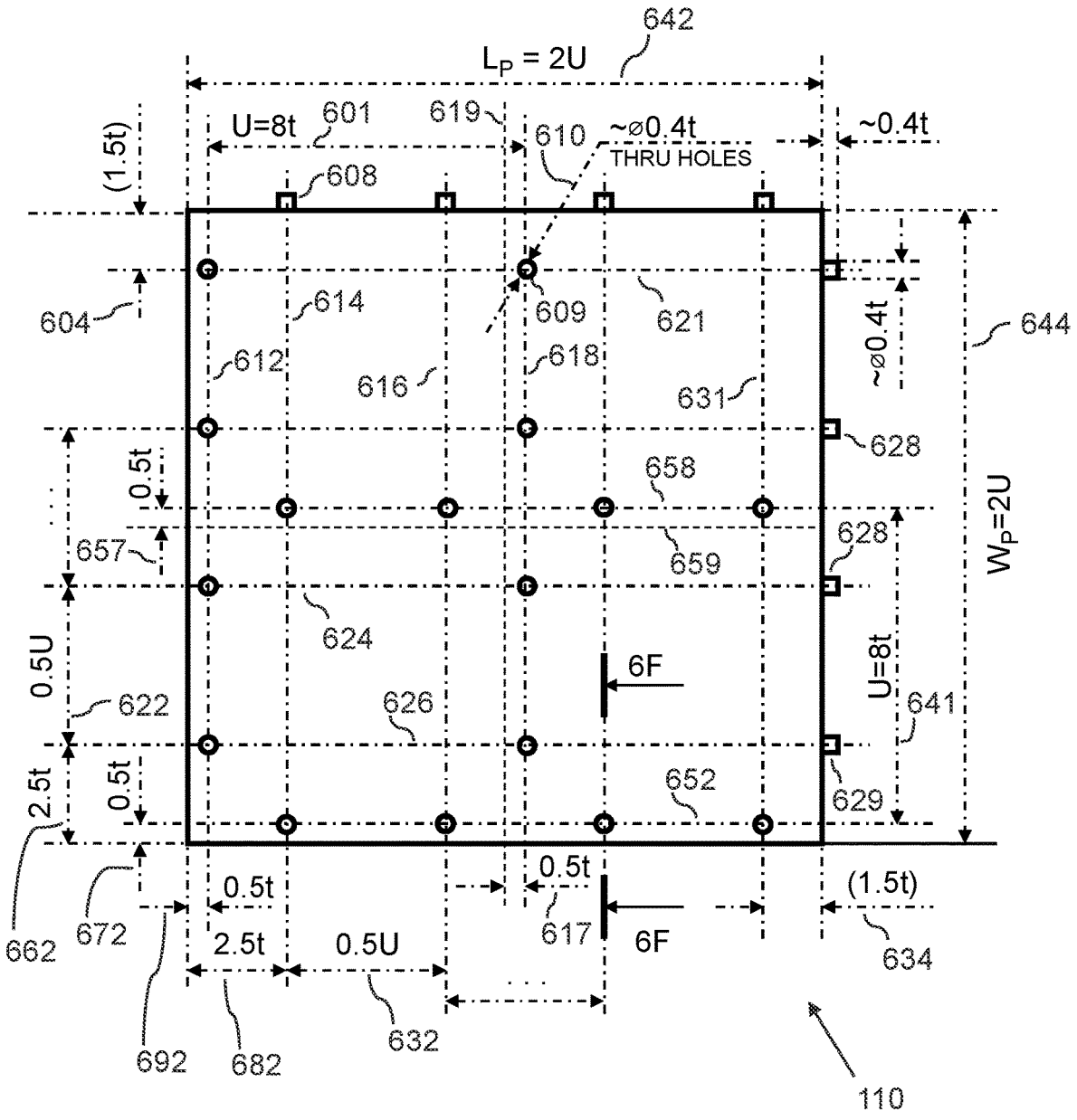
FIG. 6C is a top plan view of a P6-22 regular plate of a modular building system, according to an embodiment of the invention.
Figure 6D:
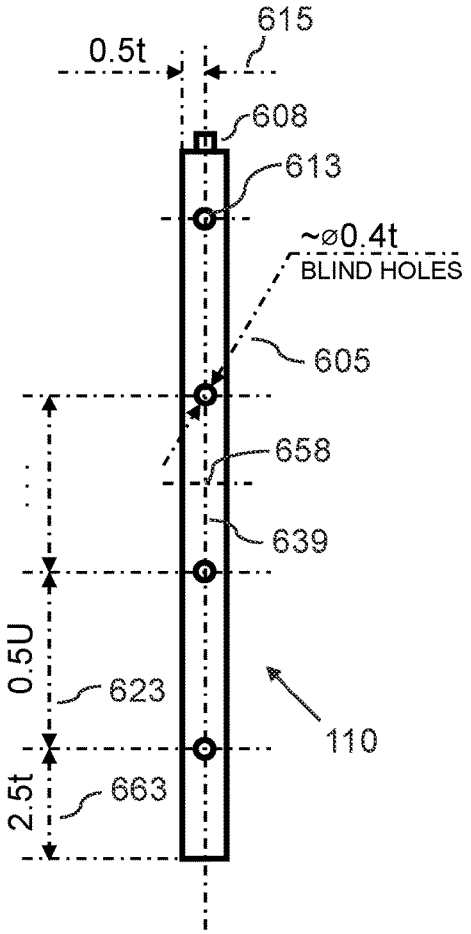
FIG. 6D is a left side view of a P6-22 regular plate of a modular building system, according to an embodiment of the invention.
Figure 6F:
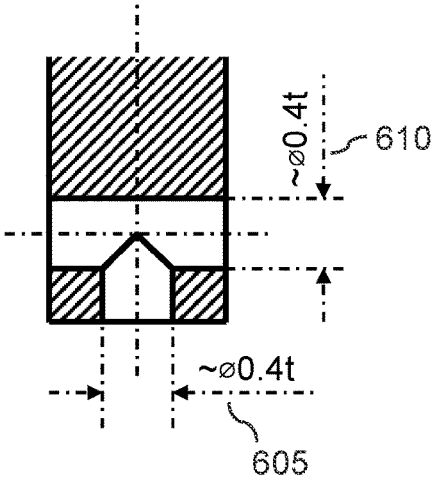
FIG. 6F is a sectional view of a P6-22 regular plate of a modular building system, taken along section line 6F-6F of FIG. 6C, according to an embodiment of the invention.
Figure 6E:
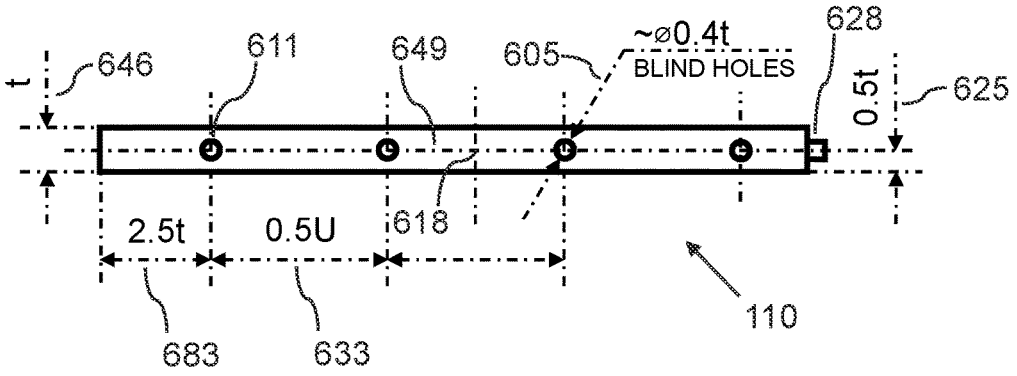
FIG. 6E is a front side view of a P6-22 regular plate of a modular building system, according to an embodiment of the invention.

In further related embodiment, as shown in FIGS. 6C (and 6D-6F), the P6-22 regular plate 110, 720 can be proportionally configured with:

a) a plate length 642 (also denoted by $L_P$)=2 U;

b) a plate width 644 (also denoted by $W_P$)=2 U;

c) a plate thickness 646 (also denoted by $H_P$)=t;

d) a right column inner distance 601 of 8t, from a lateral center thru-hole column line 618 to a left outermost thru-hole column line 612;

e) a front row inner distance 641 of 8t, from a longitudinal center thru-hole row line 658 to a front outermost thru-hole row line 652;

f) a rear outer distance 604 of 1.5t, from a longitudinal rearmost thru-hole row line 621 to a rear top edge of the regular plate 600, 720;

g) a right outer distance 634 of 1.5t, from a longitudinal leftmost thru-hole column line 631 to a right top edge of the regular plate 600, 720;

h) a diameter 610 of thru-holes 609 of about 0.4t;

i) a diameter 605 of front and left blind holes 611, 613 of about 0.4t;

j) a length of protruding connectors/pins 628 of about 0.4t;

k) a diameter of protruding connectors/pins 628 of about 0.4t;

l) a lateral row/pin/blind hole distance 622, 623 of 0.5 U between consecutive longitudinal thru-hole row lines 624, 626 that are aligned with corresponding right side protruding connectors/pins 628;

m) a left side vertical displacement 615 of laterally aligned rear side protruding connectors/pins 608 and left blind holes 613, which are aligned along a lateral left centerline 639;

n) a front side vertical displacement 625 of longitudinally aligned right side protruding connectors/pins 628 and front blind holes 611, which are longitudinally aligned along a longitudinal front centerline 649;

o) a longitudinal row/pin/blind hole distance 632, 633 of 0.5 U between consecutive lateral thru-hole column lines 614, 616 that are aligned with corresponding rear side protruding connectors/pins 608;

p) a next front row/pin/blind hole distance 662, 663 of 2.5t, from a front longitudinal thru-hole row line 626 that is aligned with a front right pin 629 to a front top edge of the regular plate 600, 720;

q) a next right column distance 682, 683 of 2.5t, from a right lateral thru-hole column line 614 that is aligned with a rear leftmost pin 608 to a left top edge of the regular plate 600, 720;

r) a front row outer distance 672 of 0.5t, from a front outermost thru-hole row line 652 to a front top edge of the regular plate 600, 720; and s) a left column outer distance 692 of 0.5t, from a left outermost thru-hole column line 612 to a left top edge of the regular plate 600, 720.

Figure 8A:
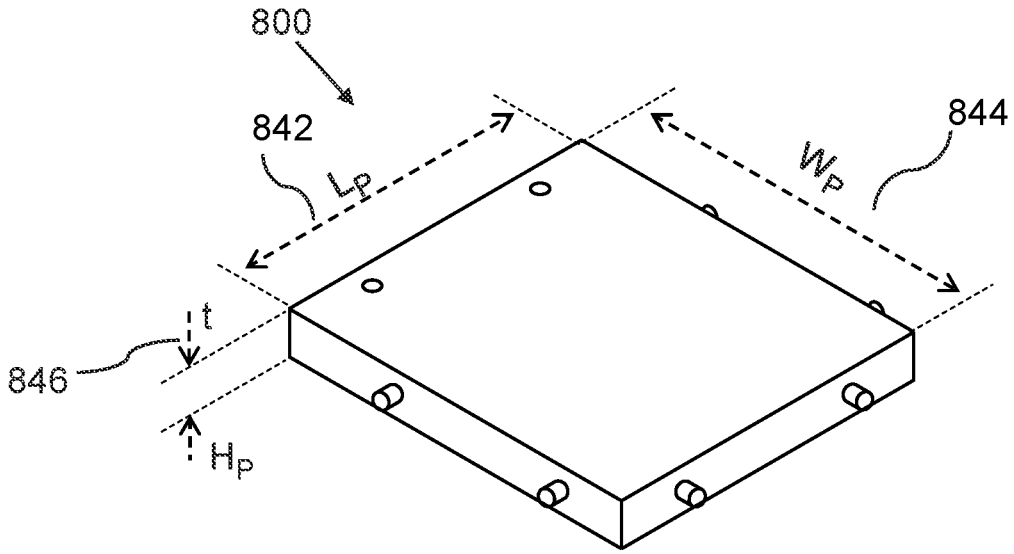
FIG. 8A is a top rear perspective view of a P6-11S smallest size short plate of a modular building system, according to an embodiment of the invention.
Figure 8B:
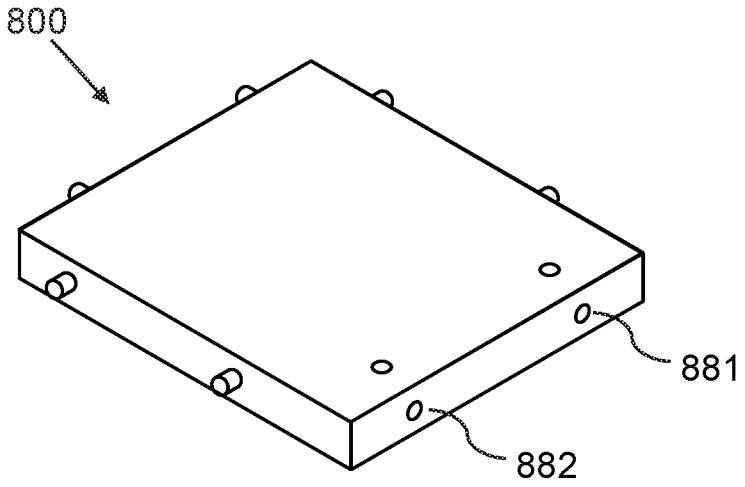
FIG. 8B is a top front perspective view of a P6-11S smallest size short plate of a modular building system, according to an embodiment of the invention.
Figure 8C:
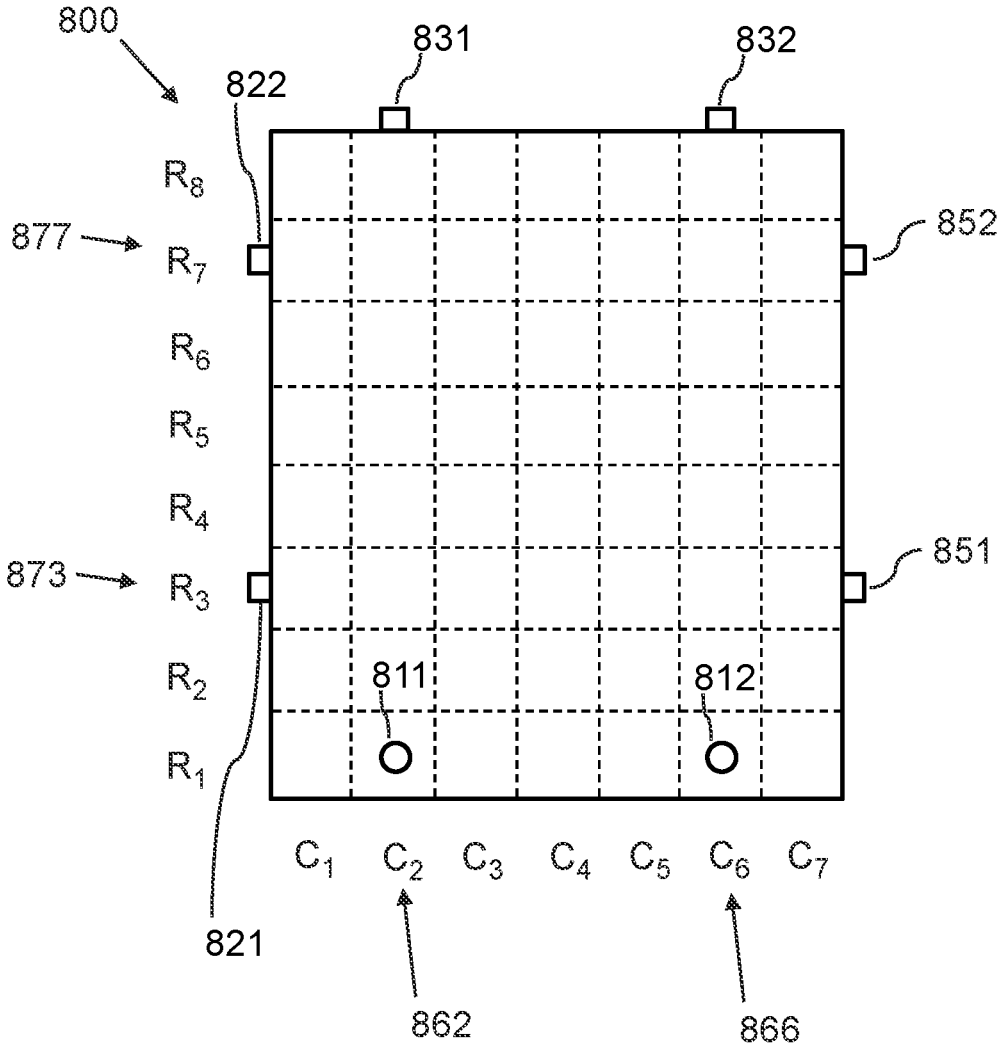
FIG. 8C is a top plan view of a P6-11S smallest size short plate of a modular building system, according to an embodiment of the invention.

In various related embodiments, short plates can include:

a) A smallest size short plate 800, the P6-11S plate 800, as shown in FIGS. 8A, 8B, and 8C, wherein:

i. A short plate is a modified version of a regular plate. A vertical strip of a width equal to the material thickness has been removed from the left side of the plate. The vertical thru-holes and blind holes (TV and BV) on that side have been removed. Instead, a new set of vertical pins (PV2) is applied to the left side;

ii. If a square grid with a spacing equal to the thickness of the plate is placed on top of the short plate, the locations of all holes and pins become apparent. The horizontal holes and pins are placed in columns no. 2 and 6 862, 866 (denoted $C_2$ and $C_6$; with columns numbered from left to right) of the grid, while the vertical holes and pins are placed in rows no. 3 and 7 873, 877 (denoted $R_3$ and $R_7$; with rows numbered from bottom to top), as shown in FIG. 8C;

iii. In an alternative embodiment, similar to a regular plate, instead of 2 holes or pins on each side/edge, there could be only 1 hole or pin located in column 4 or row 5, respectively. This would lower the total number of holes and pins in half;

iv. Note the offset location of the vertical holes and pins in regard to the horizontal center line of the plate. Any pair of vertical pins (PV, PV2) is placed symmetrically relative to a horizontal line that is offset by ½ a thickness from the horizontal centerline of the plate; and v. In contrast, any pair of horizontal holes or pins (TH, PH, BH) is placed symmetrically relative to the vertical centerline of the plate.

We will now describe some multiple-unit short plates:

b) The next size plate is the P6-21S plate (with thru-holes on the long edge), wherein:

i. That means the plate is 2 units long minus one thickness and 1 unit wide as implied by its designation;

ii. This plate is somewhat larger than 2 times the size of the P6-11S plate. It has similar features with the latter, but in addition it has a set of thru-holes (TV2) oriented along a vertical line approximately in the middle of the plate; and iii. It is readily apparent that a P6-21S plate is actually formed by placing a P6-11S plate 800 and a P6-11 plate 500 adjacent to each other (the P6-11S plate 800 to the left and the P6-11 plate 500 to the right);

c) A plate of similar size but different is P6-12S (with thru-holes on the short edge), wherein:

i. The P6-12S plate is 1 unit long minus one thickness and 2 unit wide as implied by its designation;

ii. The difference is that the thru-holes TH are placed on the short edge of the plate instead of the long one. Also, it has a set of thru-holes (TH2) placed along a horizontal line approximately in the middle of the plate;

iii. It cannot be mistaken for or miss-assembled in place of a P6-21S plate due to the different placement of holes and pins and having slightly different overall dimensions;

iv. a P6-12S plate can be formed by placing two P6-11S 800 plates on top of each other, adjacent to each other; and d) The P6-22S plate 900, as shown in FIGS. 9A-9E, is 2 units long minus one thickness and 2 units wide as implied by its designation.

i. The P6-22S plate 900 is double the size of the P6-21S plate. It has a set of (TH2) thru-holes placed along a horizontal line approximately in the middle of the plate and a set of (TV2) thru-holes placed along a vertical line approximately in the middle of the plate; and ii. It is easy to see that a P6-22S short plate 900 can be formed by placing a P6-12S plate and a P6-21 plate adjacent to each other (P6-12S to the left, P6-21 to the right). Also, a P6-22S plate can be formed by placing two P6-21S plates on top of each other.

Figure 9A:
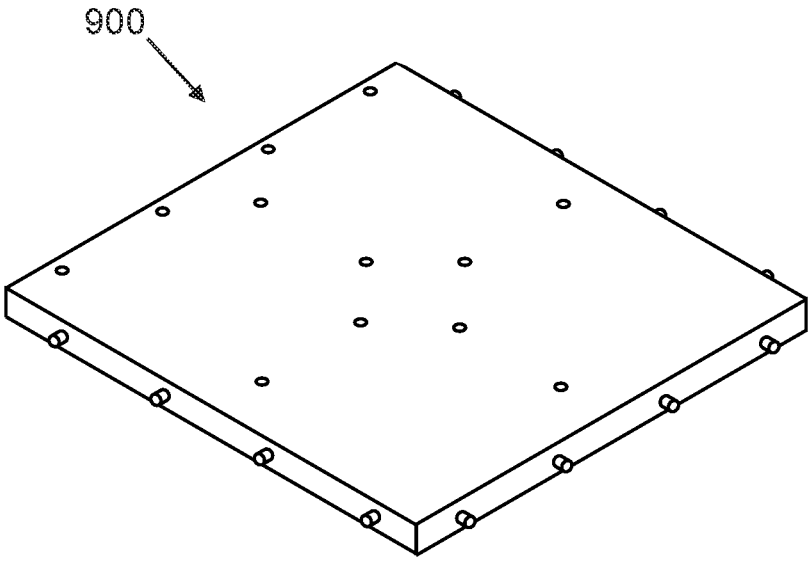
FIG. 9A is a top rear perspective view of a P6-22S short plate of a modular building system, according to an embodiment of the invention.
Figure 9B:
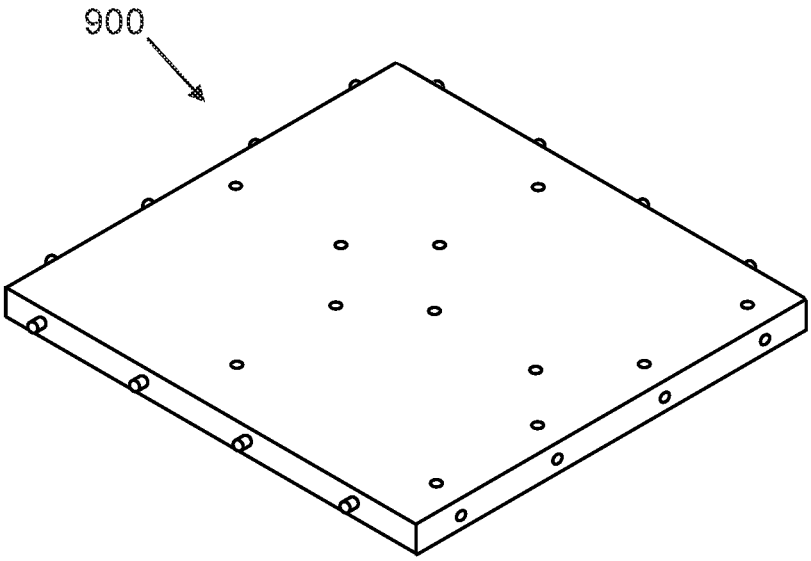
FIG. 9B is a top front perspective view of a P6-22S short plate of a modular building system, according to an embodiment of the invention.
Figure 9C:
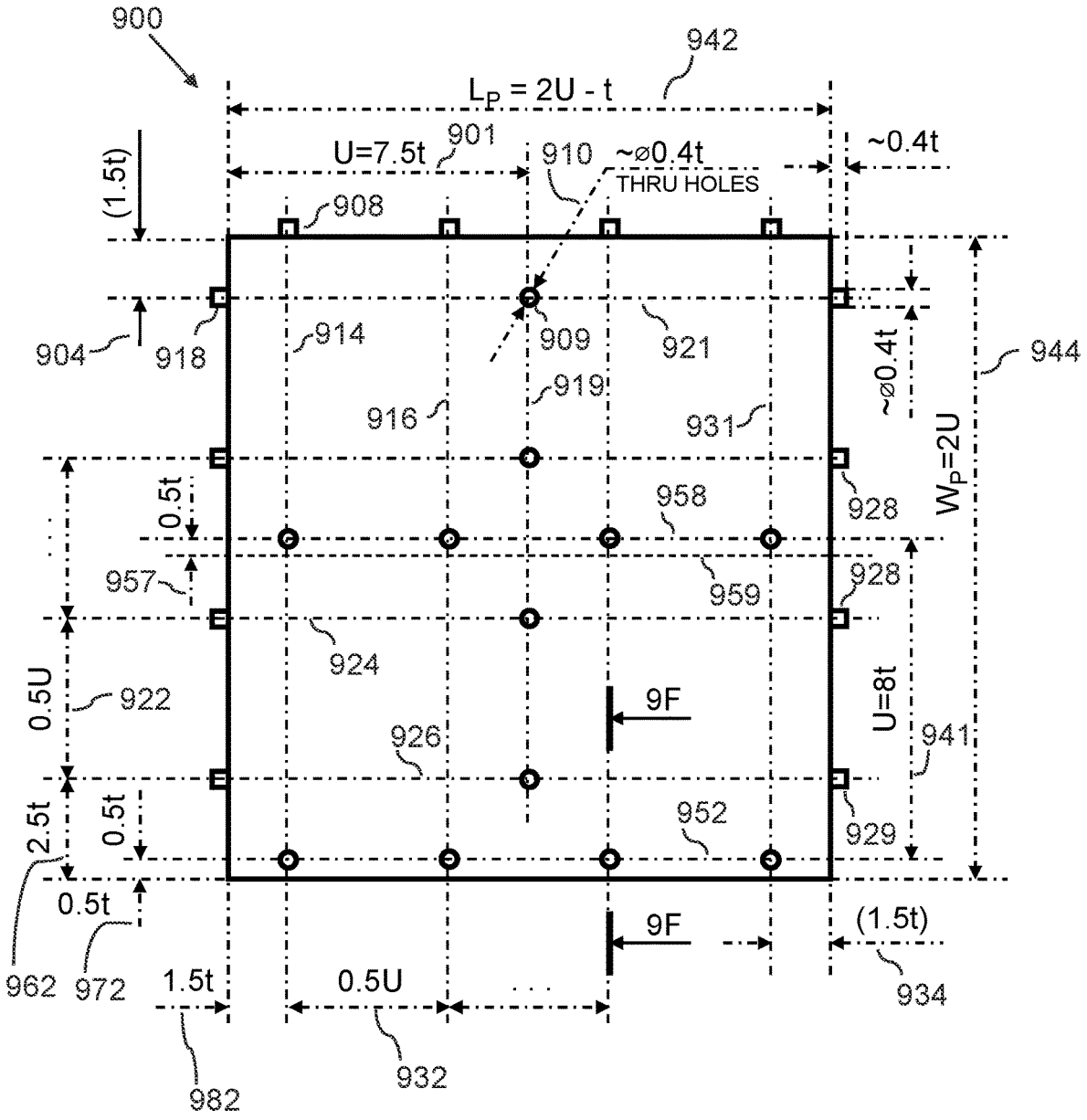
FIG. 9C is a top plan view of a P6-22S short plate of a modular building system, according to an embodiment of the invention.
Figure 9D:
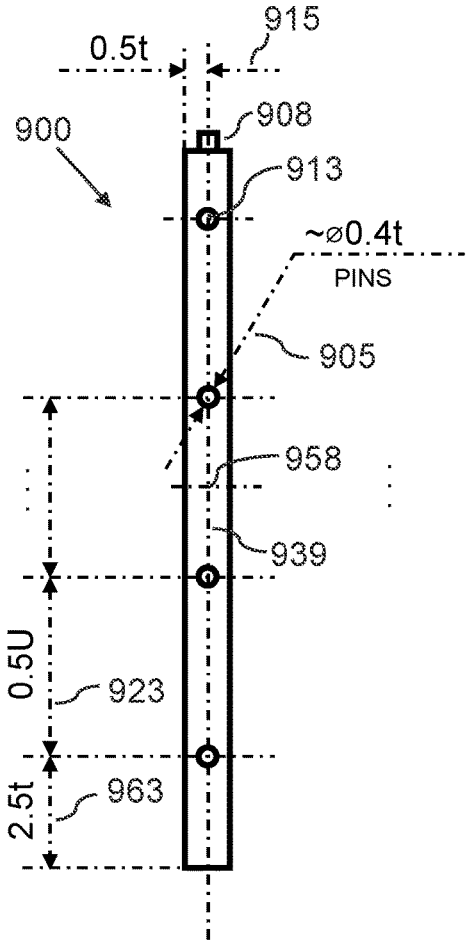
FIG. 9D is a left side view of a P6-22S short plate of a modular building system, according to an embodiment of the invention.
Figure 9F:
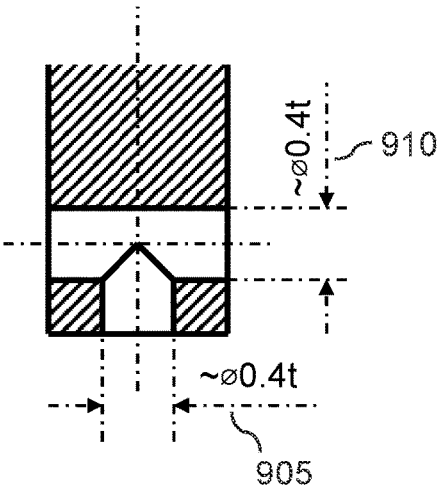
FIG. 9F is a sectional view of a P6-22S short plate of a modular building system, taken along section line 9F-9F of FIG. 9C, according to an embodiment of the invention.
Figure 9E:
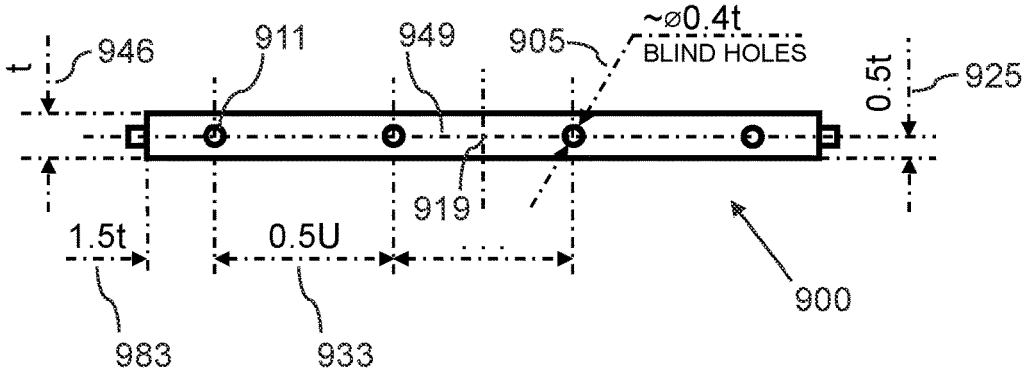
FIG. 9E is a front side view of P6-22S short plate of a modular building system, according to an embodiment of the invention.

In a further related embodiment, as shown in FIGS. 9C (and 9D-9F), the P6-22S short plate 900 can be proportionally configured such that:

a) a plate length 942 (also denoted by $L_P$)=2 U−t;

b) a plate width 944 (also denoted by $W_P$)=2 U;

c) a plate thickness 946 (also denoted by $H_P$)=t;

d) a right column inner distance 901 of 8t, from a lateral center thru-hole column line 919 to a left top edge of the P6-22S short plate 900;

e) a front row inner distance 941 of 8t, from a longitudinal center thru-hole row line 958 to a front outermost thru-hole row line 952;

f) a rear outer distance 904 of 1.5t, from a longitudinal rearmost thru-hole row line 921 to a rear top edge of the P6-22S short plate 900;

g) a right outer distance 934 of 1.5t, from a longitudinal leftmost thru-hole column line 931 to a right top edge of the P6-22S short plate 900;

h) a diameter 910 of thru-holes 909 of about 0.4t;

i) a diameter 905 of front and left blind holes 911, 913 of about 0.4t;

j) a length of protruding connectors/pins 928 of about 0.4t;

k) a diameter of protruding connectors/pins 928 of about 0.4t;

l) a lateral row/pin/blind hole distance 922, 923 of 0.5 U between consecutive longitudinal thru-hole row lines 924, 926 that are aligned with corresponding right side protruding connectors/pins 928;

m) a left side vertical displacement 915 of laterally aligned rear side protruding connectors/pins 908 and left blind holes 913, which are aligned along a lateral left centerline 939;

n) a front side vertical displacement 925 of longitudinally aligned right side protruding connectors/pins 928 and front blind holes 911, which are longitudinally aligned along a longitudinal front centerline 949;

o) a longitudinal row/pin/blind hole distance 932, 933 of 0.5 U between consecutive lateral thru-hole column lines 914, 916 that are aligned with corresponding rear side protruding connectors/pins 908;

p) a next front row distance 962, 963 of 2.5t, from a front longitudinal thru-hole row line 926 that is aligned with a front right pin 929 to a front top edge of the P6-22S short plate 900;

q) a next right column distance 982, 983 of 2.5t, from a right lateral thru-hole column line 914 that is aligned with a rear leftmost pin 908 to a left top edge of the P6-22S short plate 900; and r) a front row outer distance 972 of 0.5t, from a front outermost thru-hole row line 952 to a front top edge of the P6-22S short plate 900.

Figure 10A:
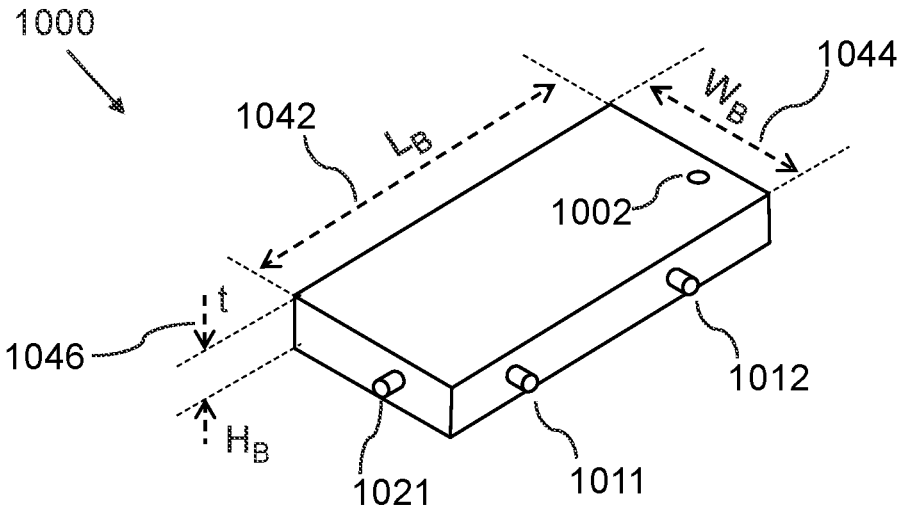
FIG. 10A is a top rear perspective view of a P6-10 smallest size regular beam of a modular building system, according to an embodiment of the invention.
Figure 10B:
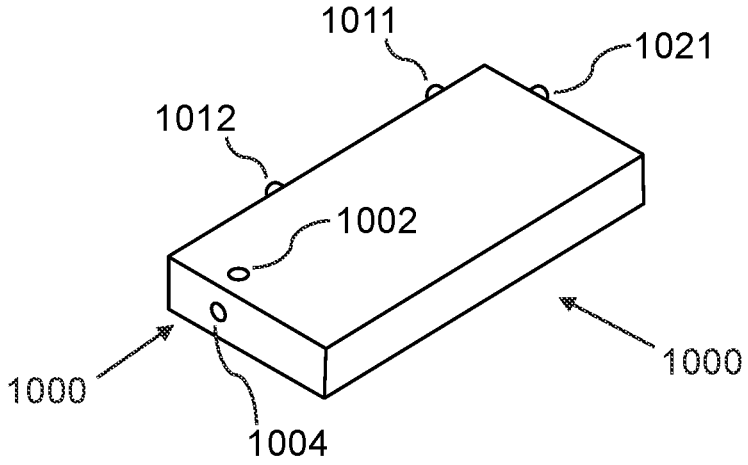
FIG. 10B is a top front perspective view of a P6-10 smallest size regular beam of a modular building system, according to an embodiment of the invention.

In other related embodiments, REGULAR BEAMS can include:

a) a smallest size regular beam P6-10 1000, as introduced above and shown in FIGS. 10A and 10B, wherein:

i. On the main surface and in proximity of the left edge there is a thru-hole 1002. We will identify this hole as thru-vertical (TV);

ii. On the left edge and aligned with the above thru-hole there is a blind hole 1004. We will identify this hole as blind-vertical (BV);

iii. On the side surfaces of the plate, there are 2 sets of pins 1011, 1012, 1021 on 2 adjacent surfaces. As before, we will identify one set 1011, 1012 as pin-horizontal (PH) and the other (1 pin) 1021 as pin-vertical (PV); and iv. As opposed to a regular plate, there are no blind holes on the bottom side, nor thru-holes on the bottom edge; and b) As shown in FIGS. 11A-11F, the next size beam is the P6-20 beam 1100 (a multiple-unit/composite beam), which is 2 units long and 0.5 units wide, as implied by its coding designation, wherein:

i. the P6-20 regular beam 1100 is double the size of the P6-10 beam 1000. It has similar features with the latter, but in addition it has a thru-hole (TV2) approximately in the middle of the plate; and ii. It is readily apparent that a P6-20 beam 1100 is actually formed by placing two P6-10 beams 1000 adjacent to each other.

Figure 11A:
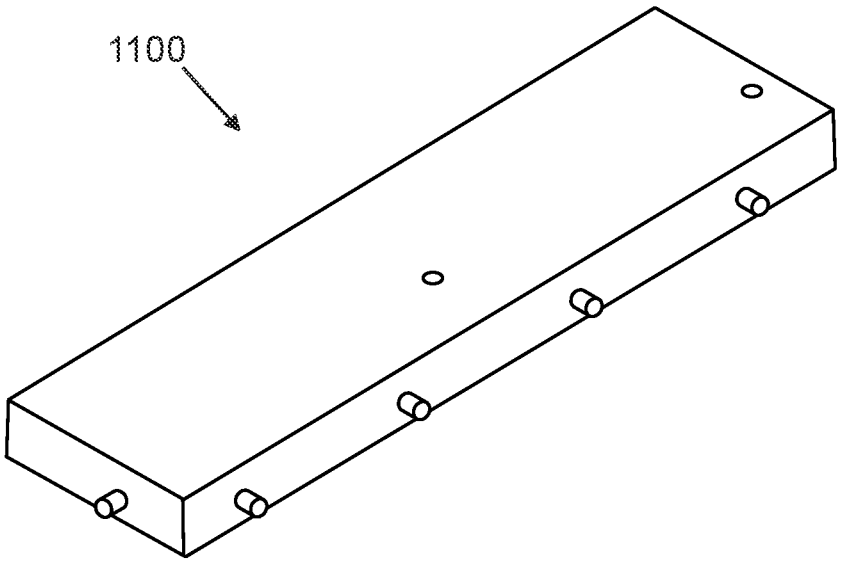
FIG. 11A is a top rear perspective view of a P6-20 regular beam of a modular building system, according to an embodiment of the invention.
Figure 11B:
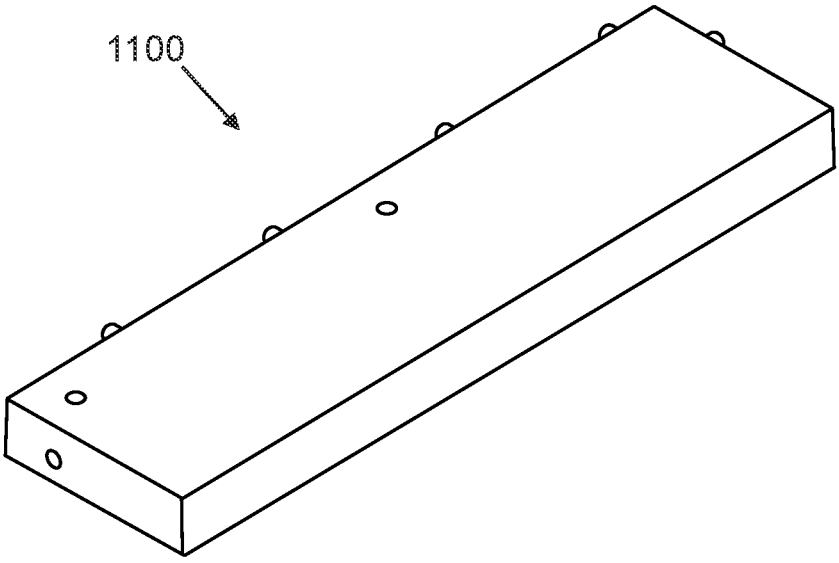
FIG. 11B is a top front perspective view of a P6-20 regular beam of a modular building system, according to an embodiment of the invention.
Figure 11C:
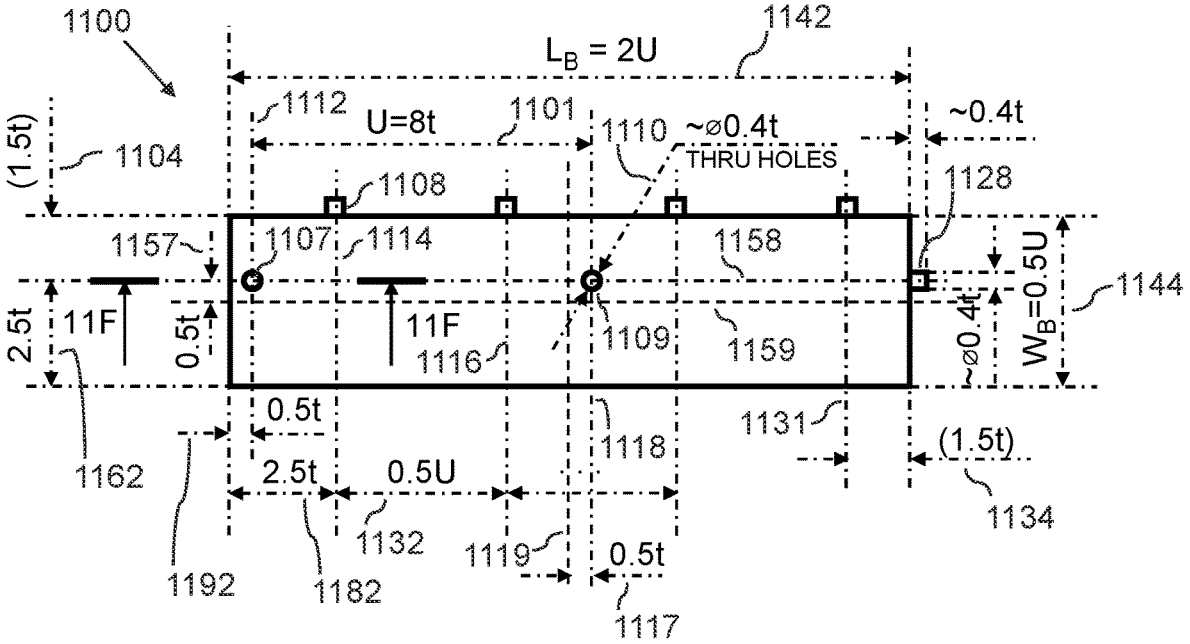
FIG. 11C is a top plan view of a P6-20 regular beam of a modular building system, according to an embodiment of the invention.
Figure 11D:
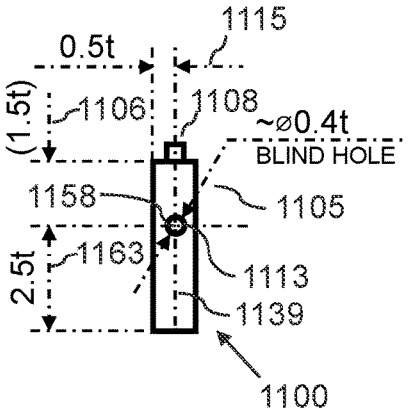
FIG. 11D is a left side view of a P6-20 regular beam of a modular building system, according to an embodiment of the invention.
Figure 11F:
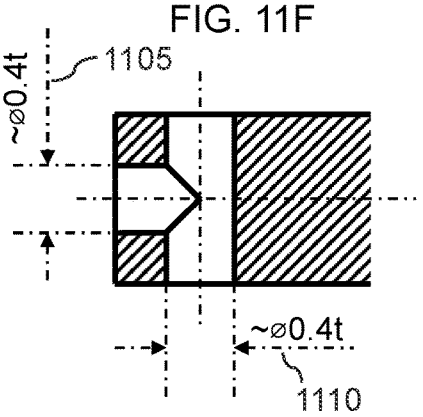
FIG. 11F is a sectional view of a P6-20 regular beam of a modular building system, taken along section line 11F-11F of FIG. 11C, according to an embodiment of the invention.
Figure 11E:
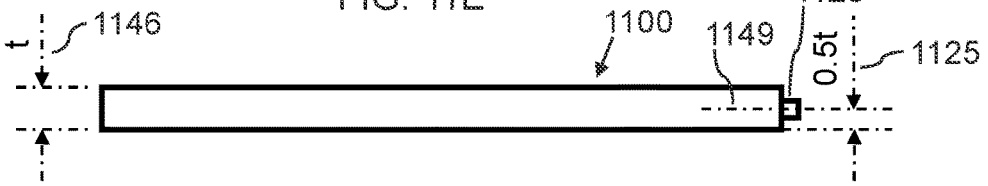
FIG. 11E is a front side view of P6-20 regular beam of a modular building system, according to an embodiment of the invention.

In a further related embodiment, as shown in FIGS. 11C (and 11D-11F), the P6-20 regular beam 1100 can be proportionally configured such that:

a) a plate length 1142 (also denoted by $L_B$)=2 U;

b) a plate width 1144 (also denoted by $W_B$)=0.5 U;

c) a plate thickness 1146 (also denoted by $H_P$)=t;

d) a right column inner distance 1101 of 8t, from a lateral center thru-hole column line 1118 to a left outermost thru-hole column line 1112;

e) a rear outer distance 1104, 1106 of 1.5t, from longitudinally aligned rear and left side blind holes/protruding connectors/pins 1113, 1128 that are aligned with a longitudinal rearmost thru-hole row line 1158 to a rear top edge of the P6-20 regular beam 1100;

f) a right outer distance 1134 of 1.5t, from a longitudinal leftmost rear connector column line 1131 to a right top edge of the P6-20 regular beam 1100;

g) a diameter 1110 of thru-holes 1109 of about 0.4t;

h) a diameter 1105 of left blind holes 1113 of about 0.4t;

i) a length of protruding connectors/pins 1128 of about 0.4t;

j) a diameter of protruding connectors/pins 1128 of about 0.4t;

k) a left side vertical displacement 1115 of laterally aligned rear side protruding connector/pin 1108 and left blind hole 1113, which are aligned along a lateral left centerline 1139;

l) a front side vertical displacement 1125 of longitudinally aligned right side protruding connector/pin 1128, which is longitudinally aligned along a longitudinal front centerline 1149;

m) a longitudinal row/pin/blind hole distance 1132 of 0.5 U between consecutive lateral rear connector column lines 1114, 1116 that are aligned with corresponding rear side protruding connectors/pins 1108;

n) a front row distance 1162, 1163 of 2.5t, from a front longitudinal thru-hole row line 1158 that is longitudinally aligned with a left blind hole 1113 and a right pin 1128 to a front top edge of the P6-20 regular beam 1100;

o) a next right column distance 1182 of 2.5t, from a right lateral thru-hole column line 1114 that is aligned with a rear leftmost pin 1108 to a left top edge of the P6-20 regular beam 1100; and p) a left column outer distance 1192 of 0.5t, from a left outermost thru-hole column line 1112 to a left top edge of the P6-20 regular beam 1100.

Figure 12A:
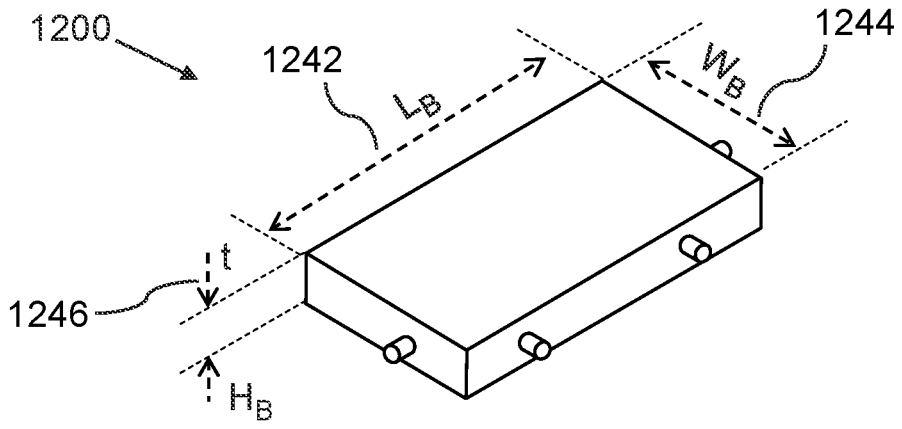
FIG. 12A is a top rear perspective view of a P6-10S short beam of a modular building system, according to an embodiment of the invention.
Figure 12B:
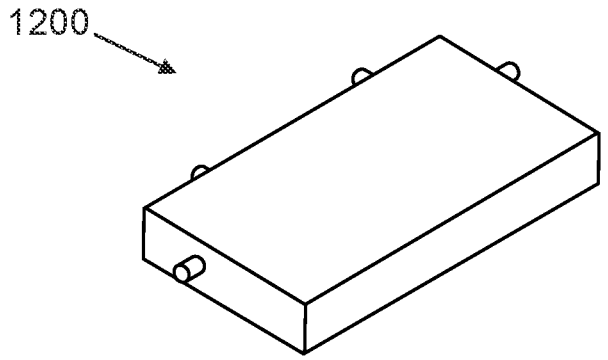
FIG. 12B is a top front perspective view of a P6-10S short beam of a modular building system, according to an embodiment of the invention.

In other related embodiments, SHORT BEAMS can include:

a) The smallest size short beam, P6-10S beam 1200, as shown in FIGS. 12A and 12B, wherein:

i. A short beam is a modified version of a beam plate. A vertical strip of a width equal to the material thickness has been removed from the left side of the beam. The vertical thru-hole and blind hole (TV and BV) on that side have been removed. Instead, a new pin (PV2) is applied to the left side; and b) The next size short beam is the P6-20S beam 1300, as shown in FIGS. 13A-13E, which is 2 units long minus one thickness and 0.5 units wide as implied by its designation, wherein:

i. This beam is somewhat larger than 2 times the size of the P6-10S beam. It has similar features with the latter, but in addition it has a hole (TV) approximately in the middle of the plate; and ii. It is readily apparent that a P6-20S beam is actually formed by placing a P6-10S and a P6-10 beam adjacent to each other.

Figure 13A:
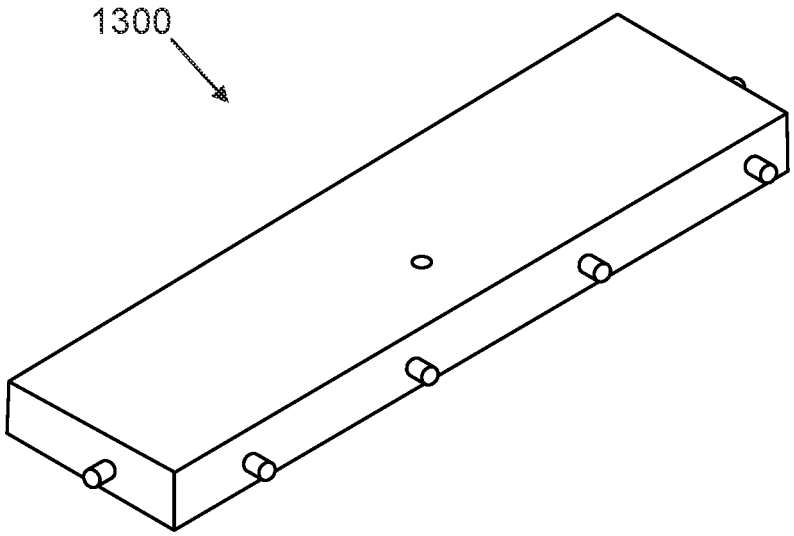
FIG. 13A is a top rear perspective view of a P6-20S short beam of a modular building system, according to an embodiment of the invention.
Figure 13B:
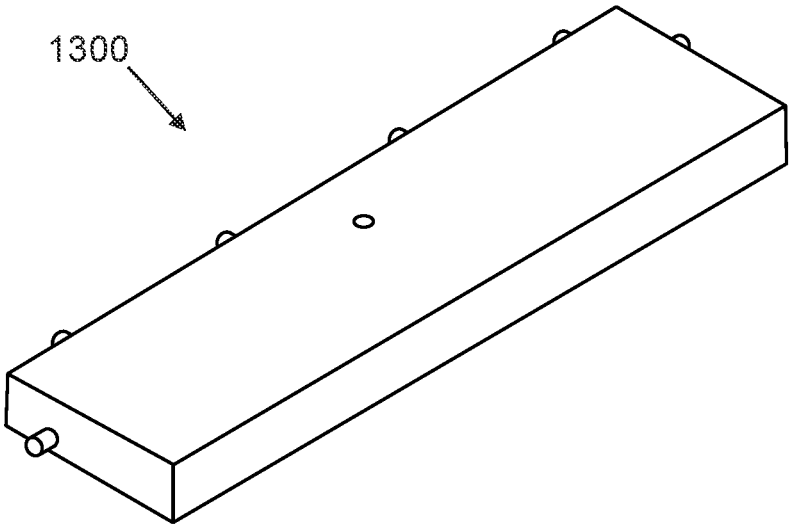
FIG. 13B is a top front perspective view of a P6-20S short beam of a modular building system, according to an embodiment of the invention.
Figure 13C:
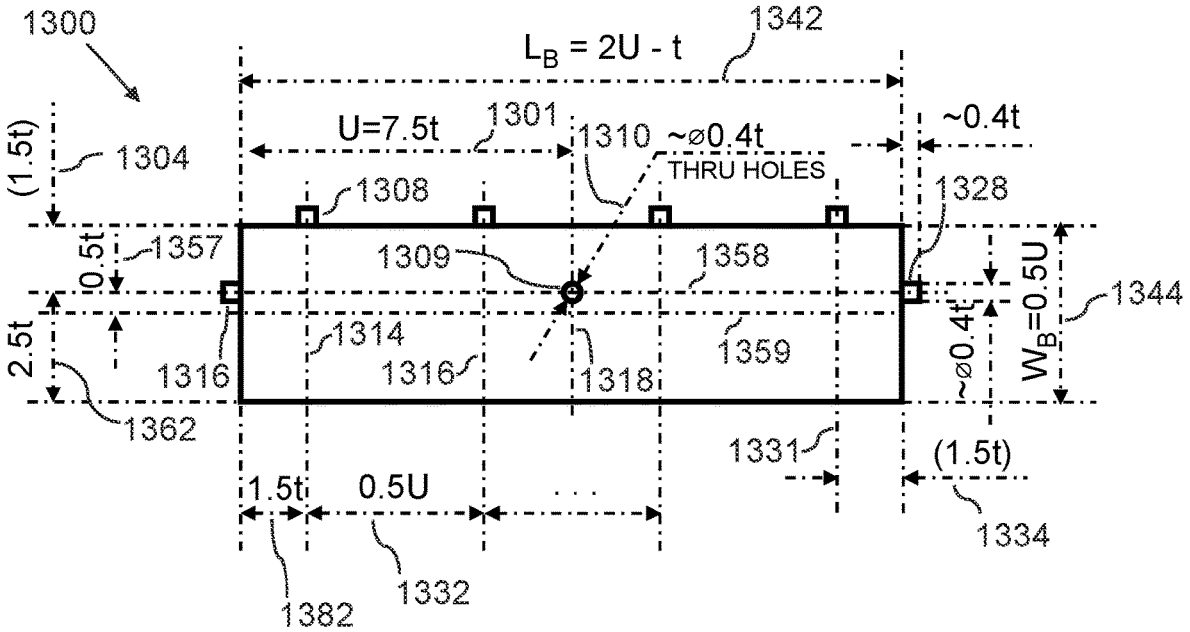
FIG. 13C is a top plan view of a P6-20S short beam of a modular building system, according to an embodiment of the invention.
Figure 13D:
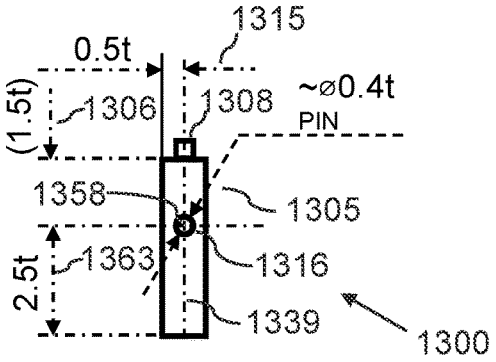
FIG. 13D is a left side view of a P6-20S short beam of a modular building system, according to an embodiment of the invention.
Figure 13E:
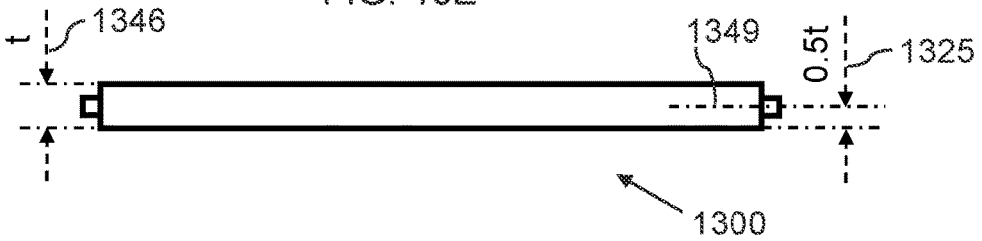
FIG. 13E is a front side view of P6-20S short beam of a modular building system, according to an embodiment of the invention.

In a further related embodiment, as shown in FIGS. 13C (and 13D-13F), the P6-20S short beam 1300 can be proportionally configured such that:

a) a beam length 1342 (also denoted by $L_B$)=2 U−t;

b) a beam width 1344 (also denoted by $W_B$)=0.5 U;

c) a right column inner distance 1301 of 7.5t, from a lateral center thru-hole column line 1318 to a left top edge of the P6-20S short beam;

d) a rear outer distance 1304, 1306 of 1.5t, from longitudinally aligned rear and left side protruding connectors/pins 1316, 1328 that are aligned with a longitudinal rearmost thru-hole row line 1358 to a rear top edge of the P6-20S short beam 1300;

e) a right outer distance 1334 of 1.5t, from a longitudinal leftmost thru-hole column line 1331 to a right top edge of the P6-20S short beam 1300;

f) a diameter 1310 of thru-holes 1309 of about 0.4t;

g) a diameter 1305 of left protruding connector/pin 1316 of about 0.4t;

h) a length of protruding connectors/pins 1328 of about 0.4t;

i) a diameter of protruding connectors/pins 1328 of about 0.4t;

j) a left side vertical displacement 1315 of laterally aligned rear side protruding connector/pin 1308 and left protruding connector/pin 1316, which are aligned along a lateral left centerline 1339;

k) a front side vertical displacement 1325 of longitudinally aligned right side protruding connector/pin 1328, which is longitudinally aligned along a longitudinal front centerline 1349;

l) a longitudinal row/pin/blind hole distance 1332 of 0.5 U between consecutive lateral thru-hole column lines 1314, 1316 that are aligned with corresponding rear side protruding connectors/pins 1308;

m) a front row distance 1362, 1363 of 2.5t, from a front longitudinal thru-hole row line 1358 that is aligned with left and right pins 1316, 1328 to a front top edge of the P6-20S short beam 1300; and n) a next right column distance 1382 of 1.5t, from a right lateral thru-hole column line 1314 that is aligned with a rear leftmost pin 1308 to a left top edge of the P6-20S short beam 1300.

Figure 14:
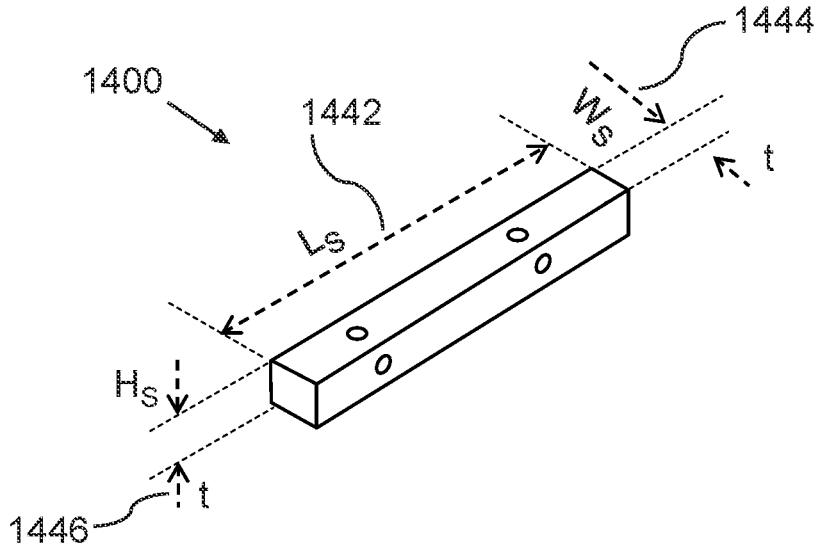
FIG. 14 is a front perspective view of a T6-1 stick of a modular building system, according to an embodiment of the invention.

In other related embodiments, STICKS can include:

a) The smallest size stick is the T6-1 stick 1400, as shown in FIG. 14, wherein:

i. Since its general shape and dimensions have been described before, we will focus on its particular features; and ii. On the lateral elongated sides of the stick there are 2 sets of thru-holes (TH1) and (TH2). There are no holes or pins on the end surfaces; and b) A multiple unit stick, the T6-2 stick 1500 is shown next in FIGS. 15A-15E, wherein:

i. It can easily be seen that an T6-2 stick is the same as 2 T6-1 sticks put together, however the 2 shortest sticks don't have any pin/hole features on the end surfaces so they can be aligned to each other. It will be seen later that such features are not necessary.

Figure 15A:
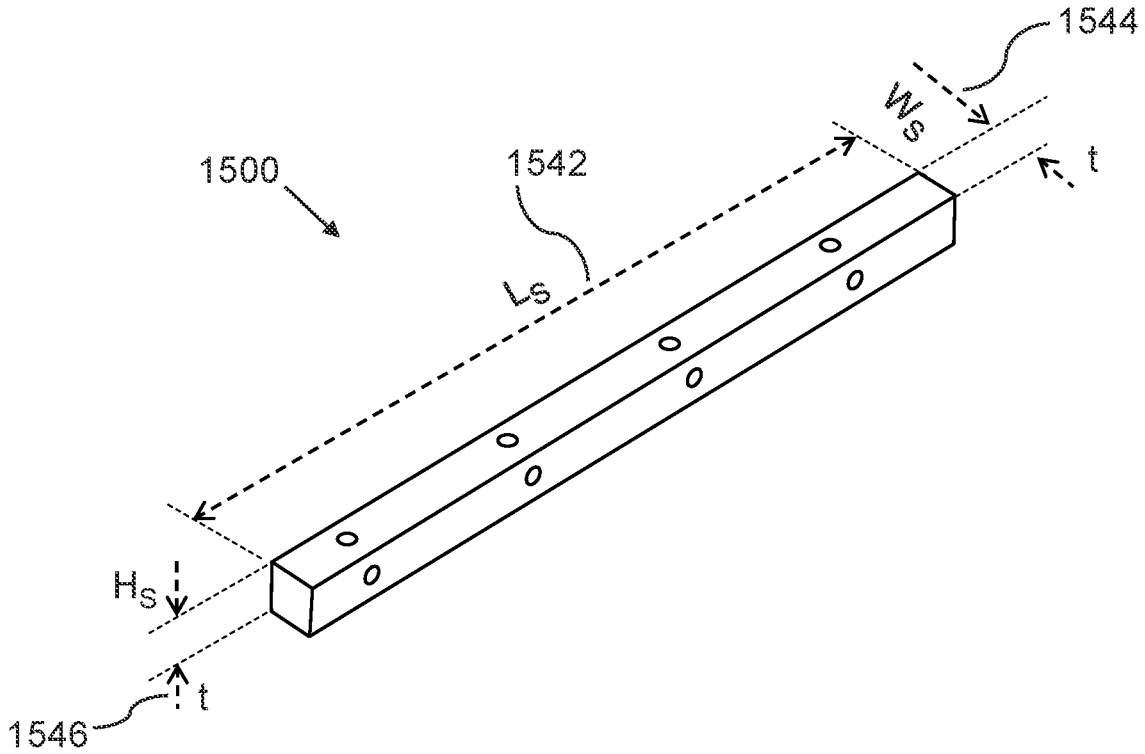
FIG. 15A is a front perspective view of a T6-2 stick of a modular building system, according to an embodiment of the invention.
Figure 15B:
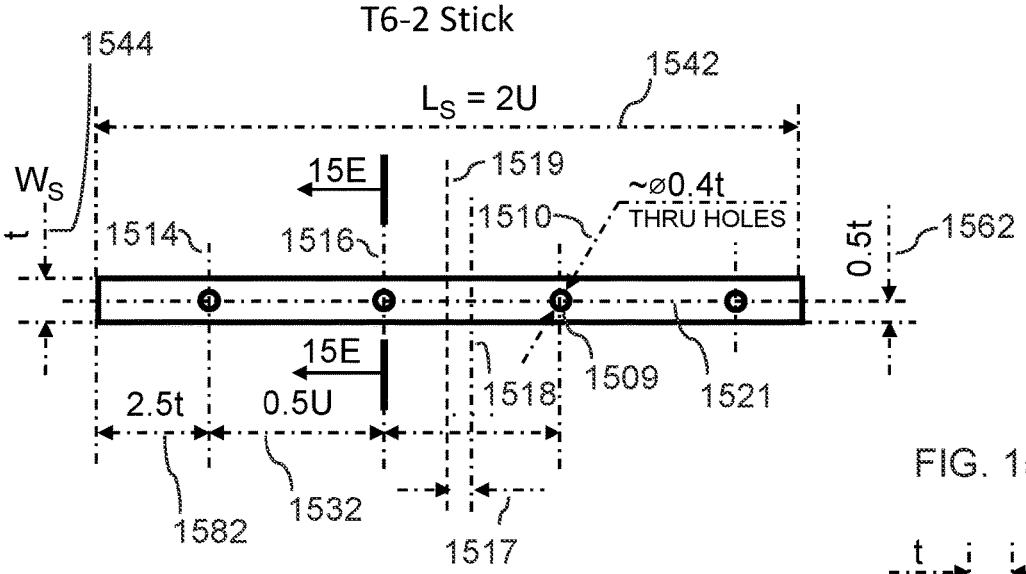
FIG. 15B is a top plan view of a T6-2 stick of a modular building system, according to an embodiment of the invention.
Figure 15C:
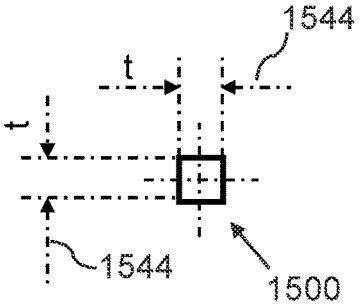
FIG. 15C is a left side view of a T6-2 stick of a modular building system, according to an embodiment of the invention.
Figure 15D:
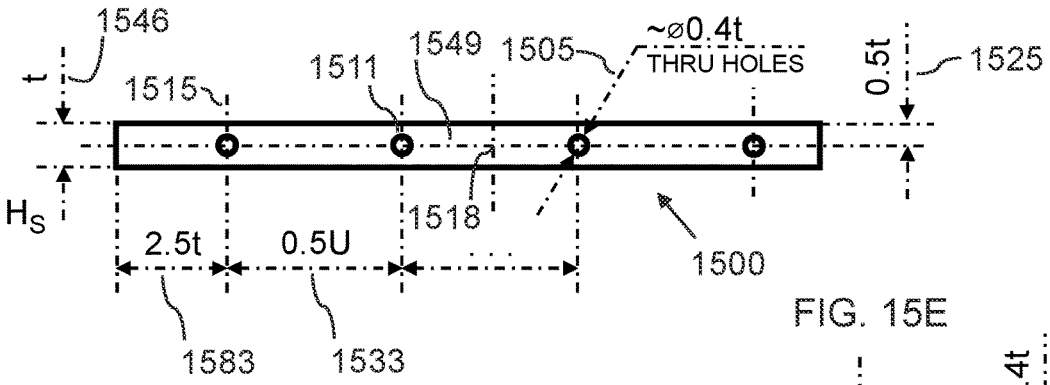
FIG. 15D is a front side view of T6-2 stick of a modular building system, according to an embodiment of the invention.
Figure 15E:
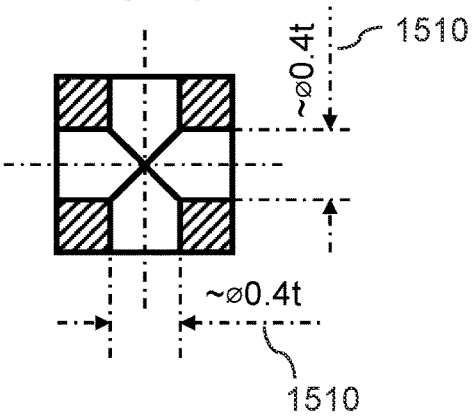
FIG. 15E is a sectional view of a T6-2 stick of a modular building system, taken along section line 15E-15E of FIG. 15B, according to an embodiment of the invention.

In a further related embodiment, as shown in FIGS. 15B (and 15C-15E), the T6-2 stick 1500 can be proportionally configured such that:

a) a stick length 1542 (also denoted by $L_S$)=2 U;

b) a stick width 1544 (also denoted by $W_S$)=t;

c) a stick thickness 1546 (also denoted by Hs)=t;

d) a diameter 1510 of top thru-holes 1509 of about 0.4t;

e) a diameter 1505 of front thru holes 1511 of about 0.4t;

f) a longitudinal thru hole distance 1532, 1533 of 0.5 U between consecutive lateral thru-hole column lines 1514, 1516;

g) a rear thru-hole row distance 1562 of 0.5t, from a longitudinal top center line 1521 to a front top edge of the T6-2 stick 1500; and h) a top displacement distance 1525 of 0.5t, from a longitudinal front center line 1549 to a front top edge of the T6-2 stick 1500; and i) a longitudinal column distance 1582, 1583 of 2.5t, from a right lateral thru-hole column line 1514, 1515 to a left side of the T6-2 stick 1500.

In various related embodiments, illustrating how the modular building system 100 works, the different parts can be assembled with each other, such that:

a) The main purpose of the holes and pins is to position the parts to each other. They may also offer some structural strength, however due to the short length of the pins, this is not their main purpose. Additional hardware must be provided to keep the parts together in structural applications; and b) In non-structural applications, the holes and pins may be sufficient to keep the parts together, if the proper fit between them is provided. With some modifications that will be described later, the edges of the plates and the pins can be made stronger while still conforming to the described system.

Figure 16A:
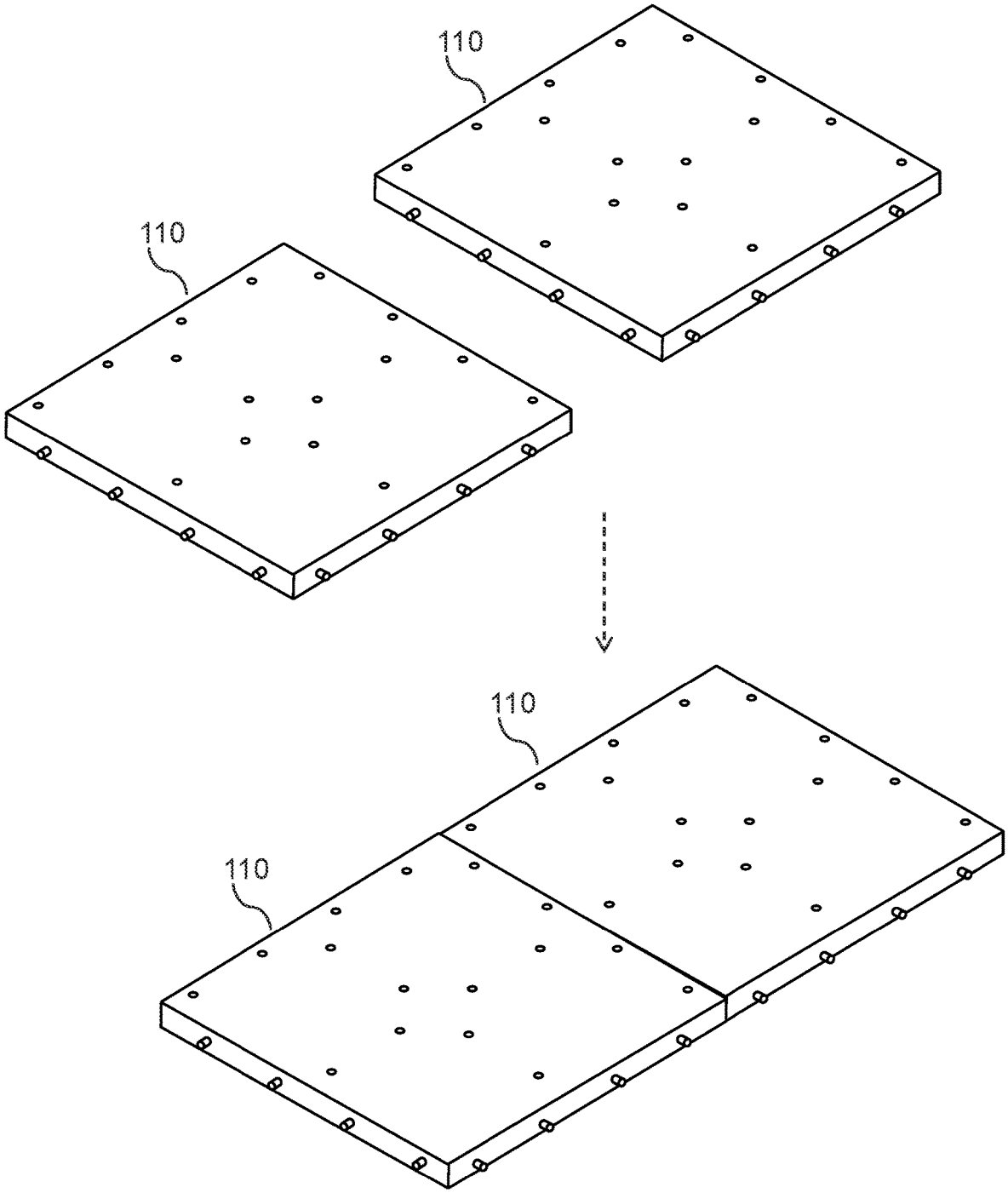
FIG. 16A is a perspective view illustrating a first optional step of an assembly process for the modular building system, according to an embodiment of the invention.
Figure 16B:
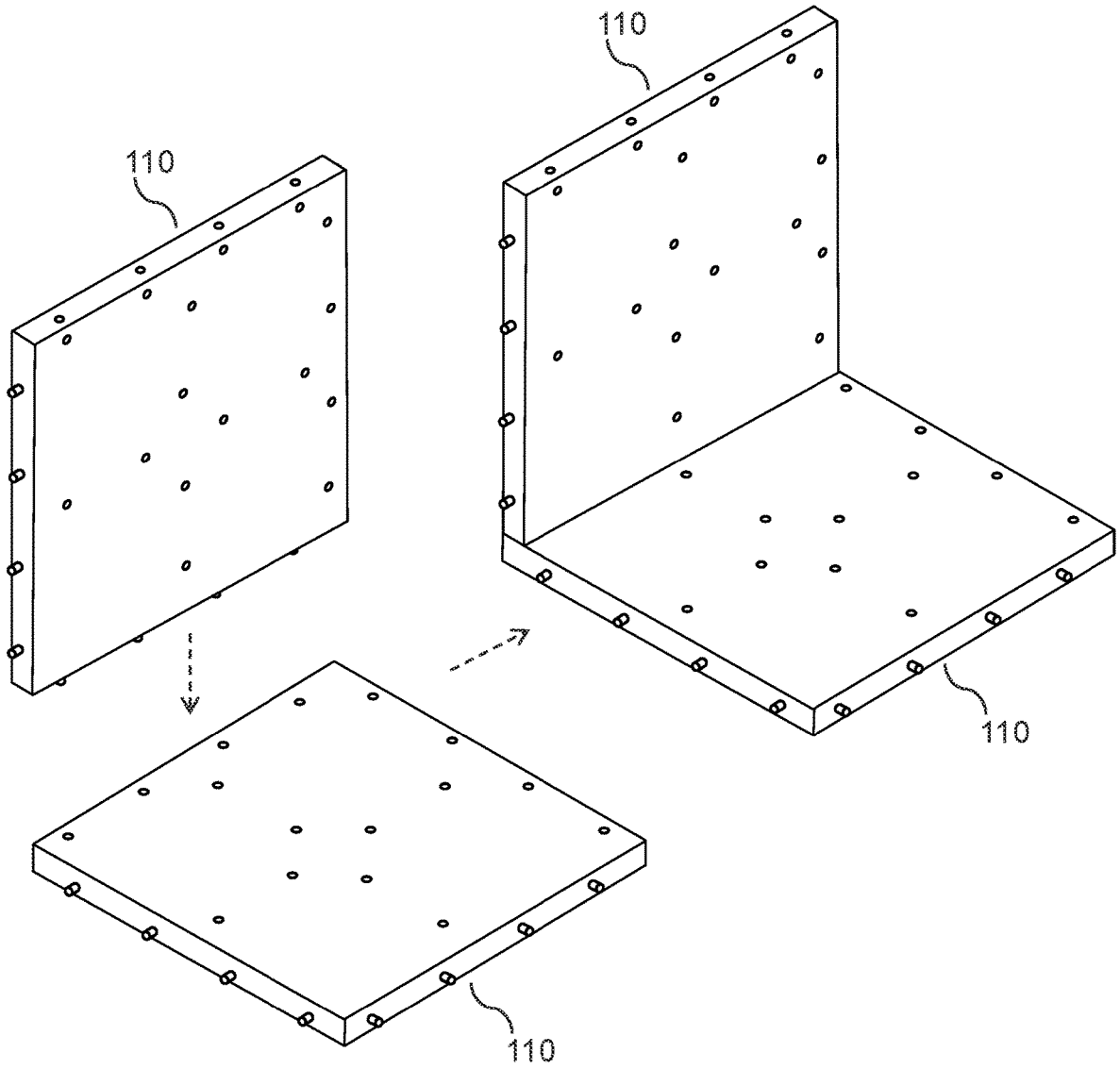
FIG. 16B is a perspective view illustrating a second optional step of an assembly process for the modular building system, according to an embodiment of the invention.
Figure 16C:
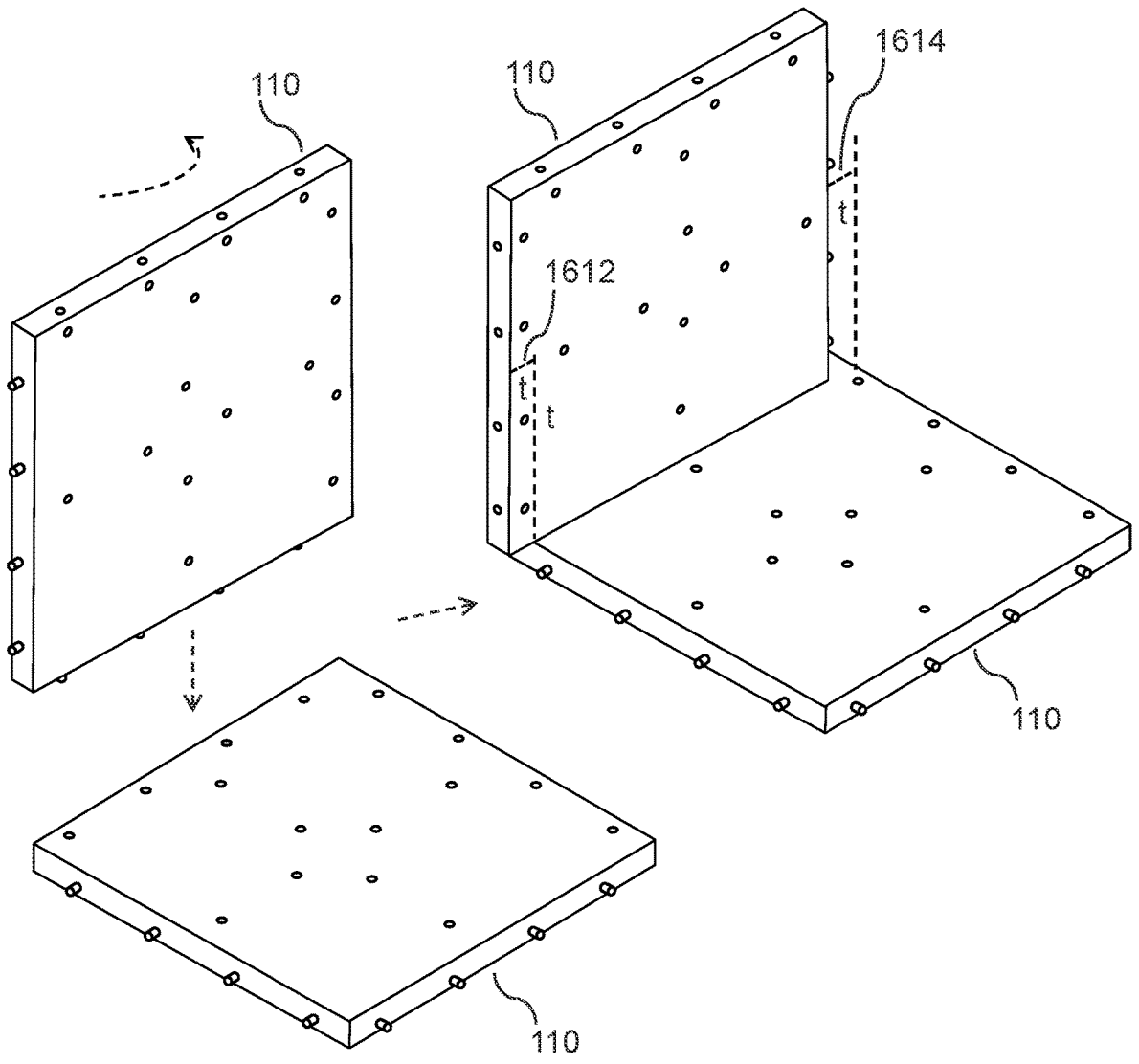
FIG. 16C is a perspective view illustrating a third optional step of an assembly process for the modular building system, according to an embodiment of the invention.
Figure 16D:
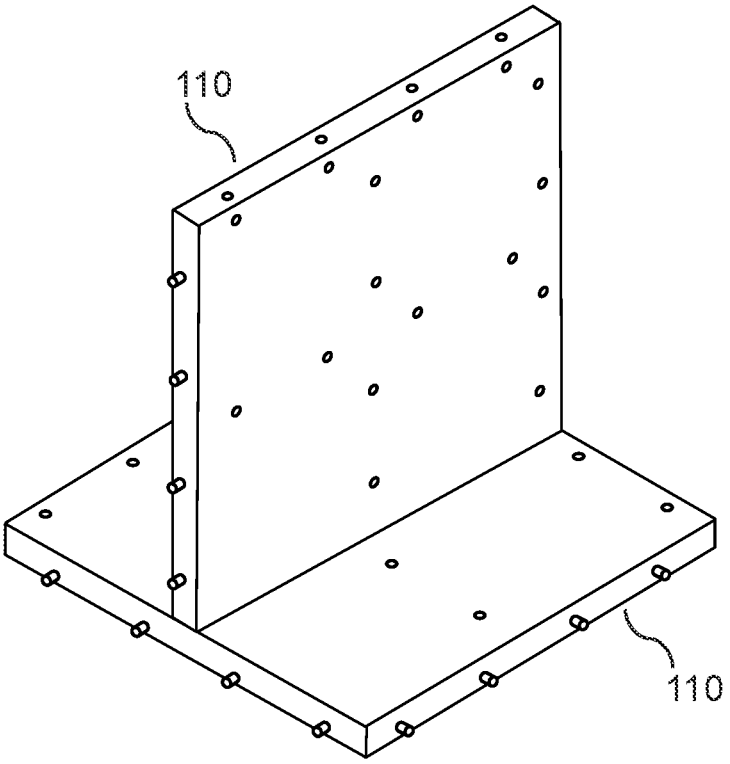
FIG. 16D is a perspective view illustrating a fourth optional step of an assembly process for the modular building system, according to an embodiment of the invention.
Figure 16E:
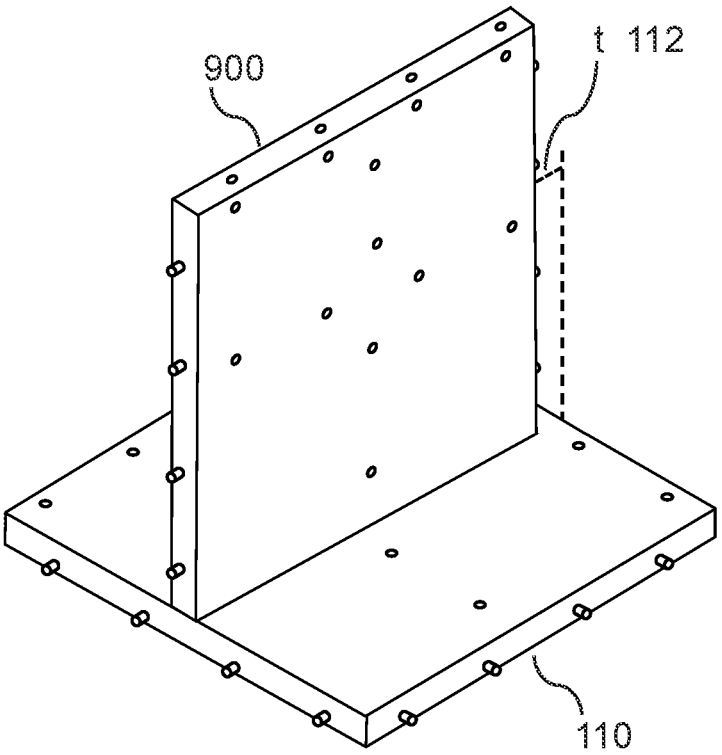
FIG. 16E is a perspective view illustrating a fifth optional step of an assembly process for the modular building system, according to an embodiment of the invention.
Figure 16F:
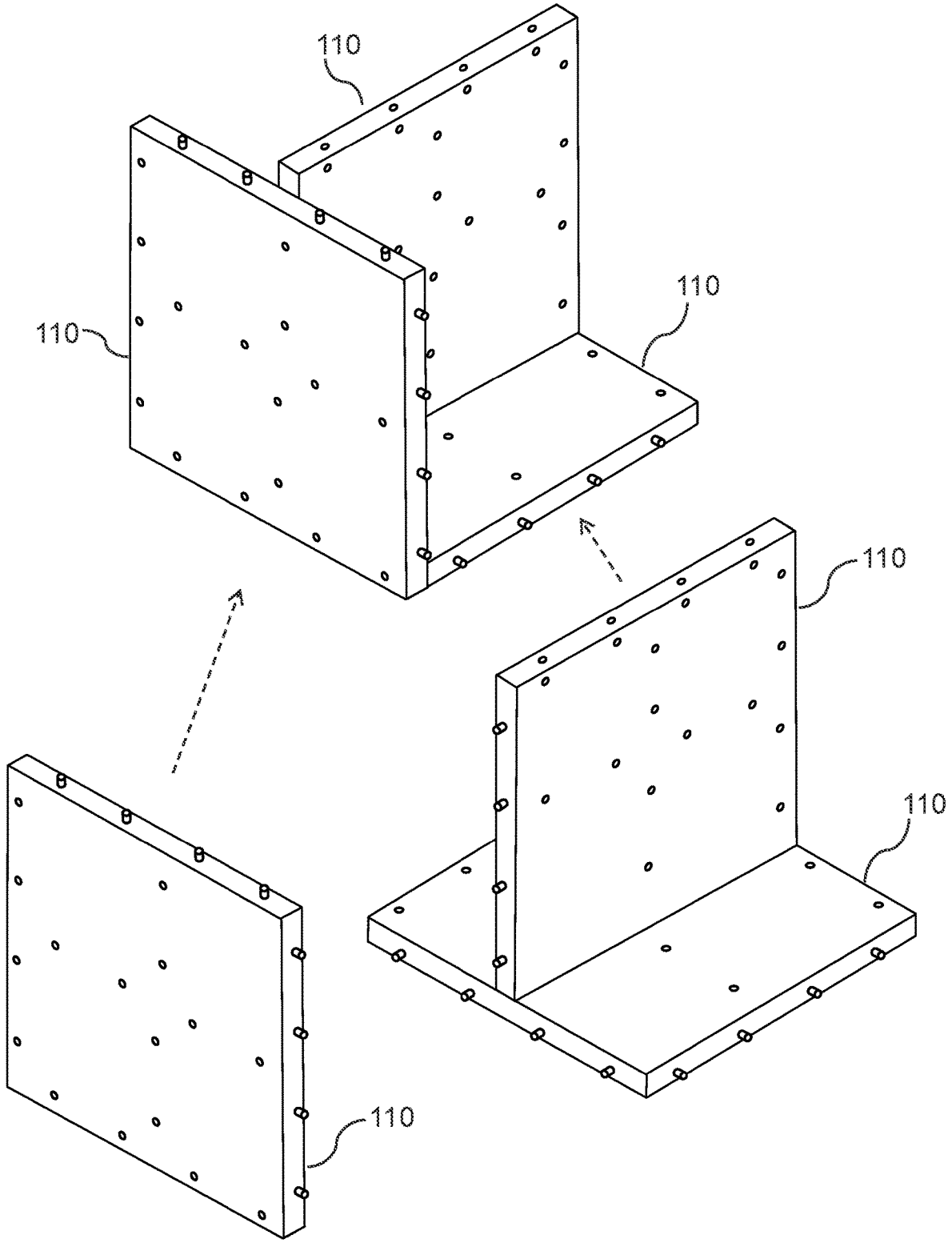
FIG. 16F is a perspective view illustrating a sixth optional step of an assembly process for the modular building system, according to an embodiment of the invention.
Figure 16G:
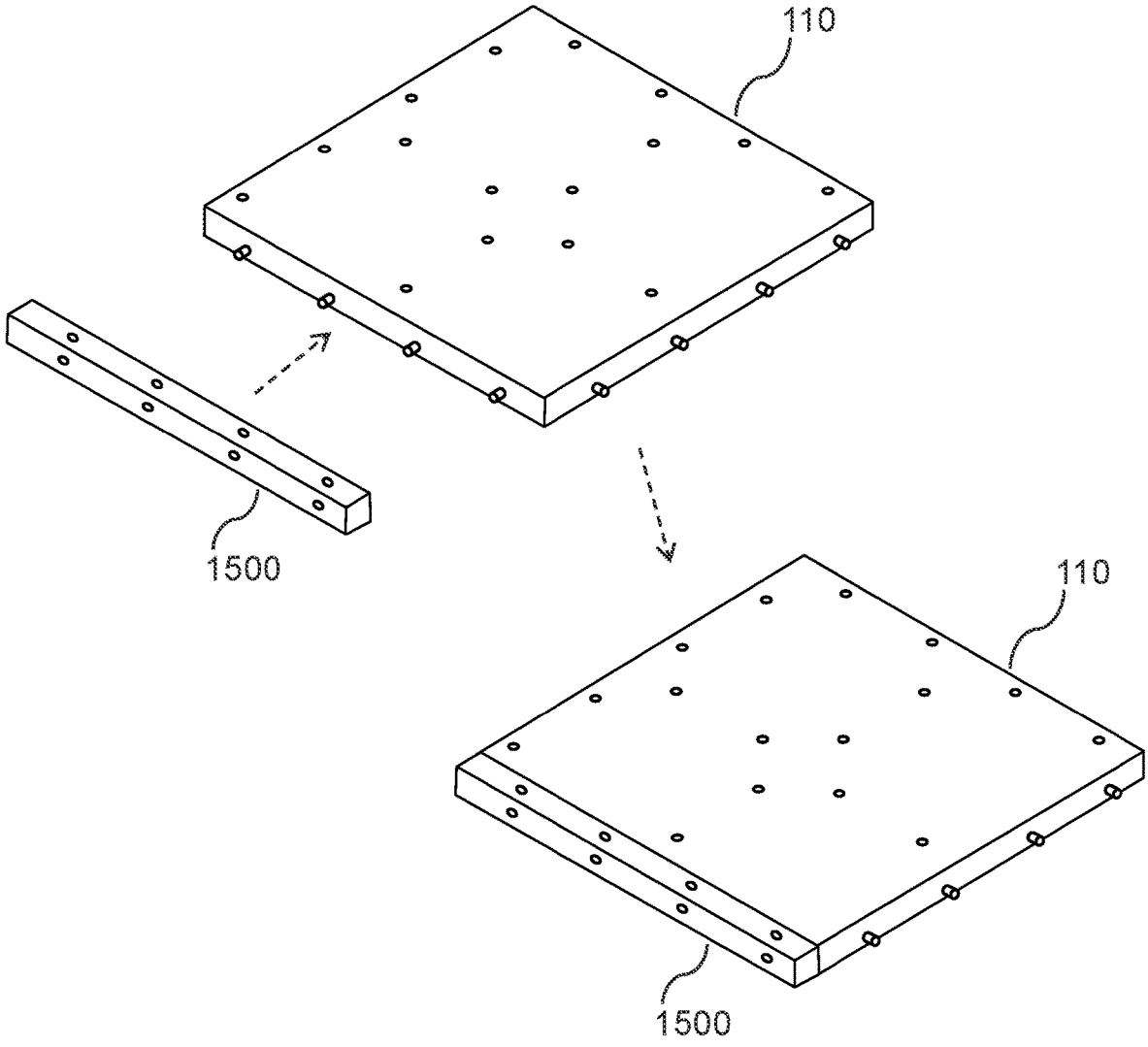
FIG. 16G is a perspective view illustrating a seventh optional step of an assembly process for the modular building system, according to an embodiment of the invention.

In various related embodiments, as shown in FIGS. 16A-16G, different ways of putting parts together to form an assembly can include:

a) Mating 2 parts on the edge, in the same plane, as shown in FIG. 16A, wherein:

i. The pins on one part slide into the blind holes at the edge of the other part;

b) Mating 2 parts on the edge in an L-shape, as shown in FIG. 16B, wherein:
   i. The pins on one part slide into the thru-holes at the edge of the other part. The picture shows 2 parts of identical size, aligned to each other; and
   ii. If one plate is flipped 180 degrees compared to the previous case, there will be an offset between the edges of the parts at both ends. The offset is equal to the plate thickness, as shown in FIG. 16C;

c) Mating 2 parts in a T-shape, as shown in FIG. 16D, wherein:
   i. The pins on one part slide into the thru-holes in the body of the other part;
   ii. This can be done with or without an offset (shown without an offset in FIG. 16D); and
   iii. If one of the plates is regular and the other is short, there will be an offset at one end of the short plate only, as shown in FIG. 16E;

d) Mating 3 parts together in a corner, as shown in FIG. 16F, wherein:
   i. The pins from an L-shape or T-shape assembly slide into the thru-holes in the body of the 3rd part; and e) Mating a stick to a plate or beam, as shown in FIG. 16G, wherein:
   i. The pins of a plate or beam slide into the thru-holes in the side of a stick.

Figure 17A:
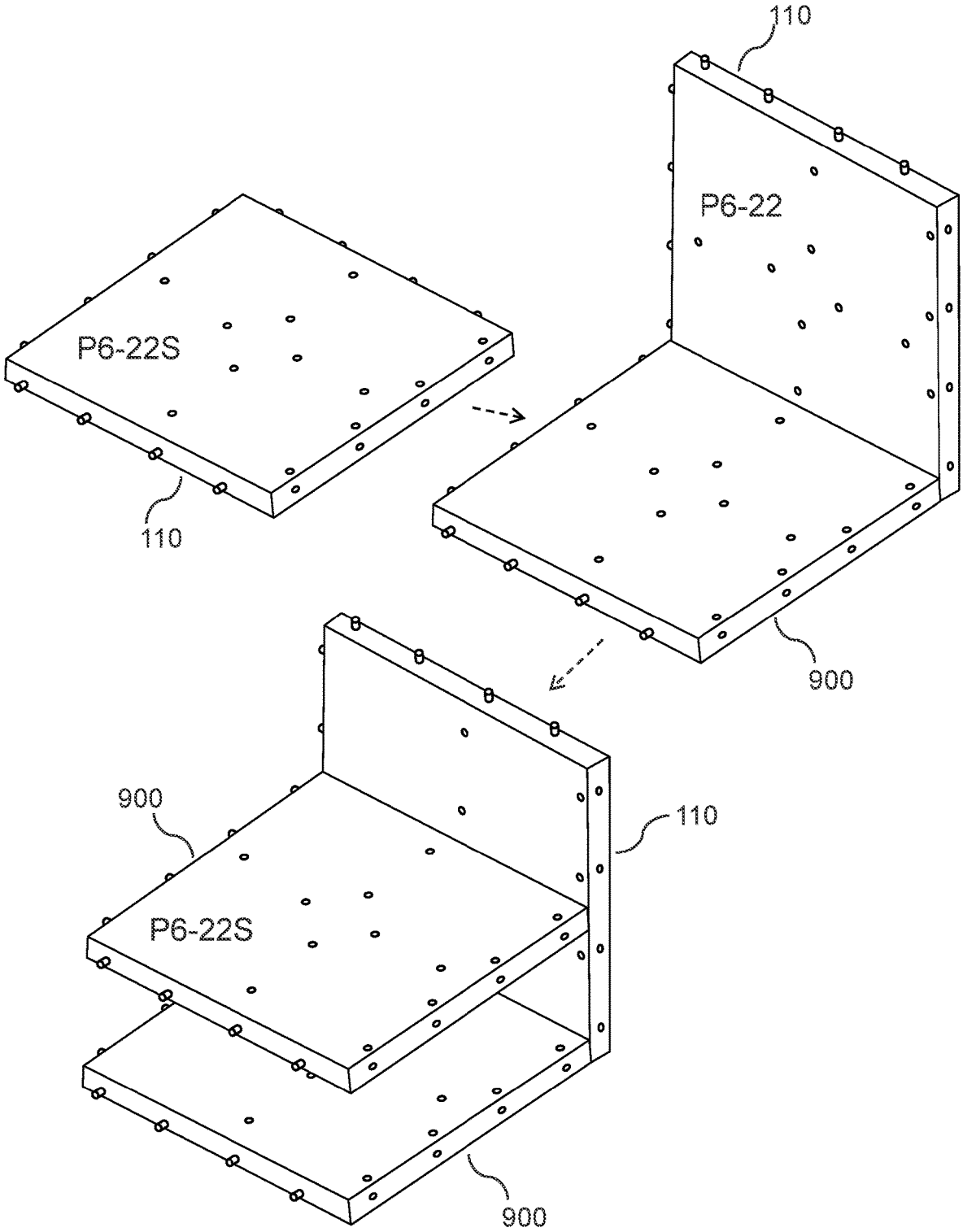
FIG. 17A is a front perspective view illustrating a first sequence of steps of an assembly process for a complex assembly of the modular building system, according to an embodiment of the invention.
Figure 17B:
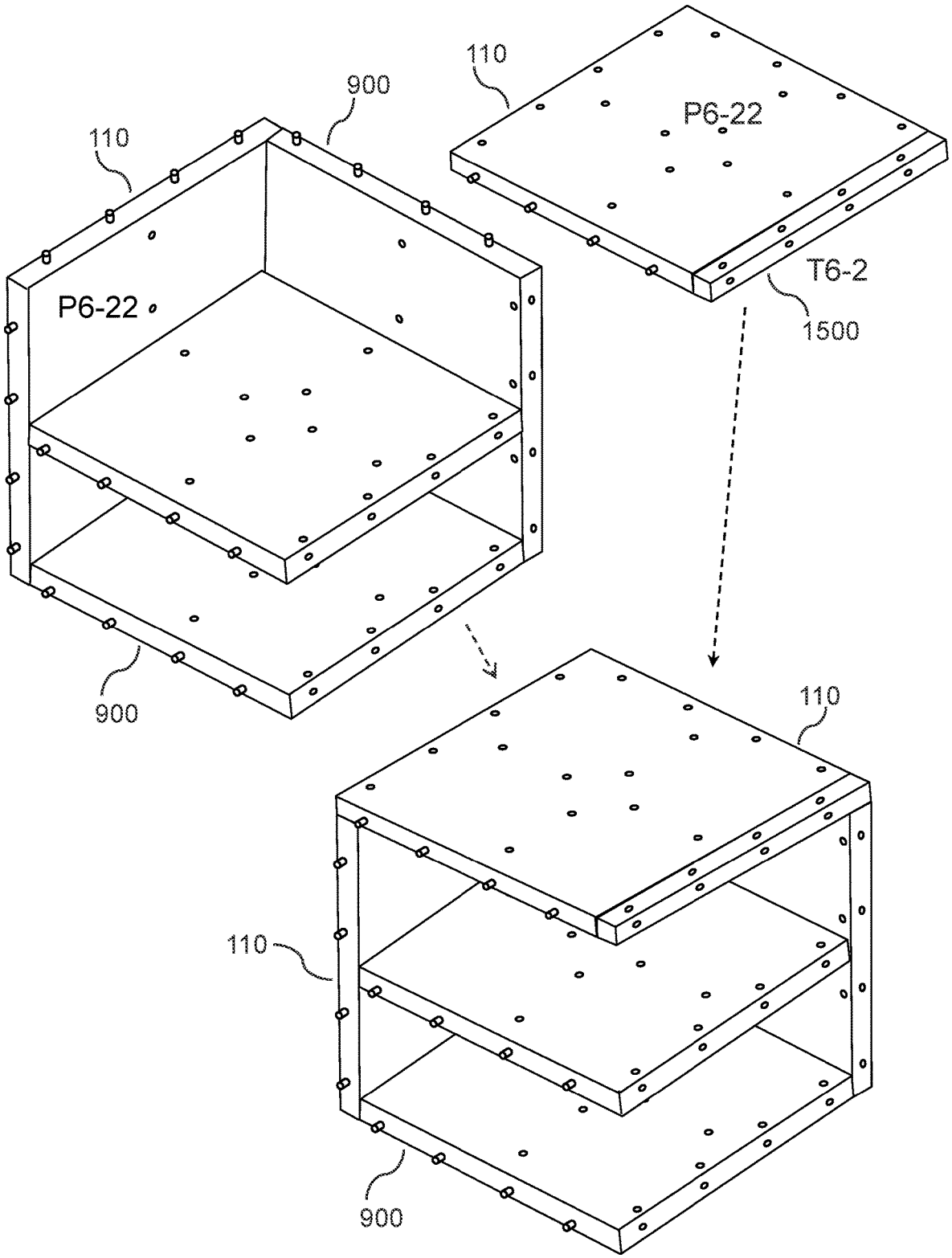
FIG. 17B is a front perspective view illustrating a second sequence of steps of an assembly process for a complex assembly of the modular building system, according to an embodiment of the invention.
Figure 17C:
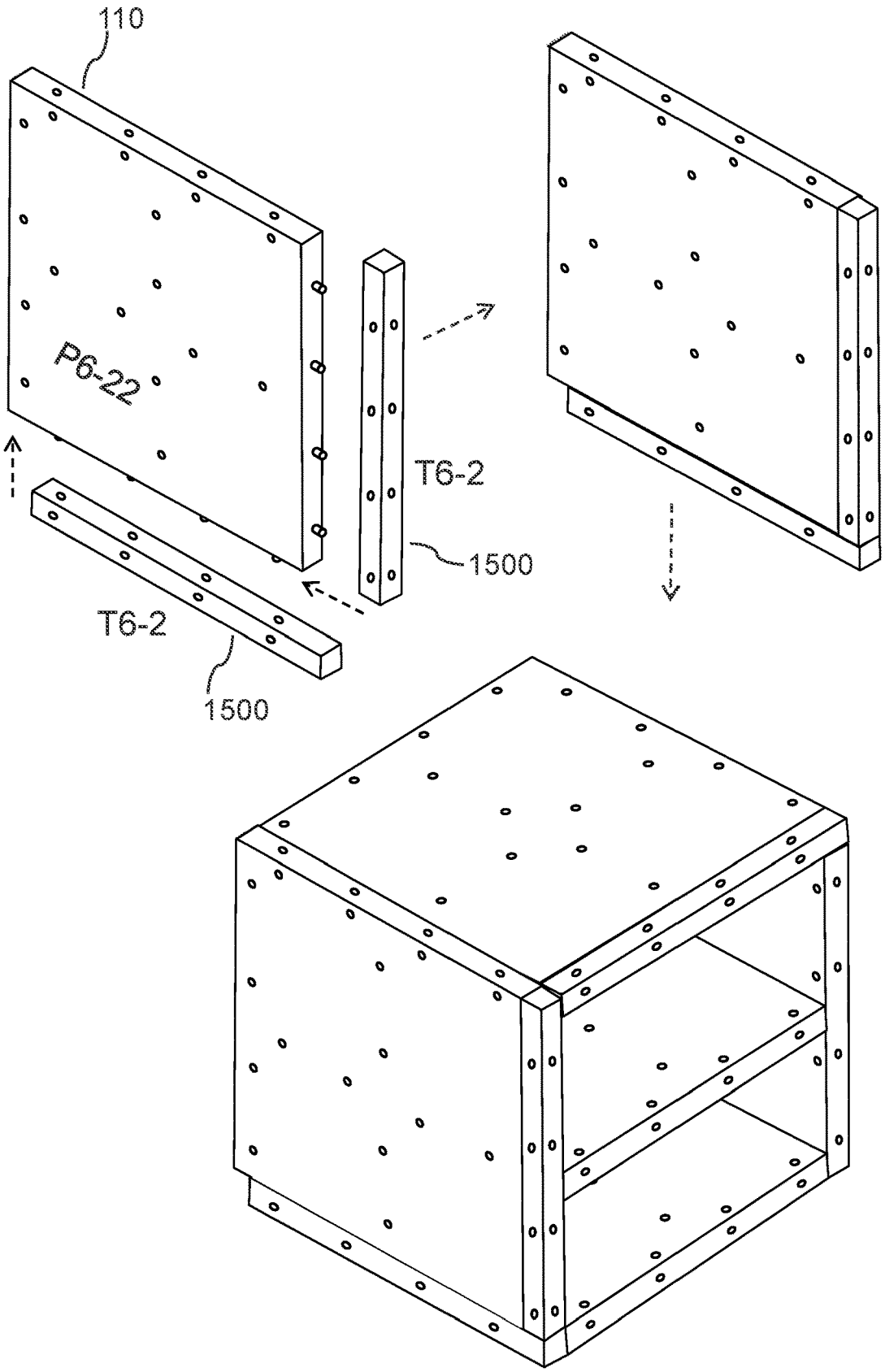
FIG. 17C is a front perspective view illustrating a third sequence of steps of an assembly process for a complex assembly of the modular building system, according to an embodiment of the invention.
Figure 17D:
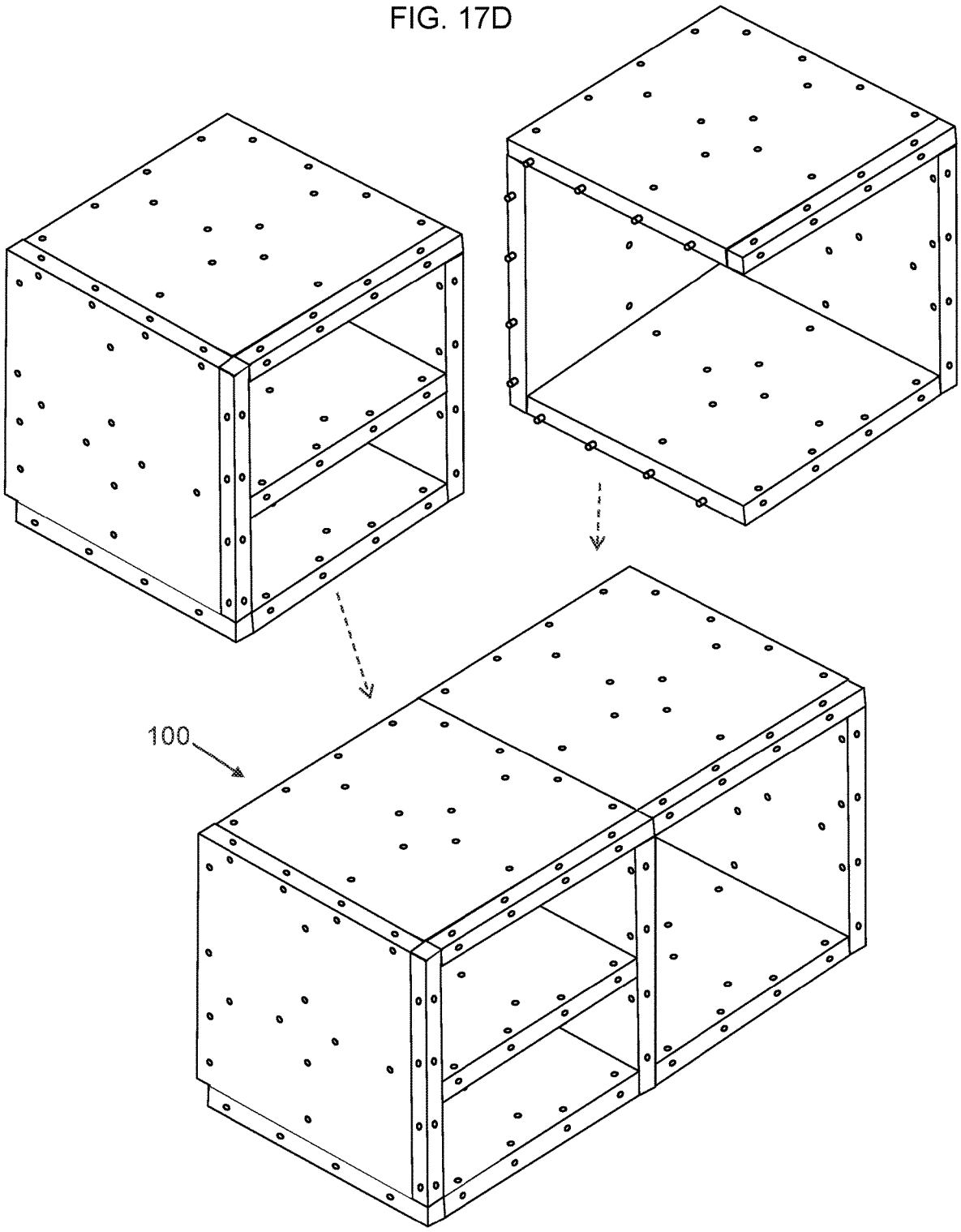
FIG. 17D is a front perspective view illustrating a fourth final sequence of steps of an assembly process for a complex assembly of the modular building system, according to an embodiment of the invention.

In a related embodiment, FIGS. 17A-17D show an example of how a more complex structure is put together. As a practical application, this could be a customized piece of furniture. The parts used at each step are listed with each figure, such as the assembly process can include:

a) Extending the structure horizontally by adding a previously-formed subassembly; and
b) Completing the structure by creating as final assembled modular building system 100, as shown in FIGS. 1 and 17D.

Figure 18:
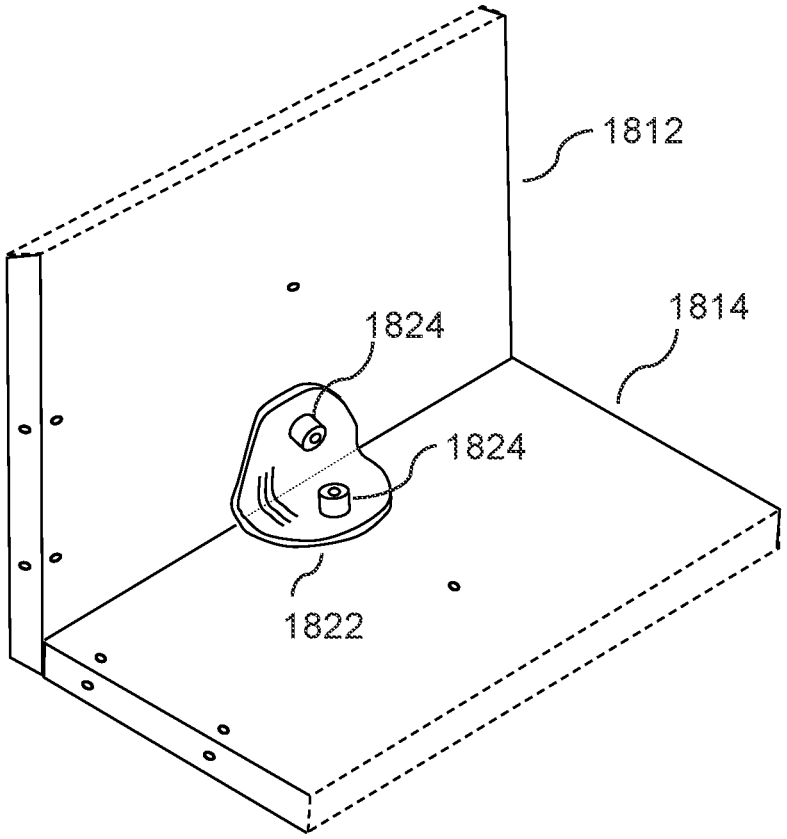
FIG. 18 is a perspective view illustrating use of a bracket and screws to secure plates of the modular building system, according to an embodiment of the invention.
Figure 19A:
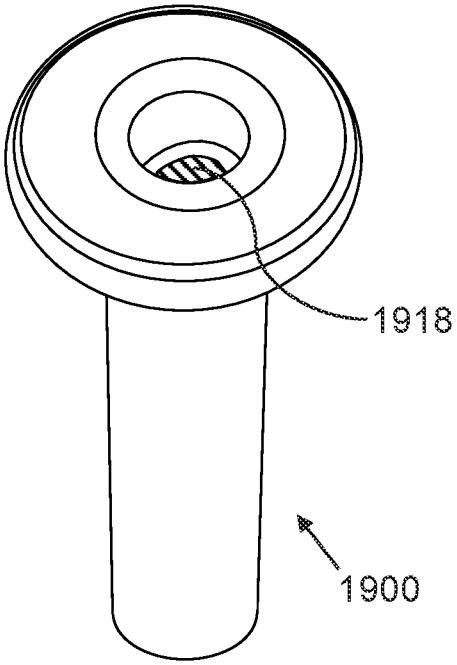
FIG. 19A is a top perspective view of a threaded tubular rivet of the modular building system, according to an embodiment of the invention.
Figure 19B:
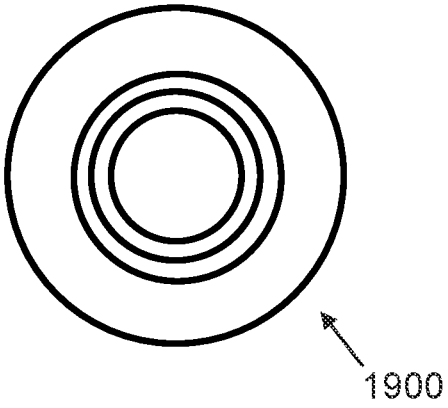
FIG. 19B is a top view of a threaded tubular rivet of the modular building system, according to an embodiment of the invention.
Figure 19C:
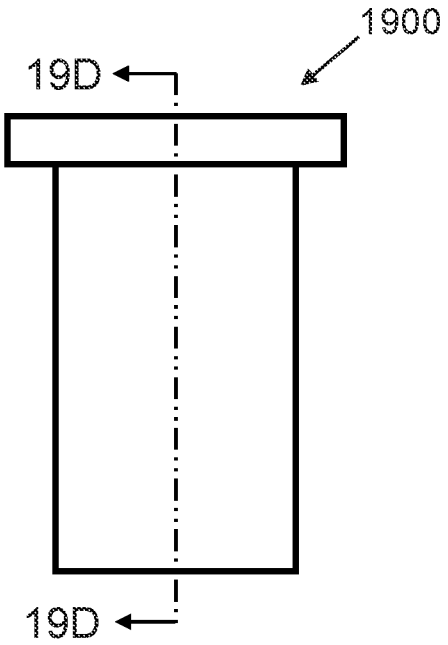
FIG. 19C is a side view of a threaded tubular rivet of the modular building system, according to an embodiment of the invention.
Figure 19D:
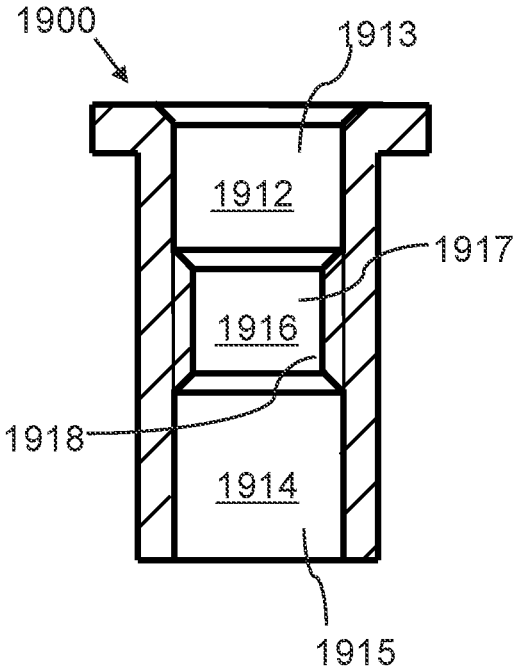
FIG. 19D is a sectional view of a threaded tubular rivet of the modular building system, taken along section line 19D-19D of FIG. 19C, according to an embodiment of the invention.

In related embodiments, individual plates 1812, 1814 can be secured together using brackets 1822 and screws 1824, as shown in FIG. 18, using variety of well-known methods and fastening devices.

In a related embodiment, as shown in FIGS. 19A-19D, a threaded tubular rivet 1900 can be pre-assembled into every thru-hole that is not located on an edge (for example, into the TH2 and TV2 holes of a P6-22 plate). The threaded tubular rivet can be of a special design, wherein a middle portion 1916 is threaded, while first and second outer portions 1912, 1914 are smooth, having a diameter equal to that of a pin.

Figure 20A:
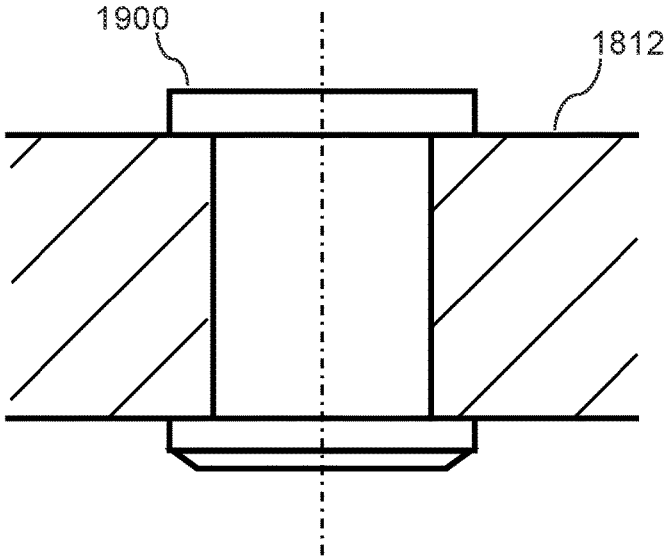
FIG. 20A is a schematic sectional side view of a threaded tubular rivet installed in a plate of the modular building system, according to an embodiment of the invention.
Figure 20B:
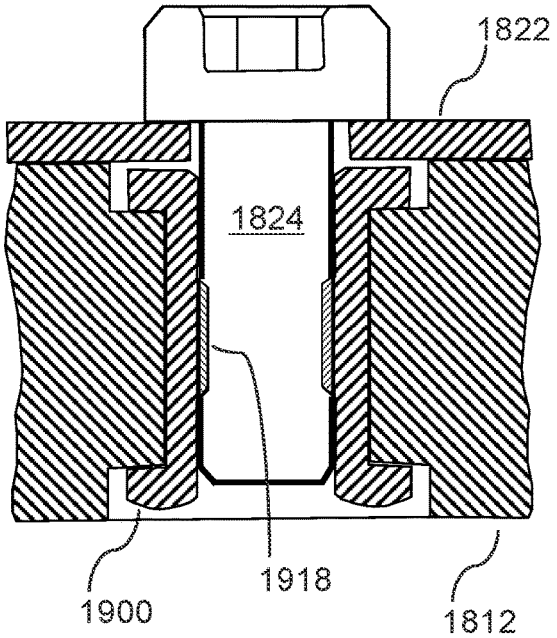
FIG. 20B is a schematic sectional side view of a threaded tubular rivet installed in a plate of the modular building system, wherein a screw is screwed into the threading of the threaded tubular rivet to secure a bracket, according to an embodiment of the invention.
Figure 20C:
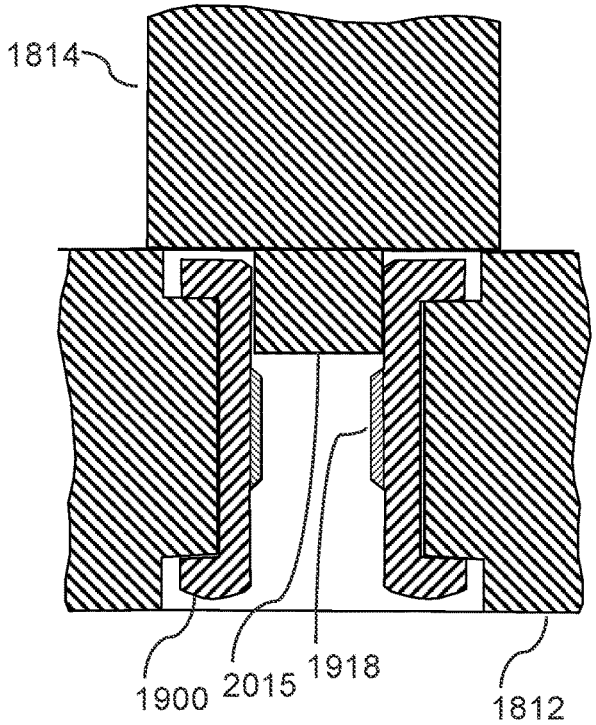
FIG. 20C is a schematic sectional side view of a threaded tubular rivet installed in a plate of the modular building system, wherein a pin of a plate is inserted into the non-threaded hole of the threaded tubular rivet to secure the plate, according to an embodiment of the invention.

In a further related embodiment, as shown in FIGS. 20A-20B, a threaded tubular rivet 1900 can be used to secure a bracket with a screw, or act as a regular hole positioning the pin of another plate.

In related embodiments, to account for dimensional and positional tolerances, the size of holes and bosses will have to be adjusted to provide a correct fit between parts in all cases. As a result, the holes may have to be slightly larger than the dimensions indicated on the drawings, or the pins will have to be slightly smaller. The overall dimensions (of the parts) will be affected by manufacturing tolerances as well, meaning that small gaps and deformations may develop between parts when fully assembled. It is beyond the purpose of this disclosure to provide exact values for tolerances, as those will depend on materials, manufacturing methods and cost considerations.

Figure 21:
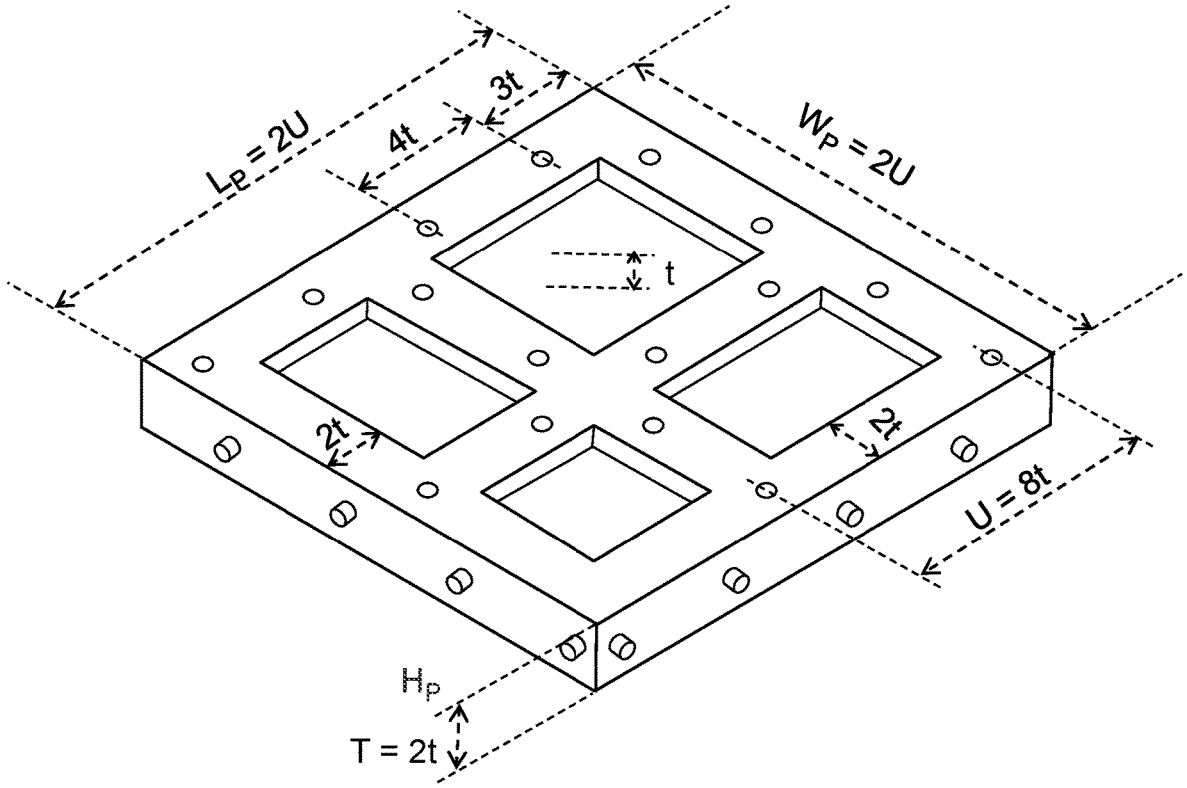
FIG. 21 is a top rear perspective view of a P6R-22 reinforced beam of a modular building system, according to an embodiment of the invention.
Figure 22:
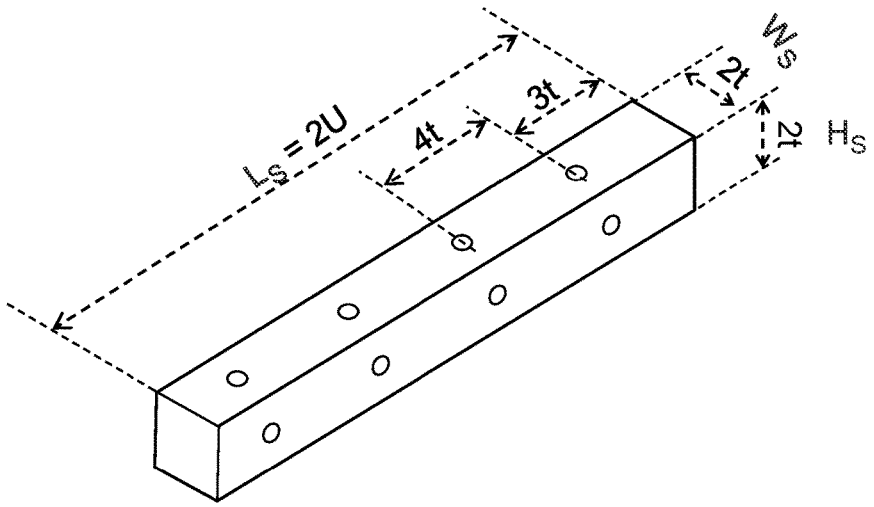
FIG. 22 is a perspective view of a T6R-2 reinforced stick of a modular building system, according to an embodiment of the invention.
Figure 23A:
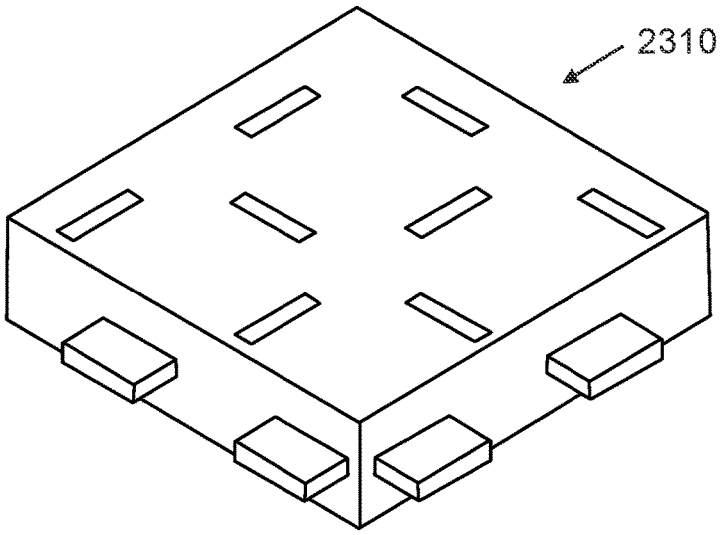
FIG. 23A is a top rear perspective view of a P6K-22 regular block of a modular building system, according to an embodiment of the invention.
Figure 23B:
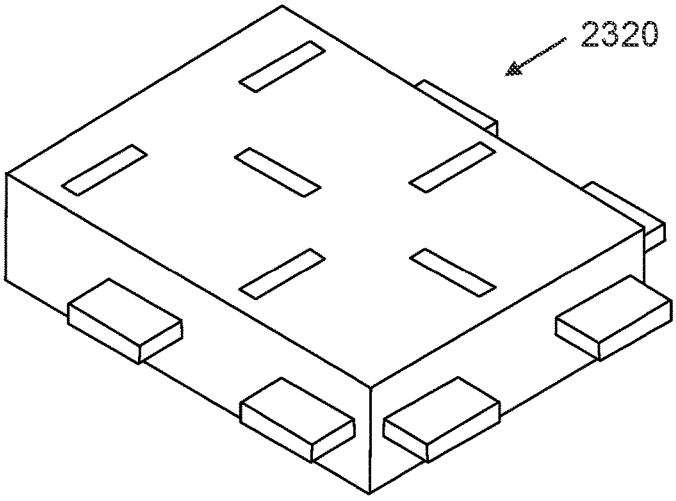
FIG. 23B is a top rear perspective view of a P6K-22S short block of a modular building system, according to an embodiment of the invention.
Figure 23C:
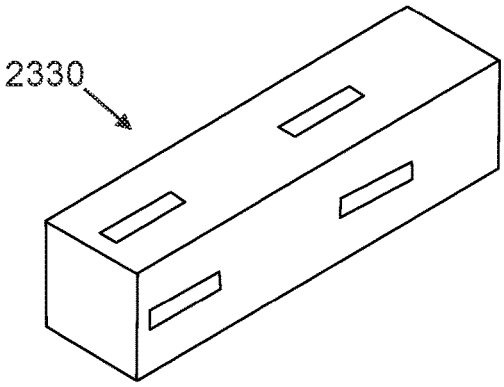
FIG. 23C is a perspective view of a T6K-2 stick of a modular building system, according to an embodiment of the invention.
Figure 24A:
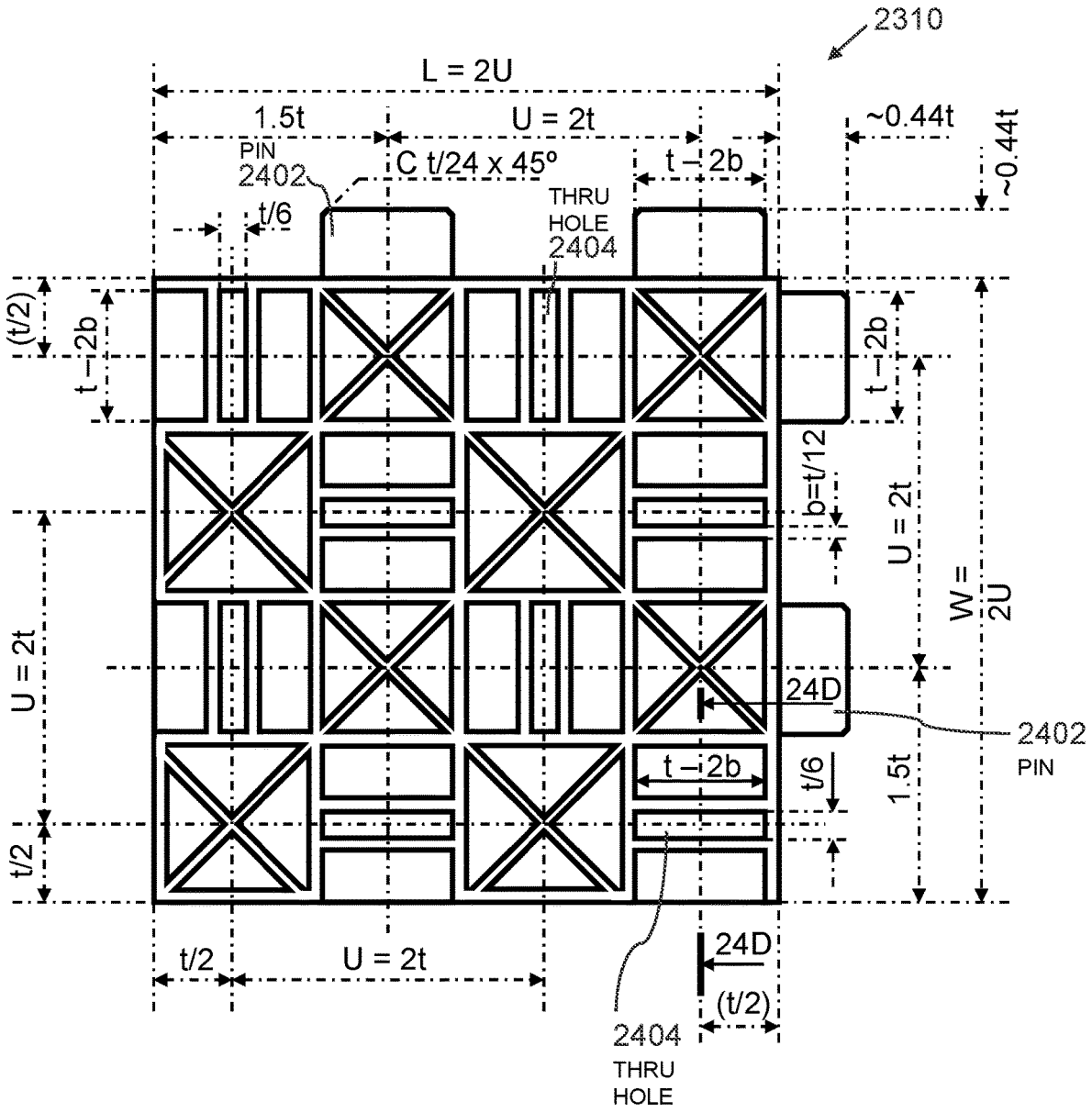
FIG. 24A is a top plan view of a P6K-22 regular block of a modular building system, according to an embodiment of the invention.
Figure 24B:
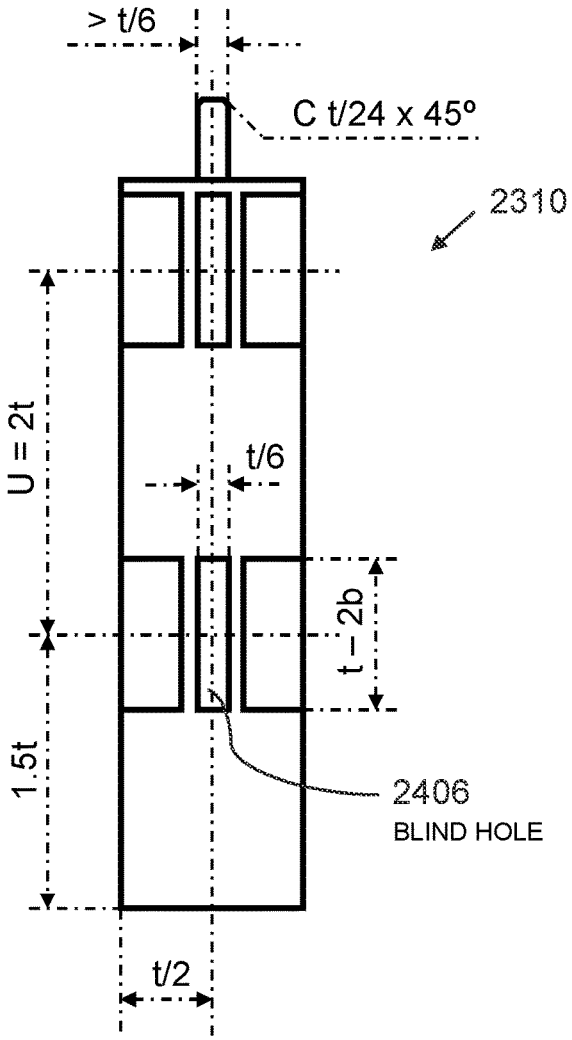
FIG. 24B is a left side view of a P6K-22 regular block of a modular building system, according to an embodiment of the invention.
Figure 24D:
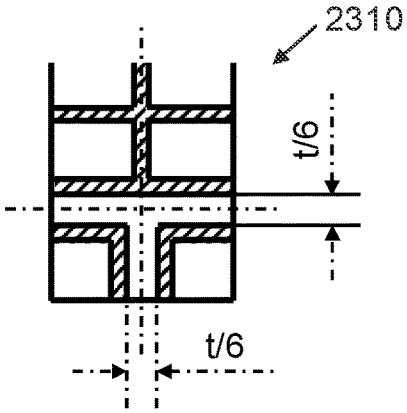
FIG. 24D is a sectional view of a P6K-22 regular block of a modular building system, taken along section line 24D-24D of FIG. 24A, according to an embodiment of the invention.
Figure 24C:
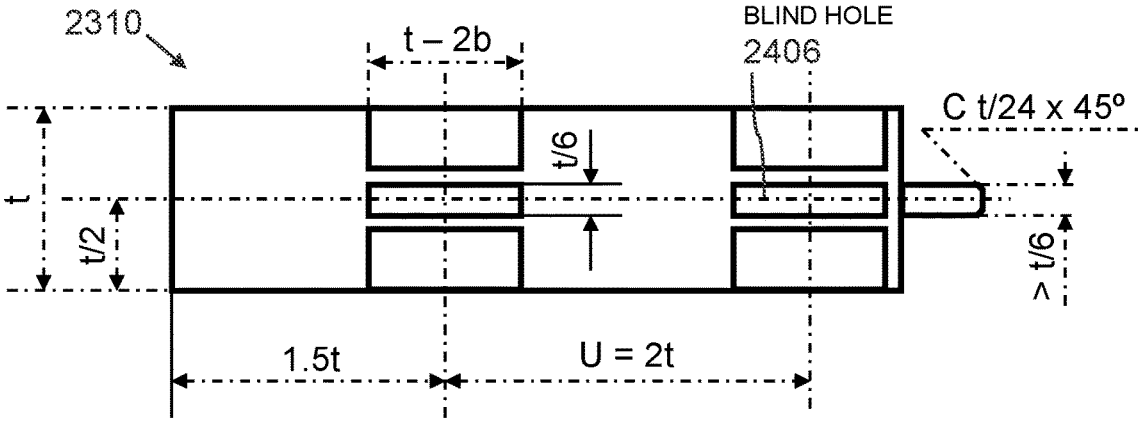
FIG. 24C is a front view of a P6K-22 regular block of a modular building system, according to an embodiment of the invention.
Figure 25A:
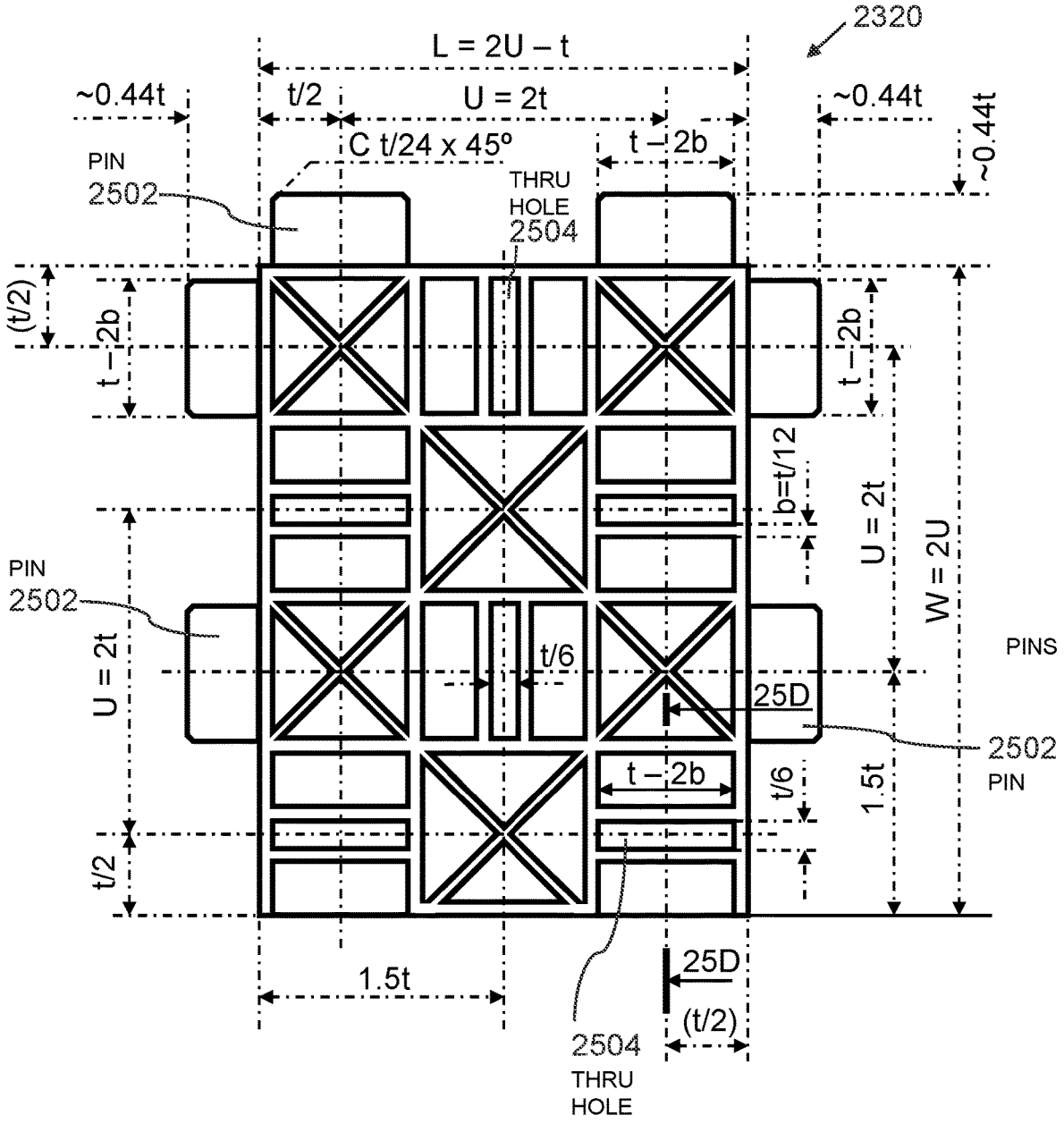
FIG. 25A is a top plan view of a P6K-22S short block of a modular building system, according to an embodiment of the invention.
Figure 25B:
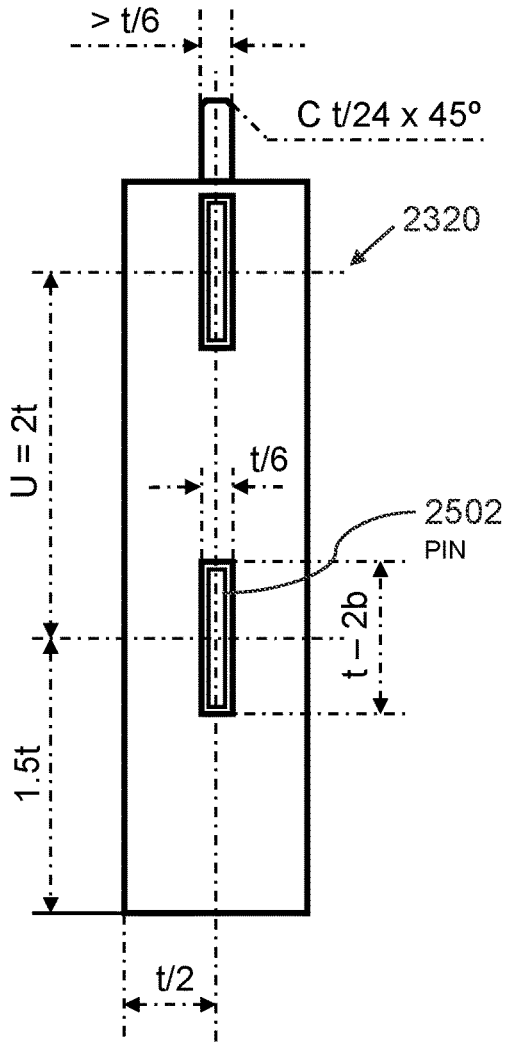
FIG. 25B is a left side view of a P6K-22S short block of a modular building system, according to an embodiment of the invention.
Figure 25D:
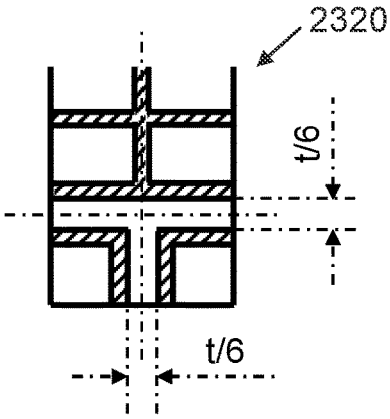
FIG. 25D is a sectional view of a P6K-22S short block of a modular building system, taken along section line 25D-25D of FIG. 25A, according to an embodiment of the invention.
Figure 25C:
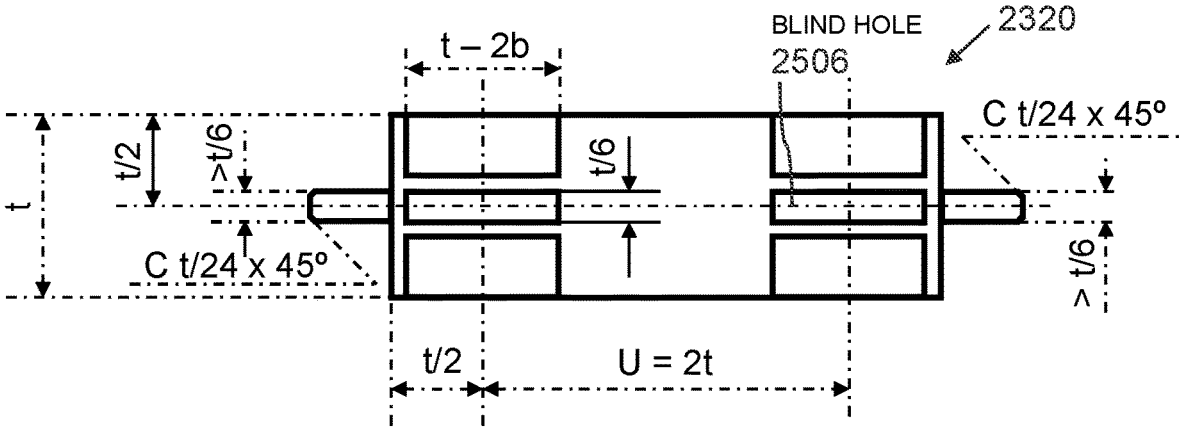
FIG. 25C is a front view of a P6K-22S short block of a modular building system, according to an embodiment of the invention.
Figure 26A:
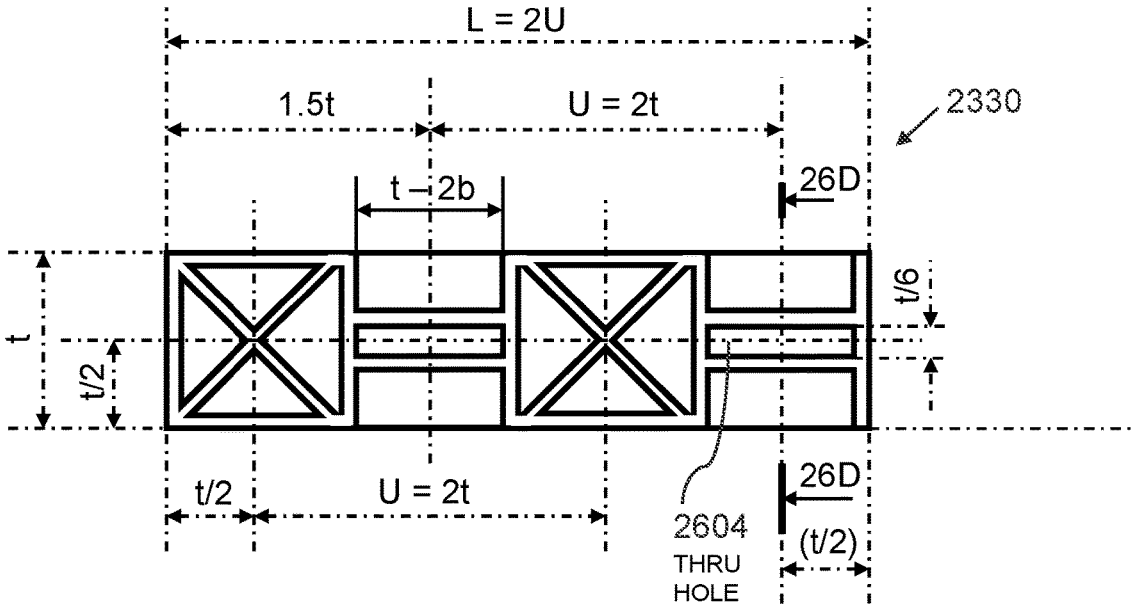
FIG. 26A is a top plan view of a T6K-2 stick of a modular building system, according to an embodiment of the invention.
Figure 26B:
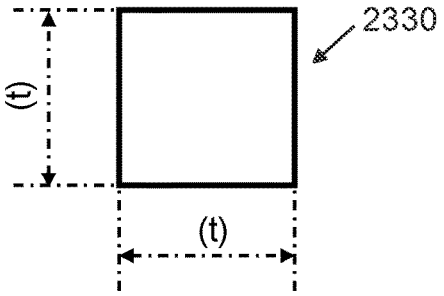
FIG. 26B is a left side view of a T6K-2 stick of a modular building system, according to an embodiment of the invention.
Figure 26D:
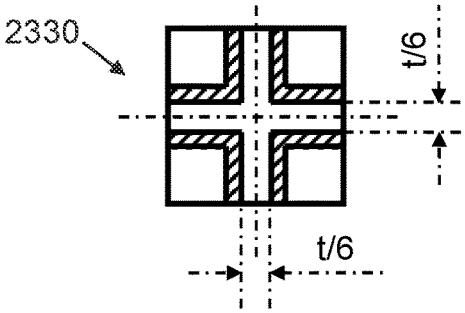
FIG. 26D is a sectional view of a T6K-2 stick of a modular building system, taken along section line 26D-26D of FIG. 26A, according to an embodiment of the invention.
Figure 26C:
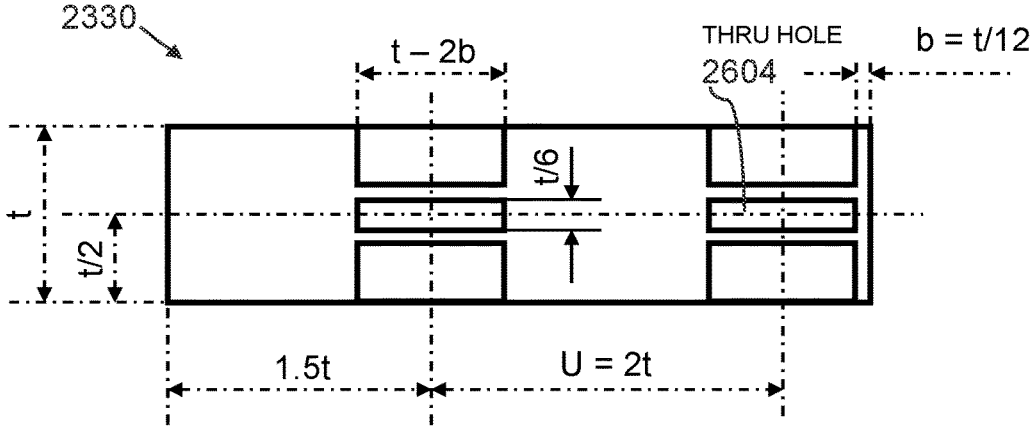
FIG. 26C is a front view of a T6K-2 stick of a modular building system, according to an embodiment of the invention.

In related embodiments, wherein additional strength is required in order to support heavier loads, the plates, beams and sticks can be modified, as shown in FIGS. 21 and 22. We will add the letter "R" to the coding designation of these plates to denote "reinforced". Such reinforced components can include:

a) A P6R-22 plate 2100, as shown in FIG. 21; and
b) A T6R-2 stick 2200, as shown in FIG. 22.

Figure 27:
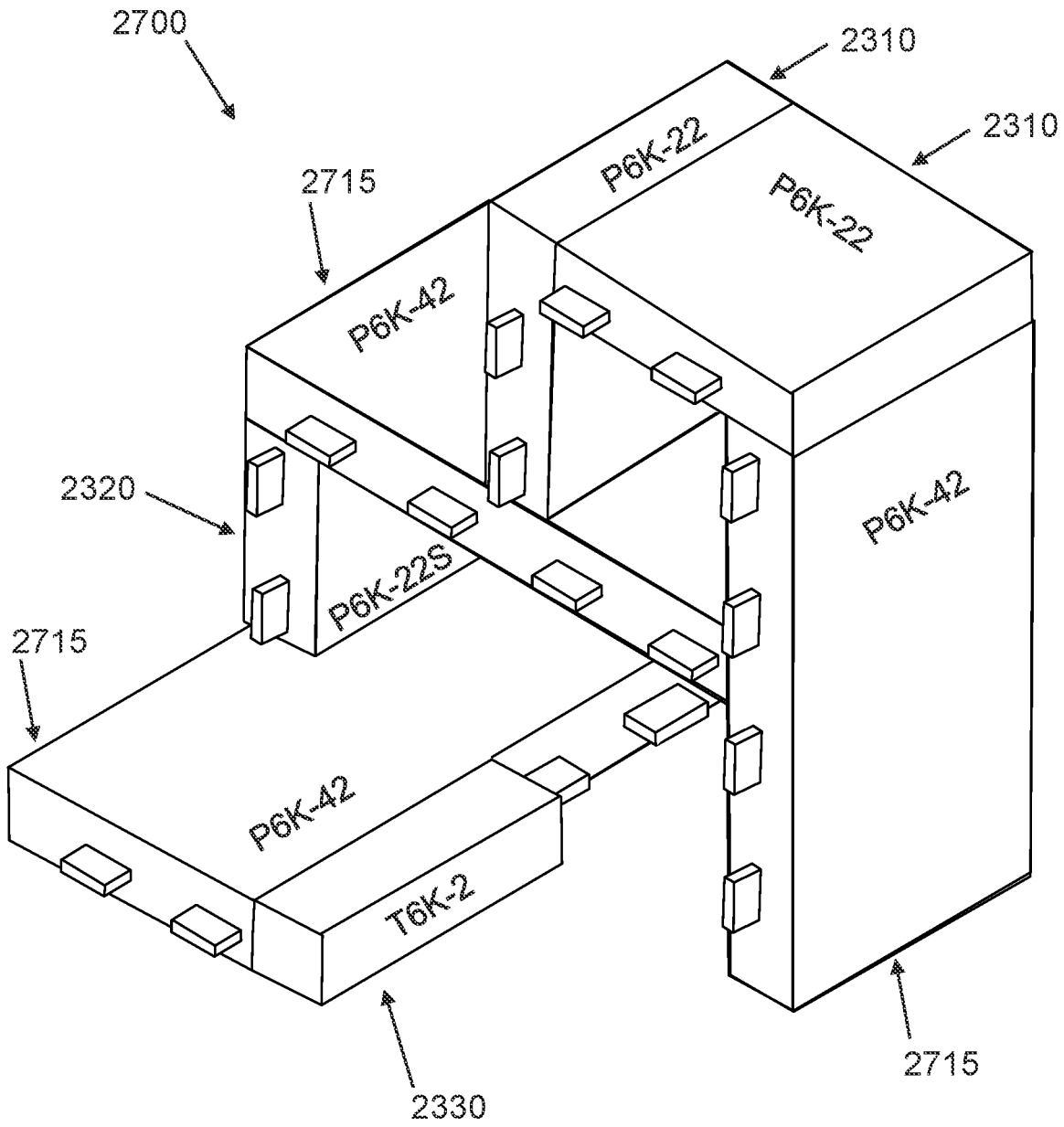
FIG. 27 is a perspective view of an assembly of blocks of the modular building system, according to an embodiment of the invention.

In related embodiments, If the unit length is chosen as U=2*t:

a) the building system 2700, as shown in FIG. 27, can be applied to construct a set of building blocks that can be used as toys. This concept extends on well-similar to the established LEGO™ system, except that instead of mating in one direction only, the blocks (or bricks) can mate in all 3 coordinate directions;
b) To distinguish these blocks from the previous applications, the letter "K" (standing for "block" or brick") will be added to the end of the designation; and
c) There will be no beams in this configuration, only blocks and sticks.

In related practical embodiments, we may choose the ¾" thickness ("6"-series) to exemplify the concept, wherein the number of individual blocks and sticks can be limited as defined by Tables E and F below:

a) A block configuration Table E:

TABLE E

| | | LENGTH [units] | | | | | |
|---|---|---|---|---|---|---|---|
| | | 1 | | 2 | | 4 | |
| P6K | | | S | | S | | S |
| WIDTH | 1 | 11 | 11S | 21 | 21S | 41 | 41S |
| [units] | 2 | | 12S | 22 | 22S | 42 | 42S |

b) A stick configuration Table F:

TABLE F

| | LENGTH [units] | | |
|---|---|---|---|
| T6K | 1 | 2 | 4 |

Wherein, in related embodiments:

a) Since the thickness of any block is ¾", a P6K-11 block will be 1½" long and 1½" wide;
b) Similarly, a P6K-22 block 2310 will be 3" long and 3" wide. A related embodiment of a P6K-22 block 2310 can be configured with elongated protruding structures/pins 2402, elongated thru-holes 2404, and elongated blind-holes 2406, as shown in FIGS. 23A and 24A-24C;
c) A P6K-42 block 2715 can be formed of two connected P6K-22 blocks 2310;
d) A P6K-11S block will be ¾" long and 1½" wide;
e) Similarly, a P6K-22S block 2320 will be 2¼" long and 3" wide. A related embodiment of a P6K-22S block 2320 can be configured with elongated protruding structures/pins 2502, elongated thru-holes 2504, and elongated blind-holes 2506, as shown in FIGS. 23B and 25A-25C;
f) A T6K-1 stick will be 1½" long and ¾" wide; and
g) Similarly, a T6K-2 stick 2330 will be 3" long and ¾" wide. A related embodiment of a T6K-2 stick 2330 can be configured with elongated protruding structures/pins 2602 and elongated thru-holes 2604, as shown in FIGS. 23C and 26A-26C.

In related embodiments, the blocks and sticks can be manufactured by injection-molding of a plastic material. This method requires the parts to be constructed out of thin walls of a certain thickness. FIGS. 24A-24D, 25A-25D, 26A-26D, illustrate dimensions for a P6K-22 regular block 2310, a P6K-22S short block 2320, and a T6K-2 stick 2330, respectively; designed specifically for this manufacturing method.

In other related embodiment, the bosses and holes can be designed with fillet radii for easy assembly as well as for increased strength and better manufacturability. Other design consideration can include specifications for draft angles, parting lines, slides, gates, ejector marks, colors, grains, tolerances, fits and finishes, etc.

An example of an assembled block structure/system 2700, is shown in FIG. 27.

Thus, in an embodiment, as shown in FIGS. 1, 2A, and 6A-6E, a modular building system 100 can include:

a) a plurality of plates 110, each corresponding plate 110 including:

i. at least one thru-hole 609, which penetrates from a top surface of the corresponding plate to a bottom surface of the corresponding plate;

ii. at least one blind side hole 611, which is positioned in a first side of the corresponding plate; and iii. at least one protruding connector 608, which is positioned in a second side of the corresponding plate;

such that a corresponding protruding connector 608 of a first plate in the plurality of plates 110 is configured to be detachably insertable into a corresponding thru-hole 609 or a corresponding side hole 611, 613 of a second plate 110 in the plurality of plates 110, such that the first plate 110 and the second plate 110 are detachably connectable;

wherein a plate length 242, 642, a plate width 244, 644, and a plate thickness 246, 646 (also referred to as a plate height 246, 646) of the corresponding plate 110, 200 are determined, such that:

the plate length 242, 642=$2^i$*U−s*t;

the plate width 244, 644=$2^j$*U; and the plate thickness 246, 646=t;

wherein i and j are natural numbers;

U 601 is a unit dimension; and s is 0 or 1, such that:

when s=0 the corresponding plate is configured as a regular plate; and when s=1 the corresponding plate is configured as a short plate.

In a related embodiment, U 601 can be an even multiple oft, the plate thickness 246, 646.

In another related embodiment, the at least one protruding connector 608 can be a circular pin 608, and the at least one penetrating/thru-hole hole 609 and the at least one side hole 611, 613 can be circular apertures.

In yet another related embodiment, the modular building system 100 can be configured such that:

a) U=8*t;

wherein the plurality of plates 110, 200 comprises at least one smallest regular plate 200 (as shown in FIGS. 5A-5C), which is configured with a regular length 542, a regular width 544, and a regular thickness 546, such that:

i. the regular length 542=8*t;

ii. the regular width 544=8*t; and iii. the regular thickness 546=t; and wherein the plurality of plates comprises at least one smallest short plate, which is configured with a short length 842, a short width 844, and a short thickness 846, such that:

iv. the short length 842=7*t;

v. the short width 844=8*t; and vi. the short thickness 846=t.

In another related embodiment, as shown in FIGS. 3A-3B and 12A-12B, the modular building system 100 can further include:

a) a plurality of beams 300, 1200;

wherein a beam length 342 and a beam width 344 of each corresponding beam 300, 1200 in the plurality of beams 300, 1200 can be determined, such that:

i. the beam length 342=$2^i$*U−s*t;

ii. the beam width 344=U/2; and iii. the beam thickness 346=t;

wherein when s=0 the corresponding beam 300 is configured as a regular beam 300; and when s=1 the corresponding beam 1200 is configured as a short beam 1200.

In a further related embodiment, as shown in FIGS. 4A-4B, the modular building system 100 can further include:

a) a plurality of sticks 400, wherein each corresponding stick 400, is configured as an elongated member with a square cross-section of equal stick width 444 and stick thickness 446, and wherein a stick length 442, a stick width 444, and a stick thickness 446 of the corresponding stick is determined, such that:

i. the stick length 442=$2^i$*U−s*t;

ii. the stick width 444=t; and iii. the stick thickness 446=t.

In another related embodiment, as shown in FIGS. 6A-6E, each corresponding regular plate 110 in the plurality of plates 110 can further include:

a) a first plurality of blind side holes 611, which are placed linearly, symmetrically, and equidistantly along a longitudinal front centerline 649 of a front side of the corresponding regular plate 110, relative to a center lateral offset line 618 that is offset 617 by half a plate thickness from a lateral centerline 619 of the corresponding regular plate;

b) a second plurality of blind side holes 613, which are placed linearly, symmetrically, and equidistantly along a lateral left centerline 639 of a left side of the corresponding regular plate, relative to a center longitudinal offset line 658 that is offset 657 by half a plate thickness from a longitudinal centerline 659 of the corresponding regular plate;

c) a first plurality of protruding connectors 608, which are placed linearly, symmetrically, and equidistantly along a rear side of the corresponding regular plate 110, relative to the center lateral offset line 618, such that the first plurality of protruding connectors 608 are laterally aligned with the first plurality of blind side holes 611; and d) a second plurality of protruding connectors 628, which are placed linearly, symmetrically, and equidistantly along a right side of the corresponding regular plate 110, relative to the center longitudinal offset line 658; whereby the second plurality of protruding connectors 628 are longitudinally aligned with the second plurality of blind side holes 613.

In a further related embodiment, each corresponding regular plate in the plurality of plates can further include:

a) a first plurality of thru-holes 609, which are placed linearly, symmetrically, and equidistantly relative to the center lateral offset line 618, such that the first plurality of thru-holes 609 are placed along the front longitudinal offset line 652, which is offset by half the plate thickness 246 from a front edge of a top side of the corresponding regular plate 110,
such that the first plurality of thru-holes 609 is laterally aligned with the first plurality of protruding connectors 608 and the first plurality of blind side holes 611; and b) a second plurality of thru-holes 609, which are placed linearly, symmetrically, and equidistantly relative to the center longitudinal offset line 658, such that the second plurality of thru-holes 609 are placed along a left lateral offset line 612, which is offset by half the plate thickness 246 from a left edge of the top side of the corresponding regular plate 110,
such that the second plurality of thru-holes 609 is longitudinally aligned with the second plurality of protruding connectors 628 and the second plurality of blind side holes 613.

In a yet further related embodiment, for multiple-unit plates only, each corresponding regular plate in the plurality of plates can further include:

a) at least one additional plurality of longitudinal thru-holes 609, which are offset 641 in a lateral direction from the first plurality of thru-holes by a multiple of U; and b) at least one additional plurality of lateral thru-holes 609, which are offset 601 in a longitudinal direction from the second plurality of thru-holes by a multiple of U.

In a related embodiment, as shown in FIGS. 9A-9E, each corresponding short plate 900 in the plurality of plates 110, 900 can further include:

a) a first plurality of blind side holes 911, which are placed linearly, symmetrically, and equidistantly along a longitudinal front centerline 949 of a front side of the corresponding short plate, relative to a lateral centerline 919 of the corresponding short plate 900;

b) a first plurality of protruding connectors 918, which are placed linearly, symmetrically, and equidistantly along a lateral left centerline 939 of a left side of the corresponding short plate 900, relative to a center longitudinal offset line 958 that is offset 957 by half a plate thickness from a longitudinal centerline 959 of the corresponding short plate 900;

c) a second plurality of protruding connectors 908, which are placed linearly, symmetrically, and equidistantly along a rear side of the corresponding short plate 900, relative to the lateral centerline 919 of the corresponding short plate 900, such that the second plurality of protruding connectors 908 are laterally aligned with the first plurality of blind side holes 911; and d) a third plurality of protruding connectors 928, which are placed linearly, symmetrically, and equidistantly along a right side of the corresponding short plate, relative to the center longitudinal offset line 958;
such that the third plurality of protruding connectors 928 are longitudinally aligned with the first plurality of protruding connectors 918.

In a further related embodiment, each corresponding short plate 900 in the plurality of plates 110, 900 can further include:

a) a plurality of corresponding thru-holes 909, which are placed linearly, symmetrically, and equidistantly relative to the lateral centerline 919, such that the plurality of corresponding thru-holes 909 are placed along the front longitudinal offset line 952, which is offset by half the plate thickness from a front edge of a top side of the corresponding short plate 900,
such that the plurality of corresponding thru-holes 909 is laterally aligned with the second plurality of protruding connectors 908 and the first plurality of blind side holes 911.

In a yet further related embodiment, for multiple-unit plates only, each corresponding short plate 900 in the plurality of plates 110, 900 can further include:

a) at least one additional plurality of longitudinal thru-holes 909, which are offset 941 in a lateral direction from the plurality of corresponding thru-holes 909 by a multiple of U.

In a related embodiment, as shown in FIGS. 11A-11E, each corresponding regular beam 1100 in the plurality of beams 1100 can further include:

a) a left blind side hole 1113, which is positioned on a left side of the corresponding regular beam 1100, aligned with a center longitudinal offset line 1158 that is offset 1157 by half a beam thickness from a longitudinal centerline 1159 of the corresponding regular beam 1100;

b) a first plurality of protruding connectors 1108, which are placed linearly, symmetrically, and equidistantly along a rear side of the corresponding regular beam, relative to a center lateral offset line 1118 that is offset 1117 by half a beam thickness from a lateral centerline 1119 of the corresponding regular beam 1100; and c) a right protruding connector 1128, which is positioned on a right side of the corresponding regular beam 1100, such that the right protruding connector 1128 is aligned with the center longitudinal offset line 1158 and with the left blind side hole 1113.

In a further related embodiment, each corresponding regular beam 1100 in the plurality of beams can 1100 further include:

a) a first thru-hole 1107, which is placed on a top side of the corresponding regular beam on an intersection of the center longitudinal offset line 1158 and a left lateral offset line 1112, which is offset by half the beam thickness from a left edge of the top side of the corresponding regular beam 1100; and b) at least one second thru-hole 1109 (for multiple-unit plates only), which is placed on the top side of the corresponding regular beam 1100 along the center lateral offset line on the top side of the corresponding regular beam 1100, with a right offset 1101 of U.

In another related embodiment, as shown in FIGS. 13A-13E, each corresponding short beam 1300 in the plurality of beams 1100, 1300 can further include:

a) a left protruding connector 1316, which is positioned on a left side of the corresponding short beam 1300, aligned with a center longitudinal offset line 1358 that is offset 1357 by half the beam thickness from a longitudinal centerline 1159 of the corresponding short beam 1300;

b) a first plurality of protruding connectors 1308, which are placed linearly, symmetrically, and equidistantly along a rear side of the corresponding short beam 1300, relative to a lateral centerline 1318 of the corresponding short beam 1300; and c) a right protruding connector 1328, which is positioned on a right side of the corresponding short beam 1300, such that the right protruding connector 1328 is aligned with the center longitudinal offset line 1358 and with the left protruding connector 1316, such that the left protruding connector 1316 and the right protruding connector 1328 are longitudinally aligned.

In a yet further related embodiment, for multiple-unit beams only, each corresponding short beam in the plurality of beams can further include:

a) a first thru-hole 1309, which is placed on a top side of the corresponding short beam on an intersection of the center longitudinal offset line 1358 and the lateral centerline 1318; and b) at least one thru-hole, which is placed on the top side of the corresponding short beam along the center longitudinal offset line 1358, with right offsets of U.

In another related embodiment, as shown in FIGS. 15A-15E, each corresponding stick 1500 in the plurality of sticks 1500 can further include:

a) a first plurality of thru-holes 1509, which are placed linearly, symmetrically, and equidistantly along a longitudinal thru-hole center line 1521 of a top side of the corresponding stick 1500, relative to a center lateral offset line 1518 that is offset 1517 by half a stick thickness from a lateral centerline 1519 of the corresponding stick; and b) a second plurality of thru-holes 1511, which are placed linearly, symmetrically, and equidistantly along a longitudinal front center line 1549 of a front side of the corresponding stick, relative to the center lateral offset line 1518;

such that the first plurality of thru-holes 1509 and the second plurality of thru-holes 1511 are laterally aligned.

In another embodiment, a modular building system 100 can include:

a) a plurality of plates 500, 800, as shown in FIGS. 5A-5C and 8A-8C comprising:

i. a plurality of smallest size regular plates 500; and ii. a plurality of smallest size short plates 800; and wherein each corresponding plate 500, 800 in the plurality of plates 500, 800 can include:

1) at least one thru-hole 511, 811 which penetrates from a top surface of the corresponding plate to a bottom surface of the corresponding plate;

2) at least one blind side hole 881, 882 which is positioned in a first side of the corresponding plate; and 3) at least one protruding connector 531, 831, 832, 851, 852;

such that a corresponding protruding connector 531, 831, 832, 851, 852 of a first plate 500, 800 in the plurality of plates is configured to be detachably insertable into a corresponding thru-hole 511, 811 or a corresponding blind side hole 881, 882 of a second plate 500, 800 in the plurality of plates 500, 800, such that the first plate 500, 800 and the second plate 500, 800 are detachably connectable;

wherein a plate length 542, 842, a plate width 544, 844, and a plate thickness 546, 846 of the corresponding plate 500, 800 are determined, such that:

the plate length 542, 842=U−s*t;

the plate width 544, 844=U; and the plate thickness 546, 846=t;

wherein:

U is a unit dimension; and s is 0 or 1, such that:

when s=0 the corresponding plate is configured as a smallest size regular plate 500; and when s=1 the corresponding plate is configured as a smallest size short plate 800.

In a related embodiment, the modular building system 100 can be configured such that:

a) U=8*t;

wherein each smallest regular plate 500 is configured with a regular length 542, a regular width 544, and a regular thickness 546, such that:

i. the regular length 542=8*t;

ii. the regular width 544=8*t; and iii. the regular thickness 546=t; and wherein each smallest short plate 800 is configured with a short length 842, a short width 844, and a short thickness 846, such that:

iv. the short length 842=7*t;

v. the short width 844=8*t; and vi. the short thickness 846=t.

In a related embodiment, as shown in FIGS. 10A-10B and 12A-12B, the modular building system 100 can further include:

a) a plurality of beams 1000, 1200, comprising i. a plurality of smallest size regular beams 1000; and ii. a plurality of smallest size short beams 1200;

wherein a beam length 1042, 1242, a beam width 1044, 1244, and a beam thickness 1046, 1246 of each corresponding beam 1000, 1200 in the plurality of beams 1000, 1200 are determined, such that:

1) the beam length 1042, 1242=U−s*t;

2) the beam width 1044, 1244=U/2; and 3) the beam thickness 1046, 1246=t;

wherein:

when s=0 the corresponding beam is configured as a regular beam 1000; and when s=1 the corresponding beam is configured as a short beam 1200.

In a further related embodiment, as shown in FIG. 14, the modular building system 100 can further include:

a) a plurality of smallest size sticks 1400, wherein each corresponding smallest size stick is configured as an elongated member with a square cross-section of equal stick width 1444 and stick thickness 1446, and wherein a stick length 1442, the stick width 1444, and the stick thickness 1446 of the corresponding smallest size stick is determined, such that:

i. the stick length 1442=U−s*t;

ii. the stick width 1442=t; and iii. the stick thickness 1446=t.

In a related embodiment, as shown in FIGS. 19A-19D and 20A-20C, the modular building system 100 can further include:

a) a plurality of tubular rivets 1900, wherein each corresponding tubular rivet 1900 can include:

i. a first outer section 1912, comprising a first outer aperture 1913, positioned on a first side of the corresponding tubular rivet 1900, wherein the first outer aperture 1913 is configured to receive a first selected protruding connector 2015, which is attached to a selected plate or selected beam; and ii. a second outer section 1914, comprising a second outer aperture 1915, positioned on a second side of the corresponding tubular rivet;

wherein the second outer aperture 1915 is configured to receive a second selected protruding connector 2015, which is attached to a selected plate or selected beam;

wherein the corresponding tubular rivet 1900 is configured to be mounted in the corresponding plate 1814, such that the corresponding tubular rivet forms a periphery of the at least one thru-hole 511, 811.

In a further related embodiment, each corresponding tubular rivet 1900 can further include:

a) a middle tubular section 1916 comprising inner threading 1918, which is configured to receive a screw 1824, wherein the middle tubular section 1916 is positioned between the first outer section 1912 and the second outer section 1914, and wherein a middle aperture 1917 of the middle tubular section 1916 is narrower than each of the first outer aperture and the second outer aperture;

such that the corresponding tubular rivet is configured as a threaded tubular rivet 1900, which is configured to enable attachment of a bracket 1822 to the corresponding plate 1814, such that the bracket 1822 is securable with the screw 1824 screwed through the bracket 1822 and into the inner threading 1918 of the middle tubular section 1916.

Here has thus been described a multitude of embodiments of the modular building system 100, and methods related thereto, which can be employed in numerous modes of usage.

The many features and advantages of the invention are apparent from the detailed specification, and thus, it is intended by the appended claims to cover all such features and advantages of the invention, which fall within the true spirit and scope of the invention.

Many such alternative configurations are readily apparent and should be considered fully included in this specification and the claims appended hereto. Accordingly, since numerous modifications and variations will readily occur to those skilled in the art, the invention is not limited to the exact construction and operation illustrated and described, and thus, all suitable modifications and equivalents may be resorted to, falling within the scope of the invention.

What is claimed is:

1. A modular building system, comprising:

a plurality of plates, each corresponding plate comprising:

at least one thru-hole, which penetrates from a top surface of the corresponding plate to a bottom surface of the corresponding plate;

at least one blind side hole, which is positioned in a first side of the corresponding plate; and at least one protruding connector, which is positioned in a second side of the corresponding plate;

such that a corresponding protruding connector of a first plate in the plurality of plates is configured to be detachably insertable into a corresponding thru-hole or a corresponding side hole of a second plate in the plurality of plates, such that the first plate and the second plate are detachably connectable;

wherein a plate length, a plate width, and a plate thickness of the corresponding plate are determined, such that:

the plate length=$2^i$*U−s*t;

the plate width=$2^j$*U; and the plate thickness=t;

wherein i and j are natural numbers;

U is a unit dimension; and s is 0 or 1, such that:

when s=0 the corresponding plate is configured as a regular plate; and when s=1 the corresponding plate is configured as a short plate.

2. The modular building system of claim 1, wherein U is an even multiple oft.

3. The modular building system of claim 1, wherein the at least one protruding connector is a pin and the at least one thru-hole and the at least one blind side hole are circular apertures.

4. The modular building system of claim 1, wherein:

U=8*t;

wherein the plurality of plates comprises at least one smallest regular plate, which is configured with a regular length, a regular width, and a regular thickness, such that:

the regular length=8*t;

the regular width=8*t; and the regular thickness=t; and wherein the plurality of plates comprises at least one smallest short plate, which is configured with a short length, a short width, and a short thickness, such that:

the short length=7*t;

the short width=8*t; and the short thickness=t.

5. The modular building system of claim 1, further comprising:

a plurality of beams;

wherein a beam length, a beam width, and a beam thickness of each corresponding beam in the plurality of beams are determined, such that:

the beam length=$2^i$*U−s*t;

the beam width=U/2; and the beam thickness=t;

wherein when s=0 the corresponding beam is configured as a regular beam; and when s=1 the corresponding beam is configured as a short beam.

6. The modular building system of claim 1, further comprising:

a plurality of sticks, wherein each corresponding stick is configured as an elongated member with a square cross-section;

wherein a stick length, a stick width, and a stick thickness of the corresponding stick is determined, such that:

the stick length=$2^i$*U−s*t;

the stick width=t; and the stick thickness=t.

7. The modular building system of claim 1, wherein each corresponding regular plate in the plurality of plates further comprises:

a) a first plurality of blind side holes, which are placed symmetrically and equidistantly along a front side of the corresponding regular plate, relative to a center lateral offset line that is offset by half the plate thickness from a lateral centerline of the corresponding regular plate;

b) a second plurality of blind side holes, which are placed symmetrically and equidistantly along a left side of the corresponding regular plate, relative to a center longitudinal offset line that is offset by half the plate thickness from a longitudinal centerline of the corresponding regular plate;

c) a first plurality of protruding connectors, which are placed symmetrically and equidistantly along a rear side of the corresponding regular plate, relative to the center lateral offset line, such that the first plurality of protruding connectors are laterally aligned with the first plurality of blind side holes; and d) a second plurality of protruding connectors, which are placed symmetrically and equidistantly along a right side of the corresponding regular plate, relative to the center longitudinal offset line;

whereby the second plurality of protruding connectors are longitudinally aligned with the second plurality of blind side holes.

8. The modular building system of claim 7, wherein each corresponding regular plate in the plurality of plates further comprises:

a) a first plurality of thru-holes, which are placed symmetrically and equidistantly relative to the center lateral offset line, such that first plurality of thru-holes are placed along a front longitudinal offset line, which is offset by half the plate thickness from a front edge of a top side of the corresponding regular plate, such that the first plurality of thru-holes is laterally aligned with the first plurality of protruding connectors and the first plurality of blind side holes; and b) a second plurality of thru-holes, which are placed symmetrically and equidistantly relative to the center longitudinal offset line, such that the second plurality of thru-holes are placed along a left lateral offset line, which is offset by half the plate thickness from a left edge of the top side of the corresponding regular plate, such that the second plurality of thru-holes is longitudinally aligned with the second plurality of protruding connectors and the second plurality of blind side holes.

9. The modular building system of claim 8, wherein each corresponding regular plate in the plurality of plates further comprises:

a) at least one additional plurality of longitudinal thru-holes, which are offset in a lateral direction from the first plurality of thru-holes by a multiple of U;

b) at least one additional plurality of lateral thru-holes, which are offset in a longitudinal direction from the second plurality of thru-holes by a multiple of U.

10. The modular building system of claim 1, wherein each corresponding short plate in the plurality of plates further comprises:

a) a first plurality of blind side holes, which are placed symmetrically and equidistantly along a front side of the corresponding short plate, relative to a lateral centerline of the corresponding short plate;

b) a first plurality of protruding connectors, which are placed symmetrically and equidistantly along a left side of the corresponding short plate, relative to a center longitudinal offset line that is offset by half the plate thickness from a longitudinal centerline of the corresponding short plate;

c) a second plurality of protruding connectors, which are placed symmetrically and equidistantly along a rear side of the corresponding short plate, relative to the lateral centerline of the corresponding short plate, such that the second plurality of protruding connectors are laterally aligned with the first plurality of blind side holes; and d) a third plurality of protruding connectors, which are placed symmetrically and equidistantly along a right side of the corresponding short plate, relative to the center longitudinal offset line;

whereby the third plurality of protruding connectors are longitudinally aligned with the first plurality of protruding connectors.

11. The modular building system of claim 10, wherein each corresponding short plate in the plurality of plates further comprises:

a plurality of corresponding thru-holes, which are placed symmetrically and equidistantly relative to the lateral centerline, such that the plurality of corresponding thru-holes are placed along a front longitudinal offset line, which is offset by half the plate thickness from a front edge of a top side of the corresponding short plate, such that the plurality of corresponding thru-holes is laterally aligned with the second plurality of protruding connectors and the first plurality of blind side holes.

12. The modular building system of claim 11, wherein each corresponding short plate in the plurality of plates further comprises:

at least one additional plurality of longitudinal thru-holes, which are offset in a lateral direction from the plurality of corresponding thru-holes by a multiple of U.

13. The modular building system of claim 5, wherein each corresponding regular beam in the plurality of beams further comprises:

a) a left blind side hole, which is positioned on a left side of the corresponding regular beam, aligned with a center longitudinal offset line that is offset by half the beam thickness from a longitudinal centerline of the corresponding regular beam;

b) a first plurality of protruding connectors, which are placed symmetrically and equidistantly along a rear side of the corresponding regular beam, relative to a center lateral offset line that is offset by half the beam thickness from a lateral centerline of the corresponding regular beam; and c) a right protruding connector, which is positioned on a right side of the corresponding regular beam, such that the right protruding connector is aligned with the center longitudinal offset line and with the left blind side hole.

14. The modular building system of claim 13, wherein each corresponding regular beam in the plurality of beams further comprises:

a first thru-hole, which is placed on a top side of the corresponding regular beam on an intersection of the center longitudinal offset line and a left lateral offset line, which is offset by half the beam thickness from a left edge of the top side of the corresponding regular beam.

15. The modular building system of claim 14, wherein each corresponding regular beam in the plurality of beams further comprises:

at least one second thru-hole, which is placed on the top side of the corresponding regular beam along the center lateral offset line, with a right offset of U.

16. The modular building system of claim 5, wherein each corresponding short beam in the plurality of beams further comprises:

a) a left protruding connector, which is positioned on a left side of the corresponding short beam, aligned with a center longitudinal offset line that is offset by half the beam thickness from a longitudinal centerline of the corresponding short beam;

b) a first plurality of protruding connectors, which are placed symmetrically and equidistantly along a rear side of the corresponding short beam, relative to a lateral centerline of the corresponding short beam; and c) a right protruding connector, which is positioned on a right side of the corresponding short beam, such that the right protruding connector is aligned with the center longitudinal offset line and with the left protruding connector.

17. The modular building system of claim 16, wherein each corresponding short beam in the plurality of beams further comprises:

at least one thru-hole, which is placed on a top side of the corresponding short beam along the center longitudinal offset line, with right offsets of U.

18. The modular building system of claim 6, wherein each corresponding stick in the plurality of sticks further comprises:

a) a first plurality of thru-holes, which are placed symmetrically and equidistantly along a top side of the corresponding stick, relative to a center lateral offset line that is offset by half the stick thickness from a lateral centerline of the corresponding stick; and b) a second plurality of thru-holes, which are placed symmetrically and equidistantly along a front side of the corresponding stick, relative to the center lateral offset line;

such that the first plurality of thru-holes and the second plurality of thru-holes are laterally aligned.

19. The modular building system of claim 1, further comprising:

a plurality of tubular rivets, wherein each corresponding tubular rivet comprises:

a first outer section, comprising a first outer aperture, positioned on a first side of the corresponding tubular rivet, wherein the first outer aperture is configured to receive a first selected protruding connector; and a second outer section, comprising a second outer aperture, positioned on a second side of the corresponding tubular rivet;

wherein the second outer aperture is configured to receive a second selected protruding connector;

wherein the corresponding tubular rivet is configured to be mounted in the corresponding plate, such that the corresponding tubular rivet forms a periphery of the at least one thru-hole.

20. The modular building system of claim 19, wherein each corresponding tubular rivet further comprises:

a middle tubular section comprising an inner threading, which is configured to receive a screw, wherein the middle tubular section is positioned between the first outer section and the second outer section, and wherein a middle aperture of the middle tubular section is narrower than each of the first outer aperture and the second outer aperture;

such that the corresponding tubular rivet is configured as a threaded tubular rivet, which is configured to enable attachment of a bracket to the corresponding plate, such that the bracket is securable with the screw screwed through the bracket and into the inner threading of the middle tubular section.

21. A modular building system, comprising:

a plurality of plates, comprising:

a plurality of smallest size regular plates; and a plurality of smallest size short plates; and wherein each corresponding plate in the plurality of plates comprises:

at least one thru-hole, which penetrates from a top surface of the corresponding plate to a bottom surface of the corresponding plate; and;

at least one blind side hole, which is positioned in a first side of the corresponding plate; and at least one protruding connector;

such that a corresponding protruding connector of a first plate in the plurality of plates is configured to be detachably insertable into a corresponding thru-hole or a corresponding side hole of a second plate in the plurality of plates, such that the first plate and the second plate are detachably connectable;

wherein a plate length, a plate width, and a plate thickness of the corresponding plate are determined, such that:

the plate length=U−s*t;

the plate width=U; and the plate thickness=t;

wherein:

U is a unit dimension; and s is 0 or 1, such that:

when s=0 the corresponding plate is configured as a smallest size regular plate; and when s=1 the corresponding plate is configured as a smallest size short plate.

22. The modular building system of claim 21, wherein U is an even multiple oft.

23. The modular building system of claim 21, wherein the at least one protruding connector is a pin and the at least one thru-hole and the at least one blind side hole are circular apertures.

24. The modular building system of claim 21, wherein:

U=8*t;

wherein each smallest regular plate is configured with a regular length, a regular width, and a regular thickness, such that:

the regular length=8*t;

the regular width=8*t; and the regular thickness=t; and wherein each smallest short plate is configured with a short length, a short width, and a short thickness, such that:

the short length=7*t;

the short width=8*t; and the short thickness=t.

25. The modular building system of claim 21, further comprising:

a plurality of beams, comprising a plurality of smallest size regular beams; and a plurality of smallest size short beams;

wherein a beam length, a beam width, and a beam thickness of each corresponding beam in the plurality of beams are determined, such that:

the beam length=U−s*t;

the beam width=U/2; and the beam thickness=t;

wherein when s=0 the corresponding beam is configured as a regular beam; and when s=1 the corresponding beam is configured as a short beam.

26. The modular building system of claim 21, further comprising:

a plurality of smallest size sticks, wherein each corresponding smallest size stick is configured as an elongated member with a square cross-section of equal stick width and stick thickness, and wherein a stick length, a stick width, and a stick thickness of the corresponding smallest size stick is determined, such that:

the stick length=U−s*t;

the stick width=t; and the stick thickness=t.

* * * * *